US009741521B1

(12) United States Patent
Perkins

(10) Patent No.: US 9,741,521 B1
(45) Date of Patent: Aug. 22, 2017

(54) VACUUM ELECTRON DEVICE DRIFT TUBE

(71) Applicant: VAREX IMAGING CORPORATION, Salt Lake City, UT (US)

(72) Inventor: Michael P. Perkins, Henderson, NV (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 0 days.

(21) Appl. No.: 15/267,111

(22) Filed: Sep. 15, 2016

(51) Int. Cl.

| | |
|---|---|
| ***H01J 23/00*** | (2006.01) |
| ***H01J 23/20*** | (2006.01) |
| ***H01J 25/12*** | (2006.01) |
| ***H01P 7/06*** | (2006.01) |

(52) U.S. Cl.
CPC ..... *H01J 23/20* (2013.01); *H01J 25/12* (2013.01); *H01P 7/06* (2013.01)

(58) Field of Classification Search
CPC .... A61B 2560/0204; A61B 2560/0219; A61B 2562/226; A61B 2562/227; A61B 5/0002; A61B 5/1113; A61B 5/6887; A61B 5/6891; A61B 5/6892; A61B 5/0031; A61B 5/14539; A61B 5/742; A61B 1/041; A61B 2034/2051; A61B 2034/2063; A61B 2034/2072; A61B 2090/3929; A61B 2090/3966; A61B 2562/0247; A61B 50/13; A61B 5/0017; A61G 12/00; A61G 2203/70; H01J 35/025; H01J 35/14
See application file for complete search history.

(56) References Cited

U.S. PATENT DOCUMENTS

| | | | |
|---|---|---|---|
| 8,076,853 | B1 | 12/2011 | Caryotakis |
| 2015/0060052 | A1 | 3/2015 | Caryotakis |

FOREIGN PATENT DOCUMENTS

| | | | |
|---|---|---|---|
| WO | 2010129657 | A1 | 11/2010 |

OTHER PUBLICATIONS

Yu D., Wilson, P., "Sheet Beam Klystron RF Cavities", PAC93, 1993, pp. 2681-2683, webpage http://epaper.kek.jp/p93/PDF/PAC1993_2681.PDF, accessed Sep. 15, 2016.
Main, M., Carmel Y., et al., "Electromagnetic Properties of Open and Closed Overmoded Slow-Wave Resonators for Interaction with Relativistic Electron Beams", IEEE Transactions on Plasma Science, vol. 22, No. 5, Oct. 1994, pp. 566-577.
(Continued)

*Primary Examiner* — Monica C King
(74) *Attorney, Agent, or Firm* — David Wilding

(57) ABSTRACT

Technology is described for vacuum electron device (e.g., sheet beam klystron) that includes a hollow tube structure. In one example, the hollow tube structure includes at least three resonant cavities and at least two drift tube sections. Each resonant cavity includes a cavity width along a major axis and a cavity height along a minor axis. Each drift tube section includes a drift tube section width and a drift tube section height, and the cavity height is greater than the drift tube section height. A first drift tube section is disposed between a first resonant cavity and a second resonant cavity. A second drift tube section is disposed between the second resonant cavity and a third resonant cavity. A drift tube section width of the first drift tube section is substantially different from a drift tube section width of the second drift tube section.

40 Claims, 29 Drawing Sheets

(56) References Cited

OTHER PUBLICATIONS

Colby, E.R., Caryotakis, G., Fowkes, W.R., Smithe, D.N. "W-Band Sheet Beam Klystron Simulation", Proc. High-Energy Density Microwaves, vol. 474, 1998, pp. 74.

Solyga S., Henke H, "Two-Dimensional Design of a Low Voltage mm-Wave Sheet Beam Klystron", ITG-Conference: Displays and Vacuum Electronics, Garmisch-Partenkirchen, Germany, Apr. 29-30, 1998.

Nlyfors, E.G., "Cylindrical Microwave Resonator Sensors for Measuring Material Under Flow", Dissertation for the degree of Doctor of Science in Technology, Helsinki University of Technology, Report S243, May 2000.

Teryaev, V., "Trapped Modes in Toshiba PPM Klystron and Simulation of Self-Excitation", 9th ISG Meeting, 2002.

Shin, Y.M., Park, G.S., Scheitrum, G.P., Caryotakis, G. "Circuit Analysis of Extended Interaction Klystron", J. Korean Phys, 2004, pp. 1239-1245.

Barker, R.J., Booske, J.H., Luhmann Jr., N.C., Nusinovich, G.S., Modern Microwave and Millimeter-Wave Power Electronics, 2005, Ch. 3, pp. 107-170.

DeFord, J., Held, B., "Calculation of Beam-Loaded Q in High-Power Klystrons", Proc. PAC05, 2005, pp. 4060-4062.

Scheitrum, G, "Design and Construction of a W-band Sheet Beam Klystron", SLAC-PUB-11688, contributed to 7th Workshop on High Energy Density and High Power RF, Jun. 13-17, 2005, Kalamata, Greece.

Bane, K.L.F., Jensen, A., Li, G. Stupakov, C. Adolphsen, C., "Sheet Beam Klystron Instability Analysis", Proc. of PAC09, 2009, pp. 4728-4730.

Sprehn, D., Jongewaard, E., Haase, A., Jensen, A., Martin, D., "Development of a 10 MW Sheet Beam Klystron for the ILC", SLAC-PUB-13598, Apr. 2009, presented at the PAC conference, May 3-8, 2009, Vancouver, Canada, webpage http://www.slac.stanford.edu/cgi-wrap/getdoc/slac-pub-13598.pdf, accessed Sep. 15, 2016.

Cui, J., Luo, J.R., Zhu, M., Guo, W., "Analysis for the Stability of Hughes-Type Coupled Cavity in an Extended-Interaction Klystron", PIERS Proceedings, 2010, pp. 136-139.

Sprehn, D., Haase, A., Jensen, A., Jongewaard, E., Martin, D., "Test and Development of a 10 MW 1.3 GHz Sheet Beam Klystron for the ILC", SLAC-PUB-15142, Jan. 2010, webpage http://www.slac.stanford.edu/pubs/slacpubs/15000/slac-pub-15142.pdf, accessed Sep. 15, 2016.

Zheng-Hong, L., Hong, Z., Bing-Quan, J., Chang, S.U., Yang, W., "Mode Control in a High-Gain Relativistic Klystron Amplifier", Chinese Phys. C., 2010, pp. 598-602.

Jensen, A., Fazio, M., Haase, A., Jongewaard, E., Martin, D., Neilson, J., "Sheet Beam Klystron for the Navy FEL", SLAC-PUB-15330, presented at The 15th Annual Directed Energy Symposium, Albuquerque, New Mexico, Nov. 26-30, 2012, webpage http://slac.stanford.edu/pubs/slacpubs/15250/slac-pub-15330.pdf, accessed Sep. 15, 2016.

Jensen, A., Fazio, Haase, Jongewaard, Neilson, "200 kW CW Sheet Beam Klystron Research and Development", SLAC-PUB-15876, released Jun. 2, 2014, webpage http://www.slac.stanford.edu/pubs/slacpubs/15750/slac-pub-15876.pdf, accessed Sep. 15, 2016.

Yang, W., Hong-Quan, X., Zhou, X., "Mode Control in a High Gain Relativistic Klystron Amplifier with 3 GW Output Power", Chinese Phys. C., 2014, pp. 1-4.

Whites, K.W., EE 481/581. Class Lecture Topic: "Lecture 10: TEM, TE, and TM Modes for Waveguides. Rectangular Waveguide", South Dakota School of Mines and Technology, 2015, webpage http://whites.sdsmt.edu/classes/ee481/notes/481Lecture10.pdf, accessed Sep. 15, 2016.

Chew, W.C., ECE 350 Lecture Notes on Fields and Waves, "Lecture 23. Cavity Resonator", webpage http://wcchew.ece.illinois.edu/chew/ece350.html, accessed Sep. 15, 2016, University of Illinois at Urbana Champaign.

| Configuration | Res. Freq. (GHz) | $Q_0$, for Cu | Calc. Res. Freq. Using Mid. Sects. (GHz) | Calc. Res. Freq. Using Mid. and End Sects. (GHz) |
|---|---|---|---|---|
| 1) Cavity 3 re-entrant, 150 mm drift, TM110 mode | 2.793 | 5270 | N.A. | N.A. |
| 2) Cavity 4 re-entrant, 150 mm drift, TM110 mode | 2.895 | 5310 | N.A. | N.A. |
| 3) Cavity 3 narrow with no re-entrant, 150 mm drift, TM110 mode | 2.793 | 4880 | N.A. | N.A. |
| 4) Cavity 3 re-entrant, 153.3 mm drift on one side and 150 mm on other, TM110 mode | 2.793 | 5260 | N.A. | N.A. |
| 5) Cavity 4 re-entrant, 153.3 mm drift on one side and 150 mm on other, TM110 mode | 2.895 | 5310 | N.A. | N.A. |
| 6) Cavity 3 re-entrant with 1 mm added to total height of middle section, 150 mm drift, TM110 mode | 2.752 | 5250 | N.A. | N.A. |
| 7) Cavity formed by two cavity 3 re-entrant with 150 mm drift, separated by 56 mm, TE302 mode | 4.049 | 1550 | 4.083 | 4.047 |
| 8) Cavity formed by two cavity 3 re-entrant with 1 mm added to total height of middle section of each cavity with 150 mm drift, separated by 56 mm, TE302 mode | 4.034 | 1300 | 4.066 | 4.032 |
| 9) Cavity formed by two cavity 3 not re-entrant with 150 mm drift, separated by 56 mm, TE302 mode | 3.963 | 270 | 4.010 | 3.965 |
| 10) Cavity formed by cavity 3 re-entrant and cavity 4 re-entrant with 150 mm drift, separated by 56 mm, TE302 mode | 4.072 | 1000 | 4.100 | 4.067 |
| 11) Cavity formed by cavity 3 re-entrant with 1 mm added to total height of mid. sect. and cavity 4 re-entrant with 150 mm drift, separated by 56 mm, TE302 mode | 4.064 | 800 | 4.091 | 4.059 |
| 12) Cavity formed by cavity 3 no re-entrant and cavity 4 re-entrant with 150 mm drift, separated by 56 mm, TE302 mode | 4.017 | 170 | 4.062 | 4.023 |
| 13) Cavity formed by cavity 3 no re-entrant and cavity 4 re-entrant with 150 mm drift, separated by 55 mm, TE302 mode | 4.035 | 150 | 4.079 | 4.040 |
| 14) Cavity formed by cavity 3 re-entrant and cavity 4 re-entrant with 153.3 mm drift between and 150 mm on input to cavity 3 and output to cavity 4, separated by 56 mm, TE302 mode | 4.025 | 900 | 4.053 | 4.020 |
| 15) Cavity formed by cavity 3 re-entrant and cavity 4 re-entrant with 153.3 mm at entrance to cavity 3 and 150 mm between 3 and 4 as well and output to cavity 4, separated by 56 mm, TE302 mode | 4.071 | 840 | 4.100 | 4.067 |

FIG. 12
(Table 1)

VACUUM ELECTRON DEVICE DRIFT TUBE

BACKGROUND

Unless otherwise indicated herein, the approaches described in this section are not prior art to the claims in this disclosure and are not admitted to be prior art by inclusion in this section.

A klystron is a type of high radio frequency (RF) amplifier (e.g., microwave amplifier), which can be used in power sources for electron accelerators and ultra high frequency (UHF) transmitters for radar, television, and satellite communication, as well as a drive power generator for particle accelerators. The klystron can be used in medicine, security and inspection, active denial, material processing, and high energy physics applications. The klystron is an electron device that includes a hollow tube structure (e.g., hollow metallic waveguide) that operates in a high vacuum (e.g., a vacuum device, vacuum electron device, or vacuum electric device). In a klystron, an electron beam generated by an electron gun interacts with radio waves as the electron beam passes through resonant cavities (e.g., metal box or cylindrical type shapes) along the length of a tube (e.g., a drift tube). The electron beam passes through a first cavity to which an input signal is applied. The energy of the electron beam amplifies the signal in the resonant cavities, and the amplified signal is taken from a later cavity at the other end of the klystron. In a conventional round beam klystron (or annular beam klystron [ABK]), a cylindrical shaped electron beam, confined by a magnet, traverses and interacts with a number of resonant cavities, amplifying an input signal often by 30-60 decibels (dB; i.e., gain of a thousand to a million times). The high RF fields generated by the cavities are isolated from other cavities by the cylindrical beam drift tube, which may be too small to propagate an RF field below a specified frequency, referred to as a cutoff frequency. The size of the drift tube, the electron gun, and focusing magnetic fields (e.g., B-fields) can place an upper limit on the current, and hence the power, of the klystron.

The sheet beam klystron (SBK) is a microwave power amplifier that can be a smaller or lower cost alternative to conventional round beam klystrons, can produce more average power than the round beam klystrons, and can extend to higher frequencies more readily than round beam klystrons. Due to the relatively wide and flat structure of the cavities and drift tube in the SBK, the SBK can be unstable. Electromagnetic (EM) radiation confined to hollow structures can have transverse modes, such as transverse electric (TE) modes, transverse magnetic (TM) modes, and hybrid modes. A transverse mode is a particular electromagnetic field pattern of radiation measured in a plane perpendicular (i.e., transverse) to the propagation direction of the beam of electromagnetic radiation. The TE mode (or H mode) is an electromagnetic field pattern without an electric field in the direction of propagation (i.e., a magnetic [H] field occurs along the direction of propagation). The TM mode (or E mode) is an electromagnetic field pattern without a magnetic field in the direction of propagation (i.e., an electric [E] field occurs along the direction of propagation). The hybrid mode is an electromagnetic field pattern with a non-zero electric field and a non-zero magnetic field in the direction of propagation. The resonant cavities amplify the RF field of the input while the resonant cavities in combination with drift tubes effect the gain and bandwidth of the klystron, which is often referred to as a tube. In the SBK, resonant cavities and drift tube may allow some transverse modes, referred to as trapped modes or parasitic modes, to be excited and grow.

Instabilities in a klystron can occur when positive feedback occurs between a transverse mode (or propagating mode) and an induced current on a quasi-steady state electron beam emitted by the electron gun (or electron beam generator). The wide drift tube of the SBK can support propagating modes, which can be "trapped" (i.e., form standing waves with strong transverse electric fields [e.g., TE mode] that can drive the electron beam into the drift tube walls), which can cause the electron beam to become unstable (e.g. TE mode instability). Instabilities in the klystron can result in the dampening of the RF fields of the signal or the electron beam colliding with the walls of the tube (e.g., a drift tube) of the SBK, as shown in FIG. 1, which can reduce the amplification of the RF signal, dampen the output signal, or damage the klystron. FIG. 1 illustrates a seven-cavity SBK 160 with a wave form of an electron beam 170 changing while passing through resonant cavities 164A-G in a drift tube 162, which results in the instability of the electron beam 172. Although the electron beam is shown hitting a drift tube wall between the sixth and seventh resonant cavities 164F-G, the instability of the electron beam is shown to occur as early as the second resonant cavity 164B, which can cause dampening of the RF fields of the signal. Instability can occur when an RF mode grows (e.g., when more power is put into mode than is dissipated out of the mode).

The SBK, when operating without instability, can have a very high average (or peak) power along with a relatively light weight structure, which can be useful in a variety of scientific, commercial, and military applications. The electron beam in the SBK is flat and can be extended laterally in the shape of "sheet" (hence the name "sheet beam"), thus the electron beam can therefore carry a higher current due to the lower current density. The technology (systems, devices, and methods) described herein provides mechanisms to change the characteristics of the transverse modes and improve the stability of the electron beam of an electron device, such as a SBK.

BRIEF SUMMARY OF SOME EXAMPLE EMBODIMENTS

Vacuum electron devices with a relatively flat structure, such a sheet beam klystron (SBK), can be susceptible to transverse electric (TE) mode instability. The technology (systems, devices, and methods) described herein provides drift tube adjustments, such as changing different drift tube section widths, and provides resonant cavity adjustments, such as changing the re-entrant features of the resonant cavity, that can reduce, minimize, lessen, or in some cases even eliminate the effects of TE mode instability. In some examples, changing the width of the drift tube sections can reduce the effects of TE mode instability with negligible effect on the operating frequency of the SBK. In an example, changing the width of the drift tube sections can vary the resonant frequency of the drift tube sections with each other so the resonant frequency of the drift tube sections do not overlap, and thus reduce the likelihood of TE mode instability. Although a re-entrant feature can enhance coupling of the electron beam to a transverse mode for amplification of the input signal, resonant cavities without a re-entrant feature can lower the reflection coefficient, and thereby lowering a loaded quality factor of the drift tube section, which can lessen oscillations of transverse modes that generate instability.

In another example, a vacuum electron device, such as a SBK, includes a hollow tube structure. The hollow tube structure includes at least three resonant cavities and at least two drift tube sections. Each resonant cavity includes a cavity width along a major axis, a cavity height along a minor axis, and a cavity length along a propagation axis, and the major axis is substantially orthogonal to the minor axis. In an example, substantially orthogonal refers to an angle between 88° and 92° (i.e., within 2° of 90°). Each drift tube section includes a drift tube section width along the major axis, a drift tube section height along the minor axis, and a drift tube section length along the propagation axis. In an example, the cavity width is greater than the drift tube section width or the cavity height is greater than the drift tube section height producing a discontinuity between the resonant cavities and the drift tube sections. A first drift tube section of the at least two drift tube sections is disposed between a first resonant cavity and a second resonant cavity of the at least three resonant cavities along the propagation axis. A second drift tube section of the at least two drift tube sections is disposed between the second resonant cavity and a third resonant cavity of the at least three resonant cavities along the propagation axis. A drift tube section width of the first drift tube section is substantially different from a drift tube section width of the second drift tube section.

In a configuration, the drift tube section width of the first drift tube section is at least 0.3% greater or less than the drift tube section width of the second drift tube section.

In another example, the hollow tube structure includes at least two resonant cavities and at least one drift tube section. Each resonant cavity includes a cavity width along a major axis, a cavity height along a minor axis, and a cavity length along a propagation axis, and the major axis is substantially orthogonal to the minor axis. The at least one drift tube section includes at least two drift tube section widths along the major axis, a drift tube section height along the minor axis, and a drift tube section length along the propagation axis. In an example, the cavity width is greater than the drift tube section width or the cavity height is greater than the drift tube section height producing a discontinuity between the resonant cavities and the drift tube sections. A first drift tube section of the at least one drift tube sections is disposed between a first resonant cavity and a second resonant cavity of the at least two resonant cavities along the propagation axis. A first drift tube section width of the at least one drift tube section is substantially different from a second drift tube section width of the at least one drift tube section.

In a configuration, the first drift tube section width of the first drift tube section is at least 0.3% greater than the second drift tube section width of the first drift tube section.

In another example, the hollow tube structure includes at least three resonant cavities and at least two drift tube sections. Each resonant cavity includes a cavity width along a major axis, a cavity height along a minor axis, and a cavity length along a propagation axis, and the major axis is substantially orthogonal to the minor axis. Each drift tube section includes a drift tube section width along the major axis, a drift tube section height along the minor axis, and a drift tube section length along the propagation axis. In an example, the cavity width is greater than the drift tube section width or the cavity height is greater than the drift tube section height producing a discontinuity between the resonant cavities and the drift tube sections. A first drift tube section of the at least two drift tube sections is disposed between a first resonant cavity and a second resonant cavity of the at least three resonant cavities along the propagation axis. A second drift tube section of the at least two drift tube sections is disposed between the second resonant cavity and a third resonant cavity of the at least three resonant cavities along the propagation axis. A drift tube section length of the first drift tube section is substantially different from a drift tube section length of the second drift tube section, and the first drift tube section and the second drift tube section are not a drift tube between a penultimate resonant cavity and a last resonant cavity.

In a configuration, the drift tube section length of the first drift tube section is 0.7% to 15% greater than the drift tube section width of the second drift tube section.

In another example, the hollow tube structure includes at least three resonant cavities and at least two drift tube sections that include a drift tube material. Each resonant cavity includes a cavity width along a major axis, a cavity height along a minor axis, and a cavity length along a propagation axis, and the major axis is substantially orthogonal to the minor axis. Each drift tube section includes a drift tube section width along the major axis, a drift tube section height along the minor axis, and a drift tube section length along the propagation axis. In an example, the cavity width is greater than the drift tube section width or the cavity height is greater than the drift tube section height producing a discontinuity between the resonant cavities and the drift tube sections. A first drift tube section of the at least two drift tube sections is disposed between a first resonant cavity and a second resonant cavity of the at least three resonant cavities along the propagation axis. A second drift tube section of the at least two drift tube sections is disposed between the second resonant cavity and a third resonant cavity of the at least three resonant cavities along the propagation axis. The second drift tube section includes a wall material along at least one interior wall of the second drift tube section. An electromagnetic property of the wall material is substantially different from the permeability and permittivity of vacuum and a wall material of a remainder of the hollow tube structure.

The summary provided above is illustrative and is not intended to be in any way limiting. In addition to the examples described above, further aspects, features, and advantages of the invention will be made apparent by reference to the drawings, the following detailed description, and the appended claims.

BRIEF DESCRIPTION OF THE DRAWINGS

FIG. 12 (Table 1) summarizes result the $TM_{110}$ modes operating in the resonant cavities and the $TE_{302}$ modes operating in the drift tube sections.

DETAILED DESCRIPTION OF SOME EXAMPLE EMBODIMENTS

Figure 1:
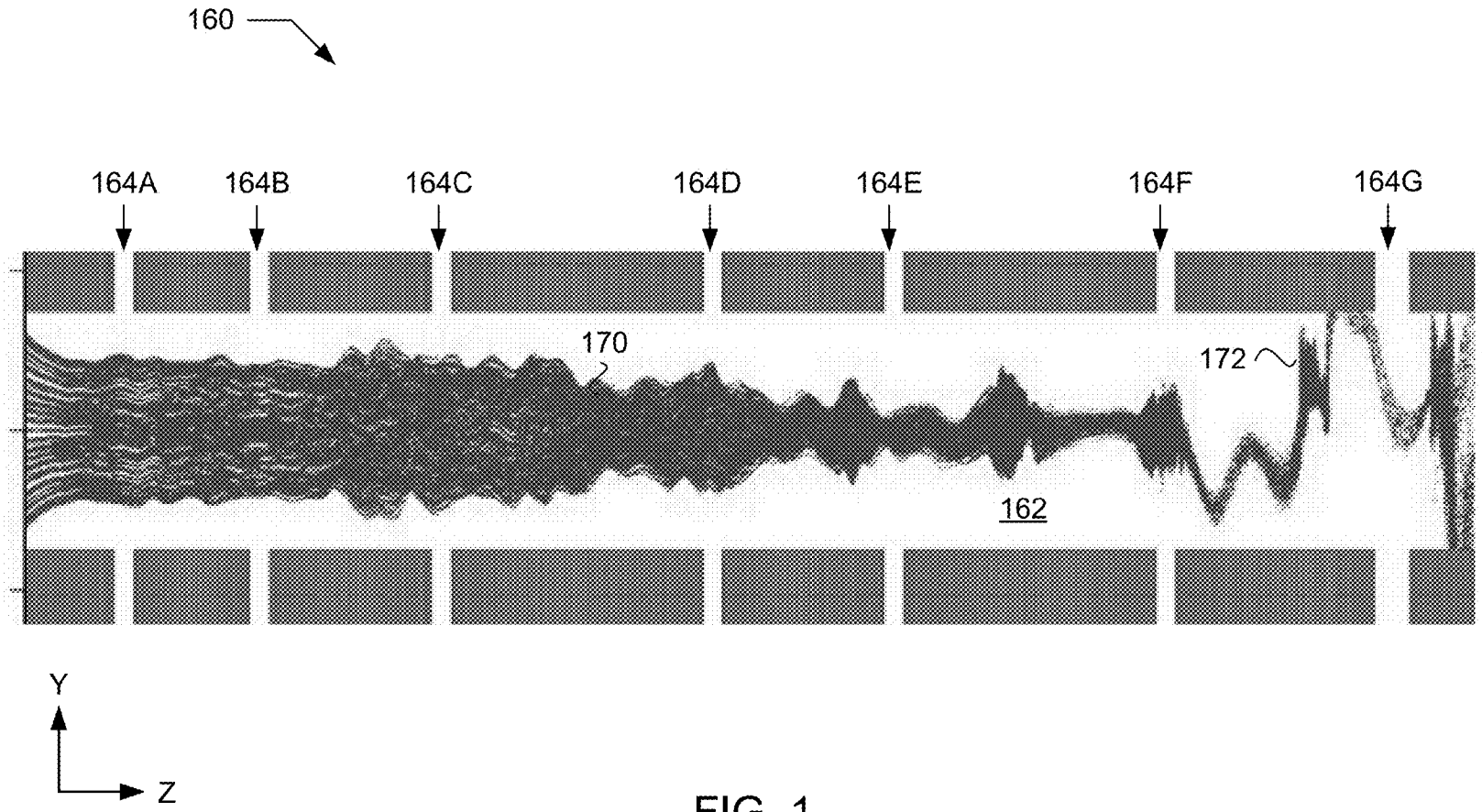
FIG. 1 illustrates a longitudinal side view simulation of an instability with an electron beam impinging on walls of a seven-cavity sheet beam klystron (SBK).

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives (e.g., a disjunction operator, or an exclusive or) or a combination of the alternatives (e.g., a conjunction operator, and/or, a logical or, or a Boolean OR).

The invention relates generally to adjustments for reducing or lessening the effects of transverse mode instability in vacuum electron devices and, more particularly, to drift tube and resonant cavity adjustments for reducing, minimizing, lessening, or in some cases even eliminating the effects of transverse electric (TE) mode instability in sheet beam klystrons (SBK).

Example embodiments illustrate various drift tube and resonant cavity adjustments that can change the resonant frequency in the drift tube sections of the resonator assembly or reduce the quality factor in the drift tube sections by modifying the reflection coefficient from the resonant cavity. In particular, drift tube widths of various drift tube sections can be modified to change the amplification characteristics of the drift tube between the resonant cavities, which can reduce the TE modes that create instability with negligible impact on an intended signal amplification of the klystron (e.g., sheet beam klystron).

Vacuum electron devices, such as klystrons, can be used to provide high power amplification of microwaves with output power up to tens of megawatts (MW). Typically, the klystron is a narrow bandwidth device with a bandwidth less than 10% of the input frequency, and in some examples, a bandwidth less than 1% of the input frequency. Conventionally, bandwidth is defined as a difference between the upper and lower frequencies on either side of a maximum frequency value (i.e., peak frequency), where the upper and lower frequencies are each defined by a 3 dB-point. The 3 dB-point is the point where the spectral density is half its maximum value. The spectral density is the distribution of power into frequency components composing a signal.

Microwaves are a form of electromagnetic radiation with wavelengths ranging from one meter (1 m) to one millimeter (1 mm) with frequencies between 300 megahertz (MHz; 1 m) and 300 gigahertz (GHz; 1 mm), which can include ultra high frequency (UHF; 300 MHz and 3 GHz), super high frequency (SHF; 3 to 30 GHz), and extremely high frequency (EHF; millimeter wave; 30 to 300 GHz). With electromagnetic energy ranging from approximately 1 GHz to 100 GHz in frequency, the microwave spectrum can be further categorized in bands, such as L (1-2 GHz), S (2-4 GHz), C (4-8 GHz), X (8-12 GHz), $K_a$ (12-18 GHz), K (18-26.5 GHz), $K_a$ (26.5-40 GHz), Q (33-50 GHz), U (40-60 GHz), V (50-75 GHz), W (75-110 GHz), F (90-140 GHz), and D (110-170 GHz). Band L is associated with UHF, bands S through $K_a$ are associated with SHF, and bands Q through D are associated with EHF. Although, vacuum electron devices are typically associated with microwaves, such as klystrons providing microwave amplification, the adjustments and approaches described herein may also apply to higher frequency devices, such as those operating in the lower infrared spectrum, where the infrared electromagnetic radiation includes wavelengths ranging from one millimeter (1 mm) to 700 nanometers (nm) with frequencies between 300 GHz (1 mm) and 450 terahertz (700 nm). Reference to the term "microwave" as used herein may also include frequencies in lower infrared spectrum. In one example the term "microwave" includes frequencies between 300 MHz and 3 THz.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

Example Klystron

Figure 2:
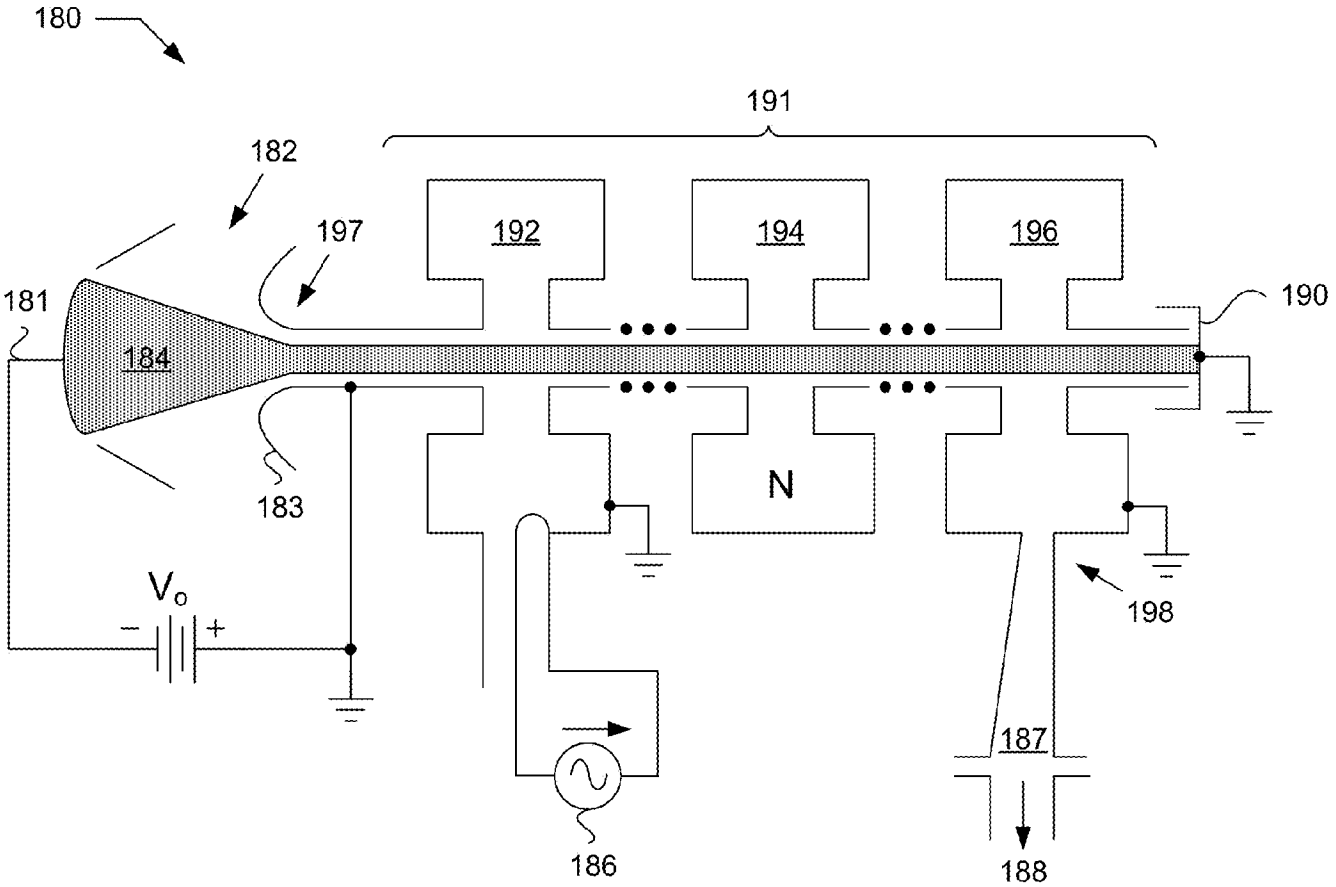
FIG. 2 illustrate a block diagram of an example klystron.

FIG. 2 is a block diagram of an example klystron 180. The N+2-cavity klystron 180 includes an electron gun (that emits electrons) 182, N+2 cavities 192, 194, and 196 in a resonator assembly 191, and collector 190. The electron gun 182 includes a cathode 181 that generates a beam of electrons (or electron beam) 184 that is accelerated towards an anode 183 by a voltage potential, $V_0$, to a velocity, $u_0$, with an energy, $$\frac{1}{2}mu_0^2 = eV_0,$$

where $m_0$ is the mass of the electron beam and e is the electron charge. The electron beam 184 enters a tube (or hollow tube structure) with a plurality of cavities, referred to as resonant cavities (or "bunch" cavities) 192, 194, and 196 connected with drift tubes (or drift tube sections). The electron beam is coupled to the tube referred to as electron beam coupling 197. The electron beam, at a first resonant cavity, referred to as an input cavity or "buncher" cavity 192, is acted upon a radio frequency (RF) voltage 186 represented as $V_i \sin \omega t$ and reduced by a coupling coefficient M (positive value less than 1), where $V_i$ is the input voltage and $\omega$ is the angular frequency, $\omega=2\pi f$, where f is the ordinary frequency (measured in hertz [Hz]). The klystron amplifies the RF input signal by converting the kinetic energy in the direct current (DC) electron beam 184 into radio frequency power.

The structure of the resonant cavities 192, 194, and 196 are designed to create standing waves at a specified resonant frequency, usually near the input frequency, which produces an oscillating voltage which acts on the electron beam 184. The electric field causes the electrons to "bunch", in that the electrons passing through the resonant cavity when the electric field opposes the motion of the electrons are slowed, and the electrons passing through the resonant cavity when the electric field is in the same direction as the motion of the electrons are accelerated, causing the previously continuous electron beam to form bunches at or near the input frequency. To reinforce the bunching, a klystron may contain additional resonant cavities or "buncher" cavities 194. In some examples, a "buncher" cavity (or "bunch" cavity) refers to the first resonant cavity. In other example, "buncher" cavities refers to the first resonant cavity and the additional resonant cavities. In the example shown in FIG. 2, the klystron has N resonant cavities 194 besides the input cavity 192 and the output cavity 196. Resonant cavities (e.g., N resonant cavities 194) are also referred to as intermediate resonant cavities. Typically, for conventional klystrons with normal tuning type configurations, each resonant cavity increases the gain by roughly 10 decibels (dB). Adding more resonant cavities can increase the RF gain or bandwidth. The electron beam 184 then passes through a "drift" tube in which the faster electrons catch up to the slower ones, creating the "bunches", then through an output cavity or "catcher" cavity 196. In the output "catcher" cavity 196, each bunch of electrons enters the cavity at a time in the cycle when the electric field opposes the electrons' motion, and thereby decelerates the electrons. Thus the kinetic energy of the electrons is converted to energy of the electric field, increasing the amplitude of the oscillations. The oscillations excited in the output cavity 196 are coupled out through a waveguide 187 (or in other examples, a coaxial cable) to produce an amplified RF output signal. The coupling of the electric field to the waveguide 187 is referred to as waveguide coupling 198. The spent electron beam, with reduced energy, is captured by a collector electrode or collector 190.

Example Sheet Beam Klystron

Figure 3:
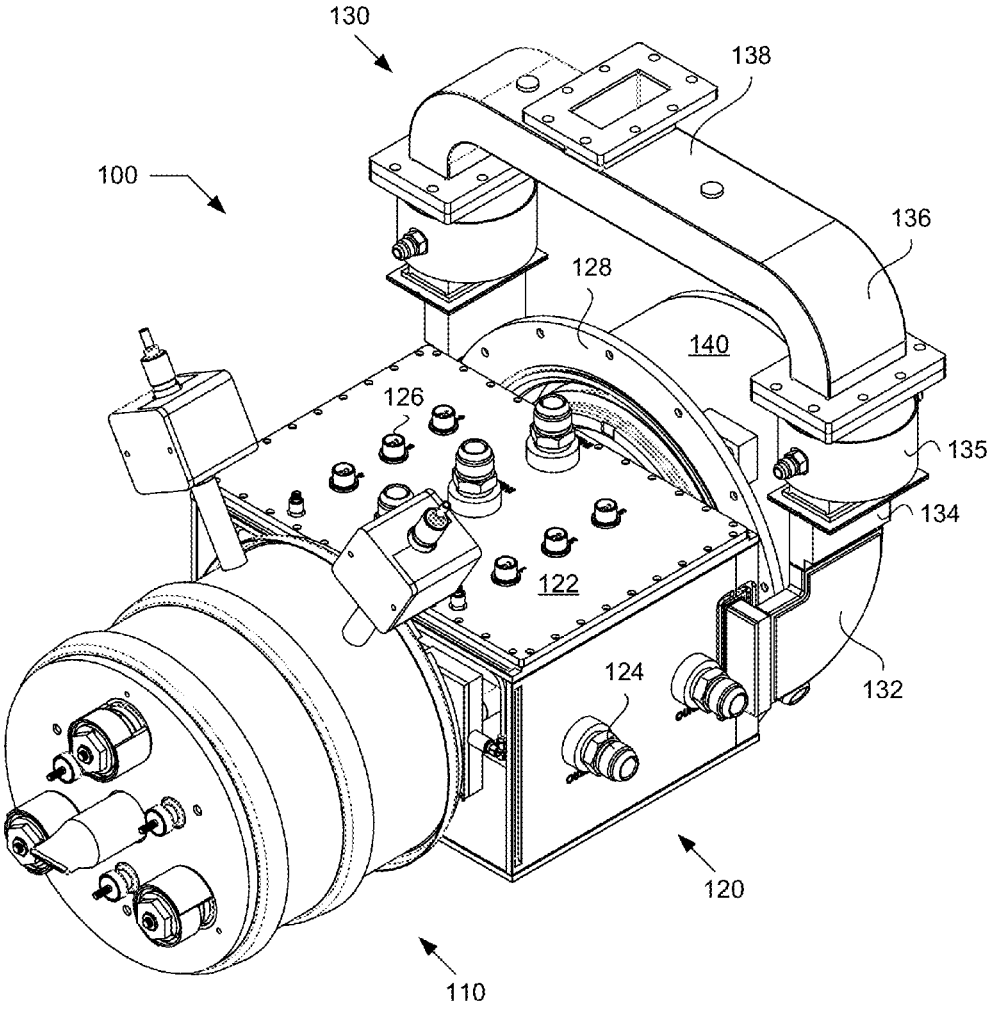
FIG. 3 illustrates a diagram of an example sheet beam klystron (SBK).

FIG. 3 is a diagram of an example sheet beam klystron (SBK) 100. The SBK includes an electron gun assembly 110, a resonator assembly (or microwave cavity assembly) 120, a microwave output waveguide assembly 130, and a collector assembly 140. The electron gun assembly 110 is on a first end of the resonator assembly 120, and the collector assembly 140 is on a second end of the resonator assembly 120. The electron gun assembly 110 includes the electron gun (not shown) that includes an electron emitter (not shown). The resonator assembly 120 includes a magnetic return box 122 (which can also function as cooling box) with solenoid coil connectors 126 and cooling interfaces 124 (e.g., inputs and outputs). The magnetic return box 122 can enclose the resonant cavities (not labeled) and the drift tube sections (not labeled). The magnetic return box 122 can be enclosed on the input side (or electron gun side) with an electron gun side pole piece (not shown) and enclosed on the output side (or collector side) with collector side pole piece 128. The electron gun side pole piece is not shown in FIG. 3 so the resonant cavities and drift tube inside the magnetic return box 122 can be shown. The microwave output waveguide assembly 130 can include various waveguide components, such as an output waveguide H-plane bend 132, an output waveguide double step E-plane transformer 134, an output waveguide window 135, an output waveguide E-plane bend 136, and an output microwave combiner or an output waveguide E-type tee junction 138. The microwave output waveguide assembly 130 directs and combines the output signal to a specified location. The collector assembly 140 can include the collector electrode (not shown).

Figure 4A:
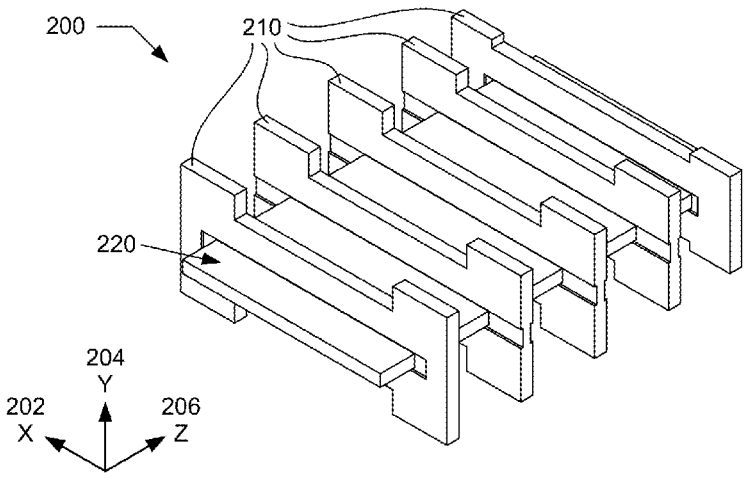
FIGS. 4A-4H illustrate views of resonant cavities and drift tube voids in a microwave cavity assembly of a five-cavity SBK.
Figure 4B:
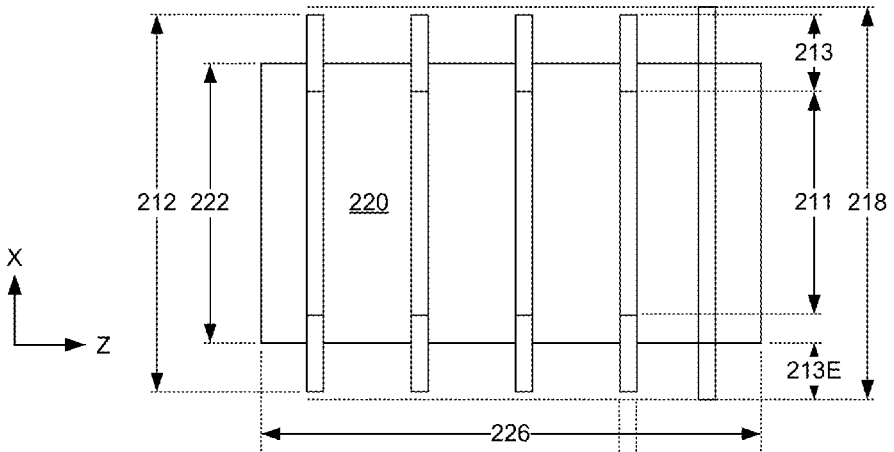
Figure 4C:
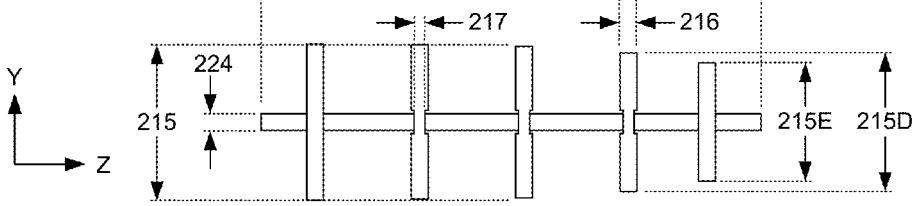
Figure 4D:
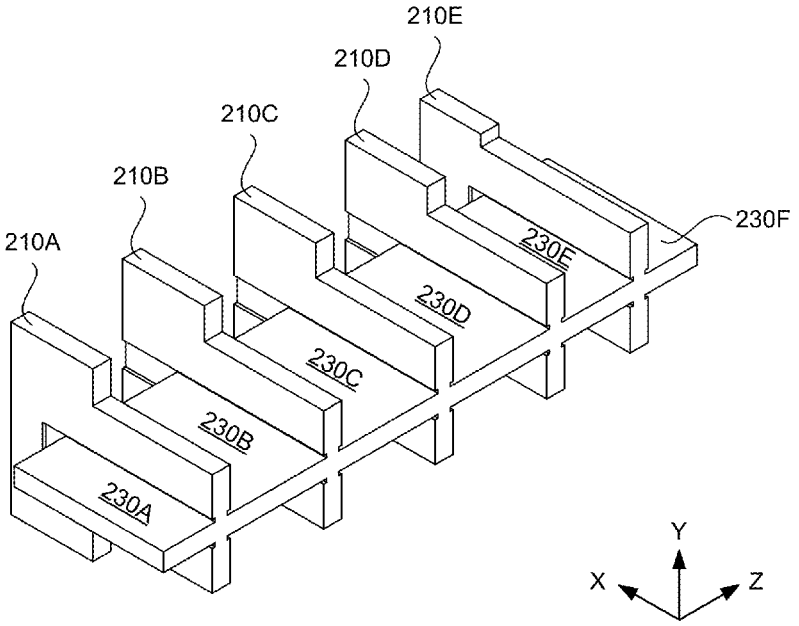
Figure 4E:
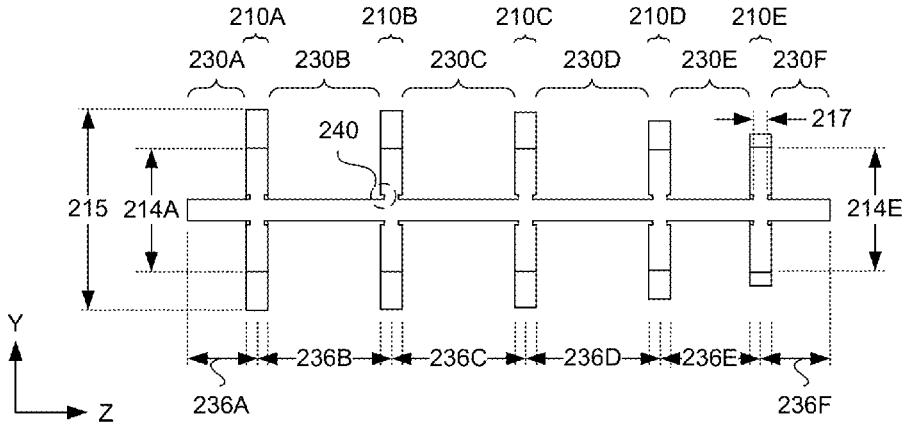
Figure 4F:
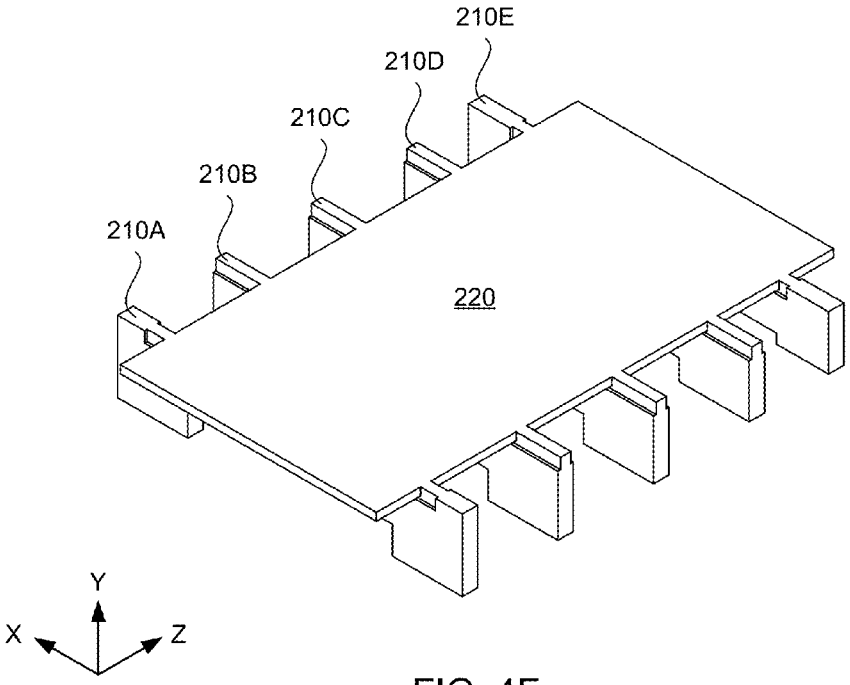
Figure 4G:
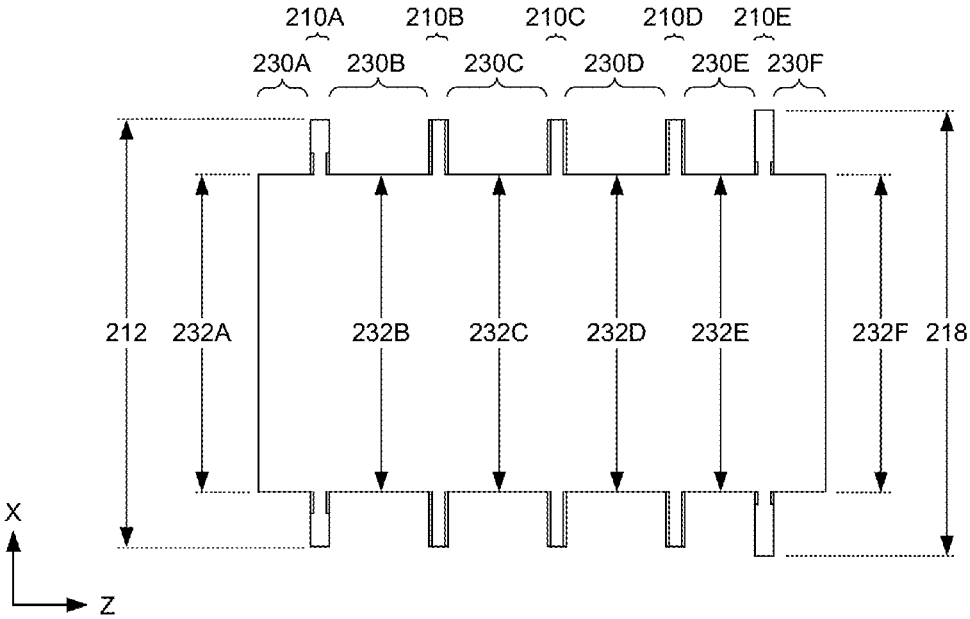
Figure 4H:
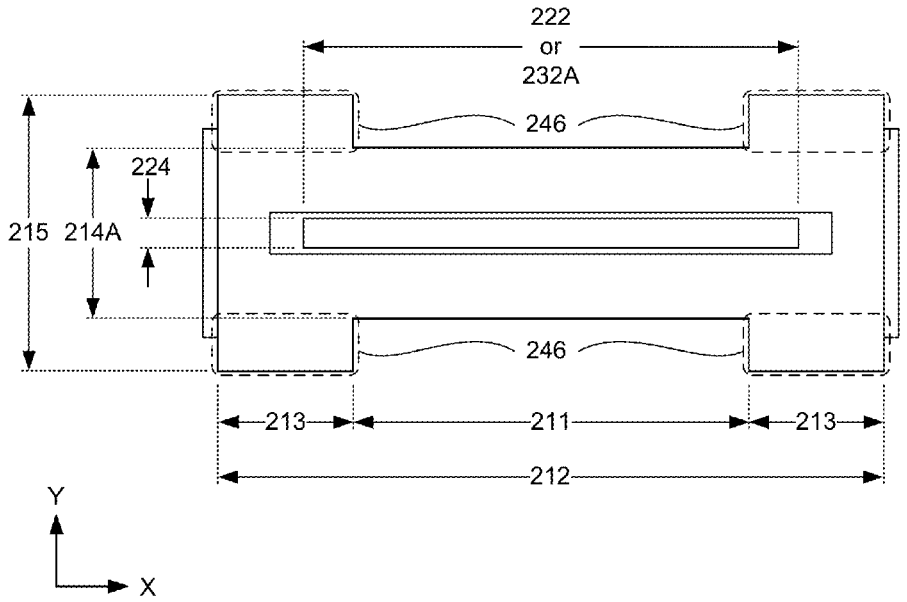

FIGS. 4A-4H illustrate views of resonant cavities and drift tube voids in a microwave cavity assembly 200 of a five-cavity SBK. FIG. 4A shows a perspective view, FIG. 4B shows a top view, FIG. 4C shows a side view, and FIG. 4H shows a front view (looking in the direction of travel of the electron beam) of the resonant cavities and the drift tube voids in the microwave cavity assembly 200. FIG. 4D shows a perspective cross-sectional view and FIG. 4E shows a side cross-sectional view of the resonant cavities and the drift tube voids in the microwave cavity assembly 200 with a cross-section taken along a center section of the microwave cavity assembly in a y-z plane. FIG. 4F shows a perspective cross-sectional view and FIG. 4G shows a top cross-sectional view of the resonant cavities and the drift tube voids in the microwave cavity assembly 200 with a cross-section taken along a center section of the microwave cavity assembly in an x-z plane.

The structures of the microwave cavity assembly 200 act as waveguides for the electron beam and the RF signal. The cavities and voids formed by structure of the microwave cavity assembly 200 provide the features to generate the standing waves and resonant frequencies used to transform the electron beam and RF input signal into an amplified RF output signal. The microwave cavity assembly 200 includes resonant cavities 210 coupled by drift tube sections 230A-F in a drift tube region 220 of the tube. The resonant cavities 210 and drift tubes 220 in a klystron may be fabricated with a suitable high electrical conductivity and high heat conductivity material, which may include, for example, copper (Cu), aluminum (Al), or a ceramic matrix composite (CMCs; e.g., ceramic fiber reinforced ceramic [CFRC] or carbon-fiber-reinforced silicon carbide [C/SiC]). In the conventional round beam klystron (not shown), the resonant cavities and drift tube have a cylindrical, torus, or ellipsoid shape with a radius, a diameter, or semi-principal axes. In the SBK, the resonant cavities and drift tube can have a substantially cuboid or rectangular cuboid shape or a substantially elliptic cylindrical shape. The electron beam is oriented such that the electron beam travels or propagates in a z-direction (or along a z-axis), a wide direction of the electron beam is in an x-direction (or along an x-axis), and the thin direction of the electron beam is in a y-direction (or along a y-axis). The void of each resonant cavity 210A-E and each drift tube section 230A-F of the drift tube 220 has a width, a height, and a length. As used herein, a width refers to distance along the x-axis 202 (or major axis), a height refers to distance along the y-axis 204 (or minor axis), and a length refers to distance along the z-axis 206 (or propagation axis; the axis of the propagation of the electron beam).

For example, each resonant cavity 210A-E has a cavity width 212 (for cavities 210A-D) and 218 (for output cavity 210E), a cavity height 214A (for cavities 210A-D) and 214E (for output cavity 210E), and a cavity length 216. Although, the cavity height 214A for cavities 210A-D are shown as similar, each resonant cavity can have a different cavity height (based on the desired resonant radio frequency field for the resonant cavity). The output cavity width 218 differs from the cavity width 212 (for cavities 210A-D) and the output cavity height 214E differs from the cavity height 214A (for cavities 210A-D). Although, the cavity width 212 for cavities 210A-D are shown as similar and different from the output cavity width 218, each resonant cavity can have a similar or different cavity width (based on the design desired resonant radio frequency field for the resonant cavity).

The resonant cavities can have various features to change the characteristics of the resonant cavities (e.g., characteristics of the transverse modes, electron beam, or RF signal), such as a barbell feature (or dumbbell feature) 246 or a re-entrant feature 240. A resonant cavity with a barbell feature (or barbell structure) can be referred to as a barbell cavity (barbell type cavity, dumbbell cavity, or dumbbell type cavity). The barbell cavity can be referred to as a dumbbell cavity or an H-block cavity, which may have slight variations with a barbell cavity. The barbell feature can improve the shape of the flat electromagnetic field by producing an RF field that doesn't vary significantly over the width of the electron beam. The barbell feature can further define the resonant cavities with an inner cavity width 211 (inside the barbell), a barbell width 213 (for cavities 210A-D) or output cavity barbell width 213E (for output cavity 210E), and a barbell height 215 (for cavities 210A-C), a fourth cavity barbell height 215D (for cavity 210D), or an output cavity barbell height 215E (for output cavity 210E). Although, the barbell height 215 for cavities 210A-C is shown as similar, each resonant cavity can have a different barbell heights. The output cavity barbell width 213E differs from the barbell width 213 (for cavities 210A-D) and the fourth cavity barbell height 215D and the output cavity barbell height 215E differs from the barbell height 215 (for cavities 210A-C). Although, the barbell widths 215 for cavities 210A-C is shown as similar and different from the fourth cavity barbell height 215D and the output cavity barbell height 215E, each resonant cavity can have a different or similar barbell widths (based on the desired tube characteristics). FIGS. 4A-9J illustrate resonant cavities with the barbell feature. In other examples, the resonant cavity can have other types of sheet beam type cavities, such as a regular cuboid shape (i.e., rectangular pillbox or regular cuboid cavity), a slotted ridged waveguide, or a cross-aperture cavity.

The re-entrant feature 240 (or re-entrant structure) can improve the coupling of the electron beam to the electromagnetic field in the resonant cavity. The re-entrant feature refers to a protrusion into a void (e.g., the resonant cavity). The re-entrant feature can have different shapes or configurations, such a triangular, triangular prism, or diagonal cupola shape (242 of FIG. 10D), or a rectangular or rectangular cuboid shape (240 of FIGS. 4E and 5E). Other shapes or configurations of the re-entrant feature may also be used. A smallest or minimum distance of the void between the re-entrant feature on each side of a resonant cavity is referred to as a re-entrant gap length 217. Typically, the re-entrant gap length 217 is smaller than the cavity length 216.

The drift tubes 230A-F in the drift tube region 220 have a drift tube width 222, a drift tube height 224, and a drift tube region length 226. The drift tube region between resonant cavities 210A-E, between the anode and the first resonant cavity (or input resonant cavity or "buncher" cavity) 210A, and between the last resonant cavity (or output resonant cavity or "catcher" cavity or final resonant cavity) 210E and the collector can each be referred to as drift tube sections 230A-F. Each drift tube section 230A-F has a drift tube section width (or tube section width) 232A-F, drift tube section height (or tube section height) 224, and drift tube section void length (or tube section length or tube section void length) 236A-F. Conventionally, the drift tube section width 232A-F are uniform and similar for each of the drift tube sections 230A-F and are referred to collectively as the drift tube width 222, and the drift tube section heights 224 are uniform and similar for each of the drift tube sections 230A-F and are referred to collectively as the drift tube height 224. The drift tube section widths 232A-F and the drift tube section heights 224 are defined by the internal walls or structure of the drift tube. In the z-axis, the drift tube sections extend into the void of the resonant cavity. The drift tube section void length 236A-F can be defined by a point (e.g., a midpoint) within the resonant cavity. In other examples (not shown), a drift tube section void length can be defined by the boundary or discontinuity between the drift tube section and the adjoining resonant cavity. The drift tube section 230B-D between resonant cavities can have similar or different drift tube section void lengths 236B-D. The drift tube section 230E between the fourth resonant cavity and the output resonant cavity can be adjusted (e.g., shorten) to decelerate the electron beam for the output signal.

The cavity width differs from the drift tube section width to create a discontinuity in the void between the resonant cavities and drift tube sections. In an example, the cavity width 212 or 218 is greater than the drift tube section width 232A-F. In another configuration, the cavity height differs from the drift tube section height to create a discontinuity in the void between the resonant cavities and drift tube sections. In an example, the cavity height 214A and 214E is greater than the drift tube section height 224. In some examples, the cavity height is twice the distance of the drift tube section height.

A cavity can be formed by placing structures (e.g., resonant cavities or drift tube sections) at the ends of the waveguide in the z-direction, which leads to the structure supporting specific eigenmodes at specific eigenfrequencies (i.e., a resonant frequency). An eigenmode (or normal mode) of an oscillating system is a pattern of motion in which all parts of the system move sinusoidally with the same frequency and with a fixed phase relation. An eigenfrequency (or resonant frequency of the oscillation) is the frequency in which a eigenmode occurs. Many vacuum electron devices, such as the klystron, operate by having electromagnetic modes (or transverse modes, propagating modes, or eigenmodes) that interact with an electron beam. In rectangular waveguides and cavities (i.e., a hollow rectangular structures), rectangular mode numbers are designated by two or three suffix numbers attached to the mode type, such as $TE_{mn}$ or $TM_{mn}$, and $TE_{mnp}$ or $TM_{mnp}$, where m is a number of half-wave patterns across the width of the waveguide, n is a number of half-wave patterns across the height of the waveguide, and p is a number of half-wave patterns across the length of the cavity.

The transverse mode interactions with the electron beam often occur by passing the electron beam through a structure that is shaped in a way to enhance the transverse mode interactions. The interaction can either take place at discrete locations along the electron beam or throughout general volumes of the structure. The changes or enhancements are generated by shaping the walls or structure to interact with the electron beam in a specific way.

Typically, resonant cavities and drift tubes, especially the resonant cavities, are designed to enhance the gain or bandwidth of the klystron by arranging the resonant frequencies of the resonant cavities to try and get a desired gain and bandwidth. Often the focus is on the $TM_{110}$ mode (or working mode or primary mode of the resonant cavities). Other modes can also be present in the vacuum electron devices (e.g., the klystron). Because SBK's are often based on rectangular type geometry, the propagating modes in a rectangular waveguide structure can be expressed in terms of transverse electric (TE) and transverse magnetic (TM) modes. For a rectangular cavity, resonant frequencies for $TE_{mnp}$ and $TM_{mnp}$ modes can be approximated by Expression 1.

$$f_{o,mnp} = \frac{1}{2\pi\sqrt{\mu\varepsilon}}\sqrt{\left(\frac{m\pi}{a}\right)^2 + \left(\frac{n\pi}{b}\right)^2 + \left(\frac{p\pi}{d}\right)^2} \quad \text{[Expression 1]}$$

where m, n, and p are non-negative integers and at least two of m, n, and p are positive integers (i.e., m=0, 1, 2, . . . , n=0, 1, 2, . . . , p=1, 2, . . . where m an n both can't be 0 simultaneously for TE modes or m=1, 2, . . . , n=1, 2, . . . , and p=0, 1, 2 . . . for TM modes), indicies m, n, and p are related to modes field structures that the waveguide supports, μ represents a composite permeability of a medium or material (e.g., volume in the cavity), ϵ represents a composite permittivity of the medium or material, 'a' represents a width (or a wide direction) of a void or cavity, 'b' represents a height (or a narrow direction) of a void or cavity, and 'd' represents a length of a void or cavity formed in the z-direction. Permeability, μ, is the measure of the ability of a material to support the formation of a magnetic field within itself. Permittivity, ϵ, is the measure of resistance that is encountered when forming an electric field in a medium. Expression 1 can be used to approximate resonant frequencies in resonant cavities and drift tubes with correction factors, as resonant cavities and drift tubes has openings (and sometimes features) in the rectangular waveguide structure. The correction factor may be determined by simulations of the structure.

An electromagnetic wave (or transverse mode) propagates when the frequency (or mode frequency) exceeds a lower threshold frequency or a minimum frequency for wave propagation referred to as a cutoff frequency. Electromagnetic modes can become "trapped", referred to as trapped modes, when the electromagnetic modes are allowed to propagate in the waveguide (e.g., a drift tube section) that connects two resonant cavities. When the drift tube section (or other waveguide features) prevents the electromagnetic modes from propagating the electromagnetic modes are cutoff. If the frequency of the electromagnetic mode is below the cutoff frequency, the electromagnetic modes cannot propagate in the waveguide structure and are referred to as cutoff. The cutoff frequency for the $TE_{mn}$ and $TM_{mn}$ modes can be represented by Expression 2.

$$f_{c,mn} = \frac{1}{2\pi\sqrt{\mu\varepsilon}}\sqrt{\left(\frac{m\pi}{a}\right)^2 + \left(\frac{n\pi}{b}\right)^2} \quad \text{[Expression 2]}$$

where m and n are non-negative integers and at least one of m and n are a positive integer (i.e., only one of m and n can be zero; e.g., m=0, 1, 2 . . . , n=0, 1, 2, . . . , m and n can't both be 0 for TE modes; or m=1, 2, . . . , n=1, 2, . . . for TM modes) and m and n are related to modes field structures that the waveguide supports, μ represents a permeability of a medium or material, ϵ represents a permittivity of the medium or material, 'a' represents a width (or a wide direction) of a void or cavity, and 'b' represents a height (or a narrow direction) of a void or cavity. Expression 2 can be used to approximate cutoff frequencies in resonant cavities and drift tubes with correction factors, as discussed previously in relation to Expression 1.

The resonant cavities can be referred to as "intended" cavities of the vacuum electron device, where RF structures are purposely designed and placed to interact with the electron beam. The drift tube or the drift tube sections can be referred to as "unintended" cavities, where cavities or voids of the drift tube generate trapped modes (or parasitic modes) between the resonant cavities (or "intended" cavities). To be clear, resonant frequencies and oscillations from the electromagnetic modes can occur in both the resonant cavities and the drift tube sections, where the resonant cavities are "intended" to enhance the resonant frequencies or oscillations, and the drift tube sections are "unintended" results of the waveguide structure. As such, modifying the structure of the drift tube or the drift tube sections (or other parts of the waveguide structure) can change the resonant frequencies and dampen oscillations of the trapped modes. Since changes in the tube (or vacuum electron device) can also impact the function and performance of the intended cavities, some changes with negligible or minimal impact on the function and performance of the resonant cavities may be more advantageous to implement. The design of the drift tube or drift tube sections takes an opposite approach (i.e., drift tube approach) from the approach of the resonant cavities (i.e., resonant cavity approach, which attempts to enhance or maximize gain of the klystron by overlapping intended cavity frequencies). For the drift tube approach, the unintended cavity frequencies generated by the voids or cavities of the drift tube section are arranged with spacing between frequencies or minimize the overlap in frequencies to keep the gain low for the trapped modes or parasitic modes. It can be desirable to have the peaks of the corresponding resonant modes in different drift tube cavities to be separated in frequency by greater than the sum of the loaded bandwidths for modes that have a non-negligible interaction with the electron beam.

In many sheet beam devices, referring back to Expressions 1 and 2, 'b' is much smaller than 'a' in the drift tube sections (or waveguides connecting resonant cavities). As such, the TE fields that have n=0 can have a much lower cutoff frequency than TM modes and TE modes with n greater than 0.

By comparison, a hollow circular structure can have a lower cutoff frequency relative to the hollow rectangular structure, so the conventional round beam klystrons can require a much higher working frequency before instability becomes an issue. In most conventional round beam klystrons, the narrow dimensions (e.g., radius or diameter) of a cylindrical drift tube cutoff most of the electromagnetic modes so that these other TE and TM modes cannot propagate. Due to the geometry of the drift tube sections of the SBK, some of the electromagnetic modes can become trapped and can generate adverse effects, such as TE mode instability of the electron beam in which a transverse electric mode is excited and grows to the point that the mode interferes enough to alter the intended operation of the electron beam of the device. TE mode instability may also occur in other non-sheet beam electron devices, such as a round beam relativistic klystron (e.g., relativistic klystron amplifier) or extended interaction klystrons. For example, in round beam relativistic klystrons, a similar challenge to TE mode propagation or instability occurs, where the drift tube is not cut off between the resonant cavities. TE mode propagation or instability (or similar challenges) can also exist in sheet beam accelerators.

The development of the SBK has been impeded by electrical and mechanical challenges associated with the rectangular structure and flat electron beam. As introduced, an electrical challenge occurs because wide drift tube sections allow trapped modes to be excited, which can cause the TE mode instability. The cavities (e.g., resonant cavities and drift tube sections) can be overmoded (e.g., allowing multiple modes to propagate).

Although vacuum electron devices that generate a flat electron beam (e.g., the SBK) can have challenges, these vacuum electron devices that generate the flat electron beam also have some distinct benefits. For example, the SBK allows for an increase in beam current without an increase in current density by changing the width of the beam, which allows for reduced cathode current densities. The decreased current densities can reduce the focusing magnetic field (or B-field) requirements and can reduce cathode loading. The reduction in the magnetic field is at least partially due to lower space charge forces, which allows permanent magnet focusing schemes that can be easier to implement. The larger surface area of the flat electron beam can also help reduce the temperature and reduce cooling requirements as power losses (e.g., $i^2R$ losses) are spread out over a larger surface area. The power roll off with frequency is in the order of (i.e., approximately) 1/frequency (1/f), instead of being in the order of the square of 1/frequency [$(1/f)^2$] as is the case for round beams, which allows the SBK to be more suitable for high frequency designs (e.g., frequencies exceeding 75 GHz), such as developing W-band SBK's around 94 GHz or SBK's operating around 1 THz.

Besides Expressions 1 and 2, many other relationships, qualities, or quantities can also help to characterize cavities as well as the ability of the eigenmodes the cavities support to interact with the electron beam. One relationship is the total quality factor of a cavity, as given by Expression 3.

$$\frac{1}{Q_T} = \frac{1}{Q_b} + \frac{1}{Q_l} = \frac{1}{Q_b} + \frac{1}{Q_o} + \frac{1}{Q_e} \quad \text{[Expression 3]}$$

where the total quality factor, $Q_T$, can have two components, the beam loaded quality factor, $Q_b$, which accounts for interaction with the electron beam, and the loaded quality factor, $Q_l$, which is the quality factor due to the cavity and exits when no electron beam is present. The loaded quality factor, $Q_l$, has contributions from the unloaded quality factor, $Q_o$, and the external quality factor, $Q_e$.

For a given mode, the quality factor is a measure of the ability of a cavity to store energy compared to the amount of power dissipated over a period, as represented in Expression 4.

$$Q_b = \frac{\omega W_o}{P_b},\ Q_o = \frac{\omega W_o}{P_o},\ Q_e = \frac{\omega W_o}{P_e} \quad \text{[Expression 4]}$$

where w is an angular frequency (2π*f; or radial frequency or radian frequency), $W_o$ is the total time average energy in the cavity, and the various Ps represents power dissipation (e.g., $P_b$ is the power dissipation due to beam loading, $P_o$ is the power dissipation due lossy materials, and $P_e$ is the power dissipation due to energy radiating or propagating out of the cavity [due to shape and design]). For $Q_b$ the power dissipated is from coupling to the electron beam, for $Q_o$ the power dissipated is through ohmic or lossy materials, and for $Q_e$ the power dissipated is through power radiating or propagating out of the cavity.

Another relationship useful to help describe the cavity is the R/Q (i.e., R/Q represents a symbol, which is not R divided by Q). R/Q, with units in ohms (Ω), describes the accelerating voltage of the cavity for a given amount of stored energy. The physical description of R/Q can be described as the ratio of the square of the voltage V across the interaction gap of a cavity and the energy W stored in the cavity as represented by Expression 5.

$$\frac{R}{Q} = \frac{V_c^2}{2\omega_o W} \quad \text{[Expression 5]}$$

where $V_c$ is the voltage across an interaction gap (in the cavity), $\omega_o$ is the resonant frequency $$(\omega o = \sqrt{\frac{1}{LC}},$$

where L is the inductance of the cavity or circuit and C is the capacitance of cavity or circuit), and W is the average energy in the cavity. Klystrons are resonant, narrowband devices that usually have some limited bandwidth. The bandwidth of a klystron is primarily set by the R/Q of the output circuit, when the input produces sufficient fundamental-frequency RF current ($I_i$) to drive the output circuit over the band of interest. R/Q can also be represented as $$\frac{R}{Q} = \frac{1}{\omega_o C} = \sqrt{\frac{L}{C}}.$$

The impedance of nth cavity in a structure, $Z_n(\omega)$, can be represented in equivalent form as a function of frequency, as represented by Expression 6.

$$Z_n(\omega) = \left(\frac{R}{Q}\right)_n \left[\frac{1}{\frac{1}{Q_{Tn}} + j\frac{\omega^2 - \omega_{0n}^2}{\omega\omega_{0n}}}\right] \quad \text{[Expression 6]}$$

where $$\left(\frac{R}{Q}\right)_n$$

is the R/Q for the nth cavity, $Q_{Tn}$ is the total quality factor for the nth cavity, $\omega_o$ is the resonant frequency for the nth cavity, and ω is the input or operating frequency of the device. With these cavity parameters, a klystron typically uses a few more parameters or relationships that are related to the electron beam. The electron beam is first accelerated by the electron gun voltage, $V_o$, has a given DC current, $I_o$, and velocity, $u_o$. The beam propagation factor (or electron wavenumber), $\beta_e$, given in Expression 7, plasma wavenumber, $\beta_p$, given in Expression 8, and reduced plasma wavenumber, $\beta_q$, given in Expression 9, are some parameters that are useful in klystron device design and understanding klystron operation. The wavenumber (or wave number) is the spatial frequency of a wave (e.g., in cycles per unit distance or radians per unit distance).

$$\beta_e=\omega/u_o \quad \text{[Expression 7]}$$

$$\beta_p=\omega_p/u_o \quad \text{[Expression 8]}$$

$$\beta_q=R\beta_p \quad \text{[Expression 9]}$$

where $\omega_p$ is the plasma frequency, and R is the plasma reduction factor. The plasma reduction factor takes into account the effect of the drift tube walls in reducing the effects of the space charge between bunches. In a wide sheet beam, the plasma reduction factor R may only have a smaller dependence on the width of the drift tube for a fixed beam width because most of the interaction occurs in the drift tube height (i.e., between the wide dimensions of the drift tube). Thus, the width of the drift tube can be altered for a fixed beam width with only a small or negligible effect on altering the reduced plasma wavenumber, $\beta_q$.

The gap coupling coefficient, M1, is given by Expression 10.

$$M1(x,\beta)=\frac{\int E_C(x,\xi)e^{j\beta\xi}d\xi}{\int E_C(x,\xi)d\xi} \quad \text{[Expression 10]}$$

where x is distance of the gap in the cavity (e.g., resonant cavity or drift tube section), β is a wavenumber (or wave number or axial wavenumber), $E_c$ is a circuit field (e.g., electric field generated by the circuit), and ξ is the path of integration along the beam where the circuit field exists. The gap coupling coefficient, $M1(x,\beta_e)$, is often averaged over the electron beam to give an averaged gap coupling coefficient $M(\beta_e)$ of the mth cavity. The mth cavity refers to a cavity preceding the nth cavity.

From klystron theory, when the RF modulation is placed longitudinally (i.e., along the z-axis) on the electron beam and the interaction takes place over discrete regions and the drift tube is cutoff, the transconductance, $g_{mn}$, between two cavities (e.g., two resonant cavities) can be represented by Expression 11 and the corresponding voltage gain, $G_{mn}$, between two cavities can be represented by Expression 12.

$$g_{mn}(\omega)=\frac{I_n}{V_m}=-\frac{1}{2}j\frac{I_o}{V_o}\frac{\omega}{\omega_q}M_mM_n\sin(\beta_q l_{mn})e^{-j\beta_e l_{mn}} \quad \text{[Expression 11]}$$

$$G_{mn}(\omega)=\frac{V_n}{V_m}=g_{mn}(\omega)Z_n(\omega) \quad \text{[Expression 12]}$$

where $V_m$ is a voltage across a gap of a preceding cavity m, $I_n$ is a driving current at a cavity n resulting from voltage $V_m$, $V_n$ is a voltage across a gap of the cavity n, $l_{mn}$ is a length (i.e., drift tube section length) between the mth and nth cavity, $V_o$ is the electron gun voltage, $I_o$ is the electron gun current, $\omega_q$ is the reduced plasma frequency, $M_m$ is the gap coupling coefficient of the mth cavity, and $M_n$ is the gap coupling coefficient of the nth cavity. The length, $l_{mn}$, is often set by parameters related to the electron beam and coupling.

These expressions (e.g., Expressions 1-12) can be used to determine a total gain of an N cavity klystron by summing over possible feed forward current paths. A resultant absolute power gain, G(p), can be expressed as Expression 13.

$$G(p)=\frac{4}{Q_{e1}Q_{eN}}\frac{|Z_1G_{N1}|^2}{\left(\frac{R}{Q}\right)_1\left(\frac{R}{Q}\right)_N}=A\left|\frac{(p-z_1)\ldots(p-z_{N-2})}{(p-p_1)\ldots(p-p_N)}\right|^2 \quad \text{[Expression 13]}$$

where $Z_1$ is the impedance of the first resonant cavity, $G_{N1}$ is voltage gain across N cavities, $Q_{e1}$ is an external quality factor of the first resonant cavity, $Q_{eN}$ is an external quality factor of the Nth resonant cavity (or last resonant cavity), $(R/Q)_1$ is the R/Q for the first cavity, $(R/Q)_N$ is the R/Q for the Nth cavity (i.e., last cavity), A is a constant that embodies various circuit and beam parameters, p is a pole of the absolute power gain, $p_n$'s are the poles of the resonant cavities of the N cavities, $z_n$'s are complex frequencies at which the gain function goes to zero, $Q_{e1}$ is an external quality factor of the first resonant cavity, $Q_{eN}$ is an external quality factor of the Nth resonant cavity (or last resonant cavity). In general, the gain functions of multi-cavity klystrons with single-tuned resonant cavities have two less zeroes (z) than poles (p). In Expression 13, the N poles are due to the resonant cavities and the N−2 zeroes are due to the feed forward paths related to the transconductance. The intermediate resonant cavities are used to enhance gain and bandwidth of the klystron. Often the resonant frequencies of the cavities are arranged to get a desired gain and bandwidth. Typically, each resonant cavity can increase a gain by approximately 10 dB. Adding more resonant cavities can increase the RF gain, especially when their resonant frequencies overlap.

Parasitic mode or trapped modes can grow when a positive feedback occurs between a mode and an induced current on an electron beam, which generates instabilities in the electron beam. These electron beam instabilities can be dependent on gun voltage (which also effects $I_o$, $u_o$, and wavenumbers represented by Expressions 7-9), and can be predicted on a basis of a negative total quality factor, $Q_T$. Parasitic modes driven by the electron beam can grow when the transverse modes are not sufficiently loaded and can disrupt the vacuum electron device (i.e., tube; e.g., klystron) operation. At least two factors drive an oscillation, first, the beam transfers power to the mode and, second, the power lost through resistive or lossy materials and power lost by energy radiating away in the cavities is less than the power obtained from the electron beam, which results in a net gain in mode energy and leads to growing oscillations. To obtain a total quality factor less than zero ($Q_T<0$), $Q_b$ needs to be negative, and the more negative an inverse of the total quality factor is, the easier mode self-excitation can occur, which generates instabilities in the electron beam. From the relationships, expressions, and descriptions above, at least three approaches can be used to help reduce unwanted modes from growing, which include, first, decrease coupling between electron beam and parasitic mode or trapped mode (e.g., increase $Q_b$), second, increase ohmic type losses (e.g., lower $Q_o$), third, allow the mode to radiate or propagate power out of a cavity (e.g., lower $Q_e$), or a combination of these approaches.

Example Extended Interaction Klystron

Unwanted oscillations occur in many types of klystron applications besides SBK. One area in particular is the field of extended interaction cavities or extended interaction klystrons (EIKs). EIKs can provide high-peak power for high frequency (e.g., ≥8 GHz), high power (e.g., ≥75 MW), or high voltage (e.g., ≥500 kilovolt [kV]) applications, such as an electron-positron linear collider. Extended interaction output cavities can be used in order to distribute the RF voltage over several output cavity interaction gaps and to avoid RF breakdown. A maximum electric field, E, for a cavity is limited by the RF breakdown. In RF breakdown, locally high electric fields cause fracture and field evaporation of ions from solid surfaces (e.g., cavity walls). Many of the expressions and relationships described, such as Expression 11, depend on an interaction between the beam and the modes taking place at several discrete gaps. EIKs occur in a klystron when multiple-gaps are used or the interaction takes place over an extended region. Many of the parameters discussed above are also relevant in analyzing EIK circuits. In EIKs, a general klystron theory applies where the interaction takes place with a generalized RF field over a general region. Such RF fields may be several discrete field regions corresponding to cavities placed closely together or the fields may be the continuous field of a coupled gap structure. EIKs are often used at higher frequency (e.g., millimeter [mm] wave circuits) to achieve large power output, wide frequency bandwidth, or high gain. In these cavities the magnitude of the average gap coupling coefficient, M, can be optimized by synchronizing phase velocity of extended cavity to beam velocity and the stability of cavities can depend on positive beam loaded conductance, $G_b$. For longitudinal waves (in the z-direction) on the beam, $G_b$ can be represented by Expression 14.

$$G_b = \frac{1}{8}\frac{\beta_e}{\beta_q}\frac{I_o}{V_o}(|M(\beta_e-\beta_q)|^2 - |M(\beta_e+\beta_q)|^2) \quad \text{[Expression 14]}$$

where $\beta_e$ is the electron wavenumber, $\beta_q$ is the reduced plasma wavenumber, $V_o$ is the electron gun voltage, $I_o$ is the electron gun current, and M is the average gap coupling coefficient.

The beam loaded quality factor, $Q_b$, can be calculated using the relation in Expression 15.

$$\frac{1}{Q_b} = G_b * \left(\frac{R}{Q}\right) \quad \text{[Expression 15]}$$

The beam loaded quality factor, $Q_b$, can also be calculated directly by looking at the power, $P_b$, coupled from a given mode into the beam (i.e., beam power) using Expression 16.

$$P_b = \frac{1}{T}\int_t^{t+T}\int J_m \cdot E_m dV dt \quad \text{[Expression 16]}$$

where $J_m$ is the current density for the electron beam, $E_m$ is the electric field of the electron beam, and the integrals are taken over the volume, V, of the beam and averaged over a period of time, T.

Example Relativistic Klystron Amplifiers

Another klystron structure in which parasitic modes can be formed are in relativistic klystron amplifiers (RKAs). RKA use relativistic electron beams, where streams of electrons generated by the relativistic electron gun move at relativistic speeds. RKA typically uses high current (e.g., in the kilo ampere [kA] range instead of the ampere [A] range of a conventional ABK) to provide high power and high gain. In some RKAs, higher modes (or higher order modes) are primarily developed between middle cavities, in which the round drift tube is not cut off. For example, the excitation of the parasitic modes is a form of positive feedback. To prevent exciting the parasitic modes, the threshold current can be increased (e.g., when the threshold current is significantly larger than the beam current). The threshold current can be proportional to a number of middle resonant cavities, so more middle cavities increases the likelihood of exciting the parasitic modes. One mechanism that can be used to dampen the parasitic modes is placing or adding resistive or lossy materials into the walls of the drift tube, which changes (e.g., decreases) the unloaded quality factor, $Q_o$. The decreases in the unloaded quality factor, $Q_o$, can help suppress the parasitic modes which can improve the performance of some RKAs.

Example Magnetic Focusing

In SBK, $TE_{m0}$ modes can propagate in the drift tube, where m is a number of half-wave patterns across the width (x-axis) of the drift tube. The TE modes can be excited due to misalignments and machining errors (e.g., matching resonant cavities or matching between output gap impedance and beam impedance) that can occur in fabrication and charge density fluctuations. If these TE modes operate in the drift tube, the TE modes usually cause challenges because the modes have a component of the electric field in the y-direction, kicking the beam towards the nearby drift tube walls. Self-excitation of the $TE_{m0}$ mode has been a challenge in different SBK designs because of the instabilities. The TE modes can be trapped due to discontinuity (e.g., change in void features) between the drift tube section and the resonant cavity. Although, periodic permanent magnet (PPM) focusing, periodically cusped magnet (PCM) fields, and wiggler fields have been used in an attempt to focus and transport the electron beam, ultimately these designs continued to be unstable due to the magnitude of the field generating the TE mode instability.

Solenoid focusing can be used to create a stiff beam that may be less susceptible to TE mode instabilities. In addition to approaches described, solenoid focusing can cause the beam center to oscillate less in the y-direction and decrease the power coupling from a given transverse mode into the beam, as previously shown in Expression 16. However, if or when the electron gun is misaligned from the magnetic field (e.g., B-field) and drift tube, which usually occurs by some extent in practice, some oscillations on the electron beam may still occur, which oscillation can still couple to the TE modes.

Altering Drift Tube Height or Adding Choke Cavities

Various changes in the resonant cavities and the drift tube can affect the trapped mode. In an example, increasing the drift tube height allows some of the RF fields to radiate out of the cavity, decreasing the external quality factor, $Q_e$. However, changing the drift tube height uniformly throughout the various drift tube sections can also have an effect on the operation of the intended cavity (or resonant cavity) by decreasing the total quality factor, $Q_T$, and reducing R/Q of the resonant cavity. In another example, a slot in the narrow wall (in the y-direction) in the drift tube section or RF absorber in the drift tube in the drift tube wall (e.g., resistive or lossy material inserted into the slotted narrow wall of the drift tube section) may also be used to suppress trapped modes. The slots in the drift tube wall and RF absorber may still interact with the electron beam and can increase the manufacturing cost of the klystron. In another example, using lossy material (e.g., in the walls of the drift tube) or one quarter (¼) lambda choke cavities may also be used to suppress trapped modes. A ¼ lambda choke cavity (or choke joint) is a narrow cavity placed at an odd multiple of quarter wavelengths (of the operating frequency) away from the end of the resonant cavity in the wide wall (e.g., upper, lower, or both walls) of the drift tube section. The choke cavity approach uses an extra set of cavities that may also need to be tuned and location of the choke cavities are mode specific, which can add manufacturing complexity and cost. Inserting lossy material and other more complex changes to the structure can also be more difficult and costly to produce, especially as the frequency of the klystron is increased and the features of the klystron become smaller.

Changing the Trapped Electromagnetic Modes

At least two different mechanisms can be used to modify the effect of trapped electromagnetic modes interacting with the electron beam with a minor or negligible effect on the amplified signal. Other mechanisms can be used which have a greater effect on the amplifying the intended signal. Some changes can have a minor or negligible effect on the amplified signal (or operating frequency) while other changes may have a more significant effect on the amplified signal.

A first method to modify the effect of trapped electromagnetic modes interacting with the electron beam can be useful when multiple cavities are formed along the structure. Very similar to klystron theory, and more generally extended interaction klystron theory, the frequency of cavities along the electron beam path can have a large effect on the interaction between the electron beam and RF fields in the different cavities. By manipulating the cavities (e.g., dimensions of the cavities) that are formed, the resonant frequency can change. Changing the resonant frequency can have a significant effect on the relationship between gain and bandwidth when multiple cavities are used. The different cavity frequencies can have an effect on the coupling between the electron beam and the electromagnetic modes. In particular, it is advantageous to decrease the gain of the trapped TE modes in the drift tube cavities at the expense of increased bandwidth.

A second method involves manipulating the electromagnetic fields that are formed when at least two objects (e.g., discontinuities) are placed along a structure, which creates a cavity (e.g., a drift tube section). By manipulating these structures or the cavity formed between the ends of the structures, the energy stored in the formed cavity can be changed. As part of the process, a reflection coefficient can be determined as a function of frequency, for a given transverse mode, from each of the objects (e.g., drift tube walls) that form the cavity as well as determining the resonant frequency of the cavity for the specific transverse mode. Then, either the objects can be modified or the cavity (e.g., resonant cavity) in between the objects can be modified to allow RF fields to radiate out of the cavity by altering the reflection coefficients as a function of frequency or changing the resonant frequency of the cavity.

Although these techniques can be generally applied to vacuum electron devices or vacuum tubes, the examples shown are applied to trapped modes that are formed in the drift tubes of sheet beam devices, such as the sheet beam klystrons. The technology, mechanisms, and approaches described can also apply to other vacuum electron devices, such as extended interaction klystrons (EIKs) and relativistic klystron amplifiers (RKAs)

Varying Frequencies of Trapped Modes in the Drift Tube

Klystrons are narrow band devices whose function depends on the frequencies of the cavities. As previously described in relation to Expressions 6, 11, and 12, a device gain (or waveguide gain), G, is a sum of products of the cavity impedance, $Z_n(\omega)$, and drift tube section transconductances, $g_{mn}$, over the signal paths, as represented by Expression 17.

$$G(\omega) = \frac{V_{out}}{V_{in}} = \sum_{i=1}^{n} g_{mn}(\omega) Z_n(\omega) = \sum_{i=1}^{n} G_{mn}(\omega) \quad \text{[Expression 17]}$$

where ω is an angular frequency, $V_{in}$ is the input voltage of the device, $V_{out}$ is the output voltage of the device, n is the number of cavities, the transconductance, $g_{mn}$, is expressed by Expression 11, impedance, $Z_n(\omega)$, is expressed by Expression 6, and voltage gain, $G_{mn}$, is expressed by Expression 12. The resultant total power gain was also previously expressed by Expression 13. The denominator polynomials (e.g., $(p-p_1) \ldots (p-p_N)$) are dependent upon cavity impedances which are be adjusted to get a desired frequency response. Klystrons have finite zeros due to the various feed forward terms. In general gain functions of multi-cavity klystrons with single-tuned cavities, the klystron has two less zeroes (e.g., $z_{N-2}$) than poles ($p_N$). Gain peaks occur opposite poles and gain depressions occur opposite of zeros. In typical klystron designs, the resonant frequencies of the resonant cavities are arranged so that the gain is reasonably flat within a band of interest. Since the gain is depressed in the vicinity of the zeros, the pole arrangement usually provides that a zero is either moved outside the band or is canceled by an adjacent pole (i.e., pole zero cancelation). Conventionally, a gain bandwidth tradeoff occurs for a given number of middle cavities. For example, when a klystron has a high gain, the klystron usually has a lower bandwidth. A klystron can be synchronously tuned, in which all the resonant cavities are tuned to a same frequency or very similar frequency. Synchronous tuning results in maximum gain, but the bandwidth can be very small. The klystron design can also be tuned for a broad band (i.e., wide bandwidth) by appropriately arranging or spacing the frequencies of the resonant cavities, which can lead to less gain.

In traditional klystron theory, interaction between the electron beam and RF fields takes place at discrete locations over the different cavities. As shown by Expression 12, the voltage developed across a gap in a cavity (e.g., $V_n$) depends on the cavity impedance, $Z_n(\omega)$. At resonance, the cavity impedance, $Z_n$, is high and so the voltage induced at this frequency component of beam current is high. In extended interaction klystrons (EIKs) the interaction takes place over many gaps or throughout an extended region. Unintended cavities can be formed in the drift tube section between two intended cavities when the drift tube is not cut off. These unintended cavities can be considered part of an "unintended klystron" operating within the "intended klystron" design. The unintended klystron can have several properties similar to a conventional klystron as well as many differences. One difference is that the electric field, RF field, or E-field in the unintended klystrons can interact on the electron beam in the y-direction (along the y-axis) instead of just longitudinally (i.e., z-direction or along the z-axis). This property can alter the analysis used for conventional klystrons. However, some concepts, relationships, and expressions can still hold and can be used. For example, unintended cavities (as well as intended cavities) can have strong resonant frequencies. The cavity impedance is high near these resonances (See Expression 12). A strong interaction occurs between the electron beam and RF fields of a cavity, when the electron beam motion has a frequency component that overlaps near a cavity resonance. Thus, to minimize this effect between the electron beam and a drift tube section, the unintended cavity frequencies are adjusted, such that their resonances do not overlap. So, drift tube design (or drift tube approach) takes an opposite approach to conventional resonant cavity design (i.e., resonant cavity approach), which enhances or maximizes gain. Drift tube design arranges the unintended cavity frequencies to minimize the overlap in frequencies (e.g., resonant frequencies and beam oscillation frequency) to keep the gain low for the trapped or parasitic modes.

Unfortunately, due to the similar designs of the drift tube sections, many conventional sheet beam klystron designs have many unintended cavities that are tuned to similar frequencies, which causes trapped or parasitic modes to grow. Some of the parameters of the drift tube sections, such as the drift tube section length (e.g., 236A-F), defining the distance between resonant cavities, are often set by other parameters or effect the performance or design of the resonant cavities. So, many drift tube sections often have a similar length or multiples of this length. The cavity heights (e.g., 214A or 214E) of intended cavities or resonant cavities are often similar because the frequencies of the working modes are similar. A change in height of the cavity heights has a much greater effect on the frequency of a working mode than on the frequency of a trapped or parasitic mode, which is supported by simulation data provided below. Thus, with multiple unintended cavities (i.e., drift tube sections) tuned near the same frequency, the gain and interaction are high. One way to change the resonant frequency of the drift tube section is to change the drift tube section width, which has little effect on other important parameters or the frequencies of the working modes for the intended klystron, but can reduce, minimize, or eliminate the effects of transverse electric (TE) mode instability in vacuum electron devices, such as the SBK.

Figure 5A:
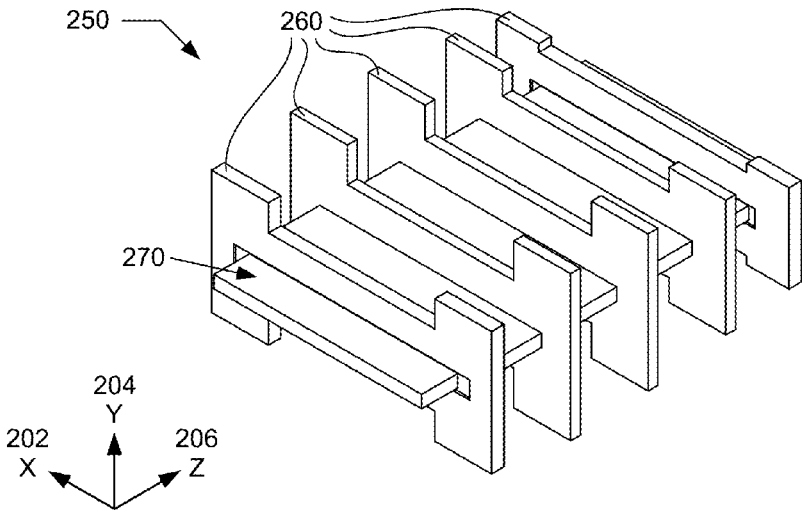
FIGS. 5A-5J illustrate views of resonant cavities and drift tube voids in a microwave cavity assembly of a five-cavity SBK with different drift tube section widths.
Figure 5B:
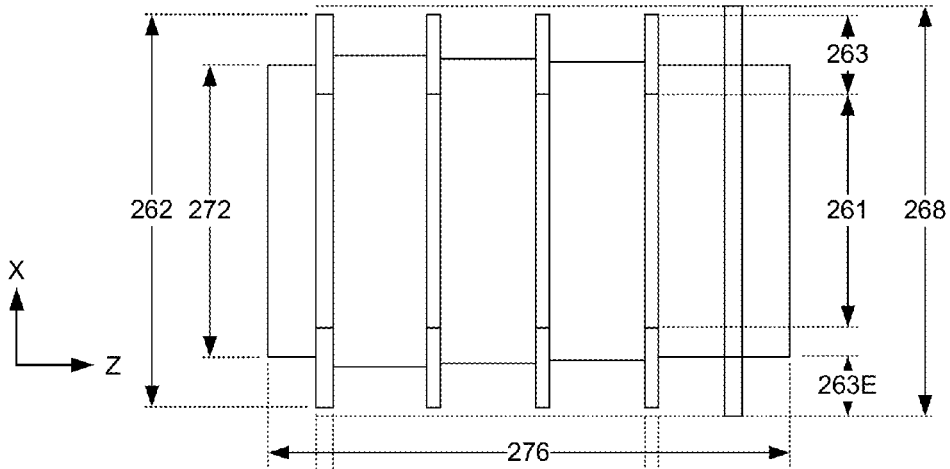
Figure 5C:
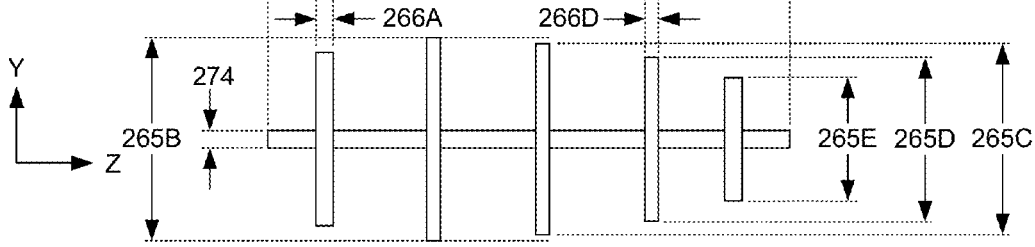
Figure 5D:
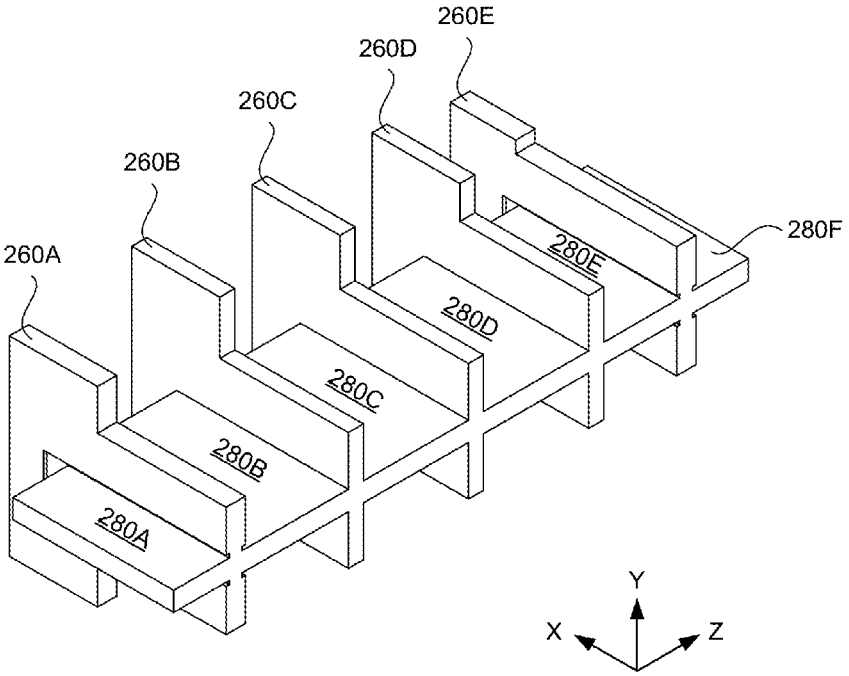
Figure 5E:
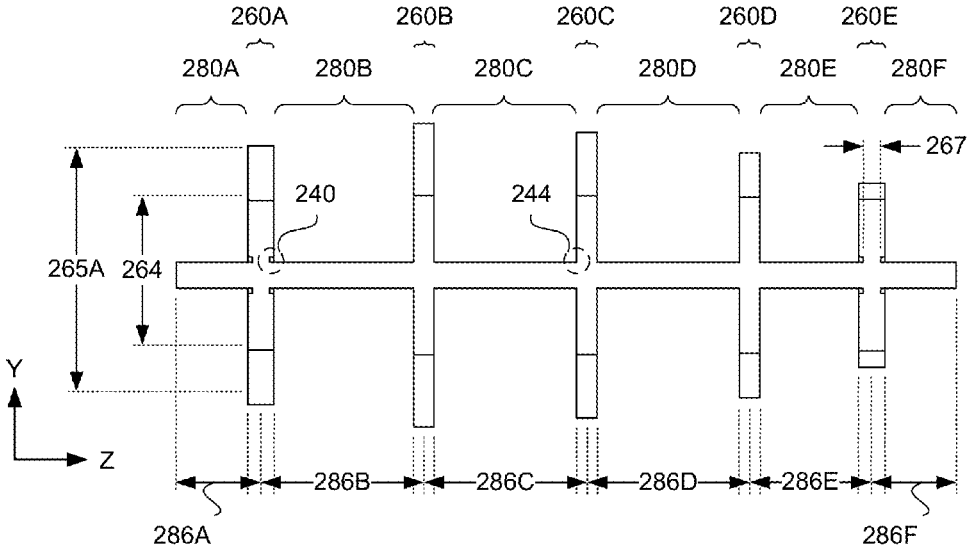
Figure 5F:
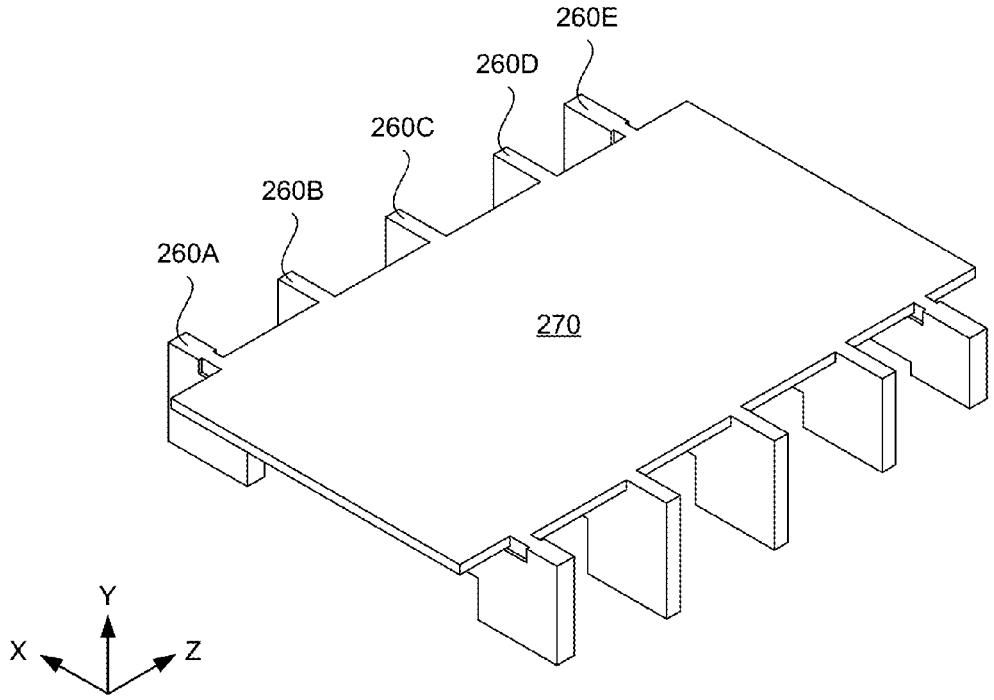
Figure 5G:
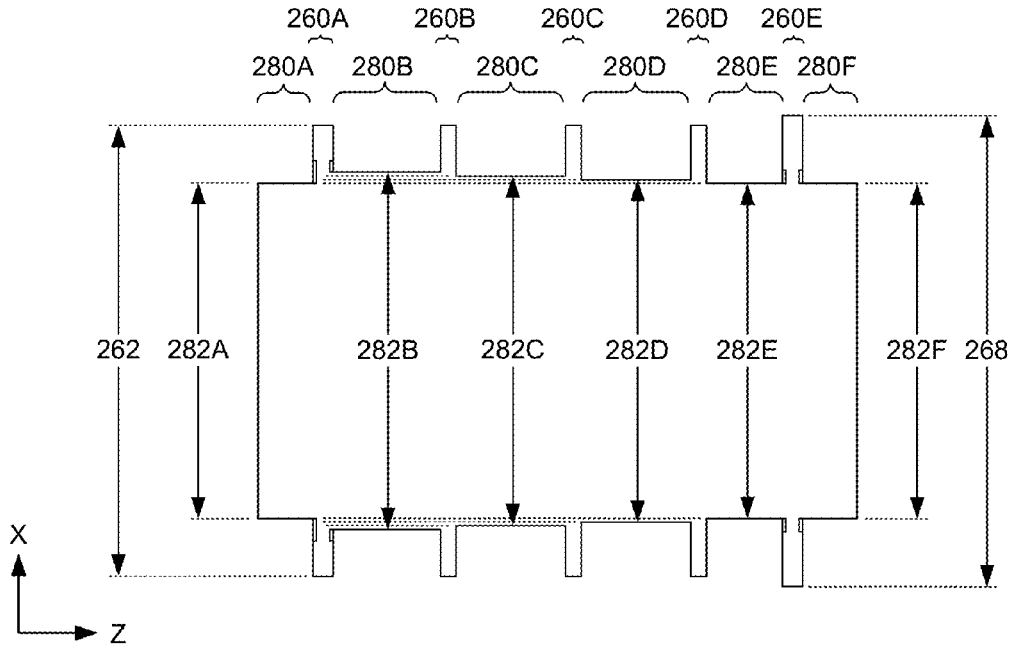
Figure 5H:
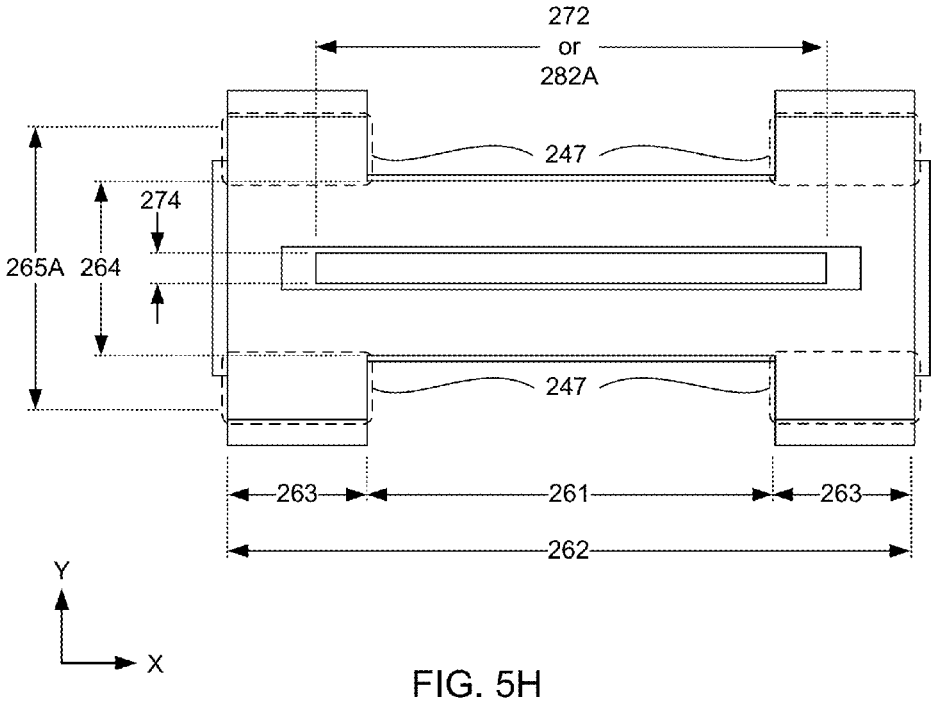

FIGS. 5A-5J illustrate views of embodiments of resonant cavities and drift tube voids in a microwave cavity assembly 250 of a five-cavity SBK that modifies the drift tube section widths. FIGS. 5A-5J show various changes to drift tube section widths using the five-cavity SBK previously shown in FIGS. 4A-4H as a base design. FIG. 5A shows a perspective view, FIG. 5B shows a top view, FIG. 5C shows a side view, and FIG. 5H shows a front view (looking in the direction of travel of the electron beam) of the resonant cavities and the drift tube voids in the microwave cavity assembly 250. FIG. 5D shows a perspective cross-sectional view and FIG. 5E shows a side cross-sectional view of the resonant cavities and the drift tube voids in the microwave cavity assembly 250 with a cross-section taken along a center section of the microwave cavity assembly in a y-z plane. FIG. 5F shows a perspective cross-sectional view and FIG. 5G shows a top cross-sectional view of the resonant cavities and the drift tube voids in the microwave cavity assembly 250 with a cross-section taken along a center section of the microwave cavity assembly in an x-z plane.

The structures of the microwave cavity assembly 250 act as waveguides for the electron beam and the RF signal. The cavities and voids formed by structure of the microwave cavity assembly 250 provides the features to generate the standing waves and resonant frequencies used to transform the electron beam and RF input signal into an amplified RF output signal. The microwave cavity assembly 250 includes resonant cavities 260 coupled by drift tube sections 280A-F in a drift tube region 270 of the tube. The resonant cavities 260 and drift tubes 270 in a klystron may be fabricated with materials and similar geometries as previously described in relation to the microwave cavity assembly 200. The void of each resonant cavity 260A-E and each drift tube section 280A-F of the drift tube 270 has a width, a height, and a length.

For example, each resonant cavity 260A-E has a cavity width 262 (for cavities 260A-D) and 268 (for output cavity 260E), a cavity height 264, and a cavity length 266A (for cavities 260A and 260E with a re-entrant feature) and 266D (for cavities 260B-D without a re-entrant feature). When the resonant cavity has a re-entrant feature, the resonant cavity 260B-D also has a re-entrant gap length 267, which is the distance of the void between the re-entrant features. Although, the cavity height 264 for cavities 260A-D are shown as similar, each resonant cavity can have a different cavity height (based on the desired resonant radio frequency field for the resonant cavity). The output cavity width 268 can differ from or be similar to the cavity width 262 (for cavities 260A-D) and the cavity heights 264 can differ from or be similar to each other for cavities 260A-E). FIGS. 5D-5E illustrate the cavity heights 264 as being similar. Although, the cavity width 262 for cavities 260A-D are shown as similar and different from the output cavity width 268, each resonant cavity can have a similar or different cavity width (based on the design desired resonant radio frequency field for the resonant cavity). Typically, in SBKs, the cavity width 262 or 268 is at least twice the distance of the cavity height 264. In some examples, the cavity width can be at least four times or ten times the distance of the cavity height.

The microwave cavity assembly 250 is shown with the barbell feature 247, the re-entrant feature 240, and a non-re-entrant feature 244 (i.e., cavity without a re-entrant feature). The barbell feature can have an inner cavity width 261 (inside the barbell), a barbell width 263 (for cavities 260A-D) or output cavity barbell width 263E (for output cavity 260E), and a input cavity barbell height 265A (for cavity 260A), a second cavity barbell height 265B (for cavity 260B), a third cavity barbell height 265C (for cavity 260C), a fourth cavity barbell height 265D (for cavity 260D), or an output cavity barbell height 265E (for output cavity 260E). Although, the barbell heights 265A-E for cavities 260A-E are shown as being different, in other examples (not shown), the barbell heights may be similar or different for the resonant cavities (based on the desired device characteristics).

The drift tubes 280A-F in the drift tube region 270 have various drift tube widths 282A-F, a drift tube height 274, and a drift tube region length 276. The drift tube region between resonant cavities 260A-E, between the anode and the first resonant cavity (or input resonant cavity or "buncher" cavity) 260A, and between the last resonant cavity (or output resonant cavity or "catcher" cavity or final resonant cavity) 260E and the collector can each be referred to as drift tube sections 230A-F. Each drift tube section 230A-F has a drift tube section width (or tube section width) 282A-F, drift tube section height (or tube section height) 274, and drift tube section void length (or tube section length or tube section void length) 286A-F. The drift tube section heights 274 are uniform and similar for each of the drift tube sections 230A-F and are referred to collectively as the drift tube height 274. In other examples (not shown), the drift tube section heights may vary from each other based on design parameters. The drift tube section widths 282A-F and the drift tube section heights 274 are defined by the internal walls or structure of the drift tube. Typically, in SB Ks, the drift tube section widths 282A-F are at least twice the distance of the drift tube section height 274. In some examples, the drift tube section widths can be at least four times or ten times the distance of the drift tube section height. For example, if a drift tube section height is 10 mm, a drift tube section width can equal or exceed 20 mm (for at least twice the drift tube section height), 40 mm (for at least four times the drift tube section height), or 100 mm (for at least ten times the drift tube section height).

In the z-axis, the drift tube sections extend into the void of the resonant cavity. The drift tube section void length 286A-F can be defined by a point (e.g., a midpoint) within the resonant cavity. In other examples (not shown), a drift tube section void length can be defined by the boundary or discontinuity between the drift tube section and the adjoining resonant cavity. The drift tube section 280B-D between resonant cavities can have similar or different drift tube section void lengths 286B-D. The drift tube section 280E between the fourth resonant cavity (second to last cavity referred to as the penultimate cavity or penultimate resonant cavity) and the output resonant cavity (or final resonant cavity) can be adjusted (e.g., shorten) to decelerate the electron beam for the output signal.

The cavity width 262 or 268 differs from the drift tube section width 282A-F to create a discontinuity in the void between the resonant cavities 260A-E and drift tube sections 280A-F. In an example, the cavity width 262 or 268 is greater than the drift tube section width 282A-F. In another configuration, the cavity height differs from the drift tube section height to create a discontinuity in the void between the resonant cavities and drift tube sections. In an example, the cavity height 264 is greater than the drift tube section height 274. In some examples, the cavity height is twice the distance of the drift tube section height.

By substantially varying the drift tube section width 232A-F, the resonant frequency of the RF fields of the drift tube section can differ from each other and reduce the gain of the trapped or parasitic modes with minimal effect on the intended frequency, gain, or bandwidth of the resonant cavities. Varying the drift tube section width allows some of the RF fields of the traverse modes to radiate out of the cavity, thus decreasing the external quality factor, $Q_e$. In one example, at least two drift tube section widths (e.g., 282A and 282B, 282B and 282C, 282C and 282D, or 282D and 282E) can be substantially different from each other. A substantial variance or difference is a difference that exceeds a manufacturing tolerance of the vacuum electron device by a specified factor (e.g., three or five times the manufacturing tolerance). Typically, exceeding a manufacturing tolerance causes a device to operate outside of a defined specification (e.g., operate improperly). Two dimensions with a substantial variance or difference from each other are two dimensions that are dissimilar from each other (i.e., outside of a manufacturing tolerance; or intentionally different).

In a configuration, at least one drift tube section width (e.g., 282C) is at least 0.3% greater than another drift tube section width (e.g., 282D). In one example, the drift tube sections with different drift tube section widths are adjacent to each other (separated by a single resonant cavity). For example, in a five cavity S-band SBK designed to operate at around 2.856 GHz, the resonant cavities and drift tubes sections may be configured to amplify a 2.856 GHz input signal. The drift tube section widths may vary from 160 mm to 150 mm between resonant cavities one and five 260A-E. If one drift tube section or a first drift tube section (e.g., 280D) has a width (e.g., 282D) of 153 mm then another drift tube section or a second drift tube section (e.g., 280C) has a width (e.g., 282C) that is at least 0.46 mm (0.3%) greater than 153 mm (for a width of 153.46 mm or greater). If a manufacturing tolerance is ±76.2 μm (for a total tolerance of 152.4 μm), then at least 0.46 mm is at least three times (e.g., a specified factor of) a manufacturing tolerance. In another example, at least one drift tube section width (e.g., 282C) is at least 2% greater than another drift tube section width (e.g., 282D), so applied to the example, the other drift tube section width (e.g., 282C) is at least 156 mm. In another example, at least one drift tube section width (e.g., 282C) is less than twice another drift tube section width (e.g., 282D), so applied to the example, the other drift tube section width (e.g., 282C) is less than 306 mm. In another example, at least one drift tube section width (e.g., 282C) is less than 1½ times another drift tube section width (e.g., 282D), so applied to the example, the other drift tube section width (e.g., 282C) is less than 229.5 mm.

In an example where the hollow tube structure includes a third drift tube section (e.g., 280B), a third drift tube section width (e.g., 282B) can be substantially different (e.g., at least 0.3%) from the first drift tube section width (e.g., 282D) and the second drift tube section width (e.g., 282C). The third drift tube section can be separated from the first drift tube section or the second drift tube section by a resonant cavity (e.g., a fourth resonant cavity 260B).

In another configuration, a first drift tube section (e.g., 280C) with a first drift tube section width (e.g., 282C) is configured to generate a first drift resonant RF field and a second drift tube section (e.g., 280D) with a section drift tube section width (e.g., 282D) is configured to generate a second drift resonant RF field, and a peak of the first drift resonant RF field varies from a peak of the second drift resonant RF field by at least 0.6% of the peak of the first drift resonant RF field where the RF fields in the two drift tube sections have the same indices m, n, and p (i.e. the same mode) for transverse modes whose resonant frequency is less than two times the operating frequency and whose resonant frequency is less than two times the cutoff frequency. The difference in the drift resonant RF field peaks can apply to transverse modes influencing mode instability, such as TE mode instability. For example, using the example of an S-band SBK designed to operate at around 2.856 GHz, the drift tube section 280D with the drift tube section width 282D of 153.3 mm is configured to generate a 4.025 GHz peak drift resonant RF field for a $TE_{302}$ mode and drift tube section 280E with the drift tube section width 282E of 150 mm and is configured to generate a 4.072 GHz peak drift resonant RF field for the $TE_{302}$ mode (when other dimensions, parameters, and features being similar between the resonant cavities and drift tube sections). The difference between the peak drift resonant RF fields due to the change in drift tube width is 47 MHz, which is 1.17% of 4.025 GHz peak drift resonant RF field, which is at least 0.6% (i.e., 24 MHz) of the peak of the first drift resonant RF field. In another example, a peak of the first drift resonant RF field varies from a peak of the second drift resonant RF field by at least 0.25% of the peak of the first drift resonant RF field. So applied to the example, if the drift tube section width 282E of 150 mm has 4.072 GHz peak drift resonant RF field for the $TE_{302}$ mode, the drift tube section width 282D is selected so the peak drift resonant RF field for the $TE_{302}$ mode for the drift tube section 280D differs by at least 10 MHz (i.e., 0.25%) from 4.072 GHz (i.e., >4.082 GHz or <4.052 GHz). In another example, a peak of the first drift resonant RF field varies from a peak of the second drift resonant RF field by at least 1% of the peak of the first drift resonant RF field. So applied to the example, if the drift tube section width 282E of 150 mm has 4.072 GHz peak drift resonant RF field for the $TE_{302}$ mode, the drift tube section width 282D is selected so the peak drift resonant RF field for the $TE_{302}$ mode for the drift tube section 280E differs by at least 41 MHz (i.e., 1%) from 4.072 GHz (i.e., >4.113 GHz or <4.031 GHz).

In an example where the hollow tube structure includes a third drift tube section (e.g., 280B), the third drift tube section can be configured to generate a third drift resonant frequency. The third drift resonant frequency can varies from the first drift resonant frequency by at least 0.7% of the third drift resonant frequency and varies from the second drift resonant frequency by at least 0.6% of the third drift resonant frequency.

The difference between the peak drift resonant RF fields can also be represented symbolically. While Expression 1 is primarily used to determine the resonant frequencies for transverse modes for a closed rectangular cavity, Expression 1 may be used to approximate the resonant frequencies for transverse modes of the drift tube sections with open ends adjoining the resonant cavities with some modifications and corrections. The drift resonant frequency for a transverse mode of each drift tube section can be approximated by Expression 1, and a delta drift resonant frequency between peaks of the drift resonant frequencies can be generated. A change in the drift tube section width between drift tube sections can generate the delta drift resonant frequency. In an example, delta drift resonant frequency is at least 0.25% for each transverse mode. In another example, delta drift resonant frequency is at least 0.5% for each transverse mode. In another example, delta drift resonant frequency is at least 1% for each transverse mode.

As previously shown and discussed, the drift tube sections have openings on each end of the drift tube section length, thus the length of the void or cavity of the drift tube section formed in the z-direction represented by 'd' in Expression 1 is approximated and a correction factor is added for the geometry or features (e.g., re-entrant feature or barbell feature) of the resonant cavity of each end of the drift tube section. For example, a first drift resonant frequency for a transverse mode of the first drift tube section is approximated by Expression 18, and a second drift resonant frequency for a transverse mode of the second drift tube section is represented by Expression 19, and a delta drift resonant frequency is represented by Expression 20.

$$f_{do_1,mnp} = \frac{1}{2\pi\sqrt{\mu_1\varepsilon_1}}\sqrt{\left(\frac{m\pi}{w_1}\right)^2 + \left(\frac{n\pi}{h_1}\right)^2 + \left(\frac{p\pi}{l_1}\right)^2} \quad \text{[Expression 18]}$$

$$f_{do_2,mnp} = \frac{1}{2\pi\sqrt{\mu_2\varepsilon_2}}\sqrt{\left(\frac{m\pi}{w_2}\right)^2 + \left(\frac{n\pi}{h_2}\right)^2 + \left(\frac{p\pi}{l_2}\right)^2} \quad \text{[Expression 19]}$$

$$\Delta f_{do,mnp} = \left|\frac{f_{do_1,mnp} - f_{do_2,mnp}}{f_{do_1,mnp}}\right| \quad \text{[Expression 20]}$$

where $\mu_1$ is a composite magnetic permeability and $\epsilon_1$ is a composite magnetic permittivity of a volume of a material in the first drift tube section; $w_1$ is the drift tube section width (e.g., 282D); $h_1$ is the drift tube section height (e.g., 274); and $l_1$ is an approximation of the drift tube section length (e.g., 286D) of the first drift tube section, a half of the cavity height (e.g., 264) of the first resonant cavity, a half of the cavity height of the second resonant cavity (e.g., 264), and a correction factor for features of the first resonant cavity, the first drift tube section, and the second resonant cavity; and m, n, and p are non-negative integers representing the transverse mode and m and n are not both zero; and where $\mu_2$ is a composite magnetic permeability and $\epsilon_2$ is a composite magnetic permittivity of a volume of a material in the second drift tube section; $w_2$ is the drift tube section width (e.g., 282E); $h_2$ is the drift tube section height (e.g., 274); and $l_2$ is an approximation of the drift tube section length (e.g., 286E) of the second drift tube section, a half of the cavity height (e.g., 264) of the second resonant cavity, a half of the cavity height (e.g., 264) of the third resonant cavity, and a correction factor for features of the second resonant cavity, the second drift tube section, and the third resonant cavity.

If the features and geometries for the first and second drift tube sections (i.e., parameters of Expressions 18 and 19) are similar except for the drift tube section width, Expressions 18-19 can be represented by Expressions 21-22, respectively.

$$f_{do_1,mnp} = \frac{1}{2\pi\sqrt{\mu\varepsilon}}\sqrt{\left(\frac{m\pi}{w_1}\right)^2 + \left(\frac{n\pi}{h}\right)^2 + \left(\frac{p\pi}{l}\right)^2} \quad \text{[Expression 21]}$$

$$f_{do_2,mnp} = \frac{1}{2\pi\sqrt{\mu\varepsilon}}\sqrt{\left(\frac{m\pi}{w_2}\right)^2 + \left(\frac{n\pi}{h}\right)^2 + \left(\frac{p\pi}{l}\right)^2} \quad \text{[Expression 22]}$$

where $\mu$ is a composite magnetic permeability and $\epsilon$ is a composite permittivity of a volume of a material in a drift tube section, $w_1$ is the drift tube section width (e.g., 282D) of the first drift tube section, $w_2$ is the drift tube section width (e.g., 282E) of the second drift tube section, h is the drift tube section height (e.g., 274), and l is an approximation of the drift tube section length (e.g., 286B-D) of the drift tube section, a half of the cavity height (e.g., 264) of the resonant cavities on each end of the drift tube section, and a correction factor for features of the drift tube section and the resonant cavities on each end of the drift tube section; and m, n, and p are non-negative integers representing the transverse mode and m and n are not both zero.

In another configuration, the first drift tube section (e.g., 280D) is configured to generate a first drift resonant RF field with a first drift bandwidth and the second drift tube section (e.g., 280E) is configured to generate a second drift resonant RF field with a second drift bandwidth, and a peak of the first drift resonant RF field varies from a peak of the second drift resonant RF field by at least one and a half times the sum of the first drift loaded bandwidth and second drift loaded bandwidth, where the drift loaded bandwidth is given by the resonant frequency divided by the loaded quality factor ($f_{o,mnp}/Q_l$) for transverse modes whose resonant frequency is less than two times the operating frequency and whose resonant frequency is less than two times the cutoff frequency. For example, using an S-band SBK example designed to operate at around 2.856 GHz, the drift tube section 280D with the drift tube section width 282D of 153.3 mm is configured to generate a 4.025 GHz peak drift resonant RF field for a $TE_{302}$ mode and a loaded quality factor of 900, giving a drift loaded bandwidth of 4.5 MHz, and drift tube section 280E with the drift tube section width 282E of 150 mm (when other dimensions, parameters, and features being similar between the resonant cavities and drift tube sections), and is configured to generate a 4.071 GHz peak drift resonant RF field for the $TE_{302}$ mode and a loaded quality factor of 840, giving a drift loaded bandwidth of 4.8 MHz. The difference between the two resonant frequency peaks is 46 MHz (i.e., 4.071 GHz-4.025 GHz), which is greater than 13.95 MHz (i.e., one and a half times the sum of the two drift loaded bandwidths—1.5*[4.5 MHz+4.8 MHz]).

Figure 5I:
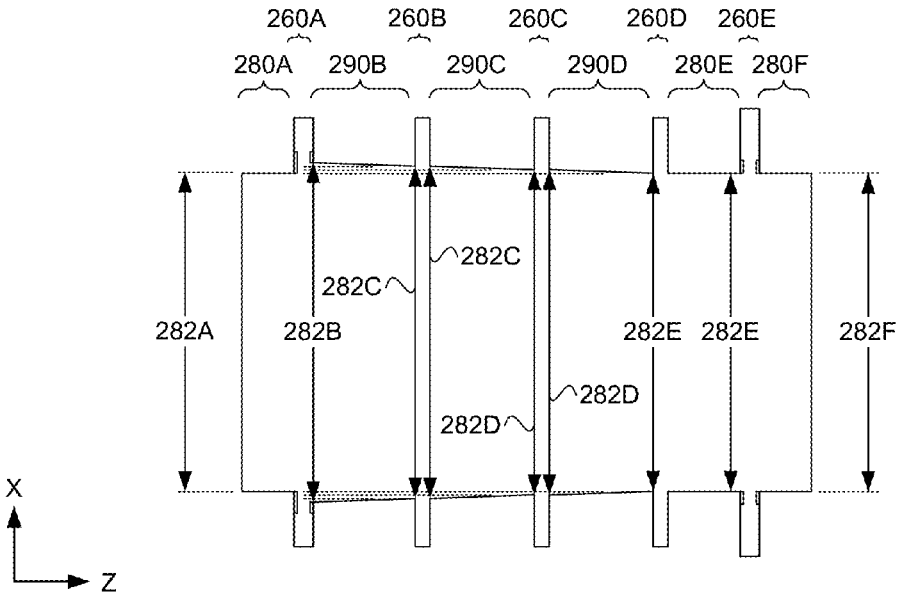
Figure 5J:
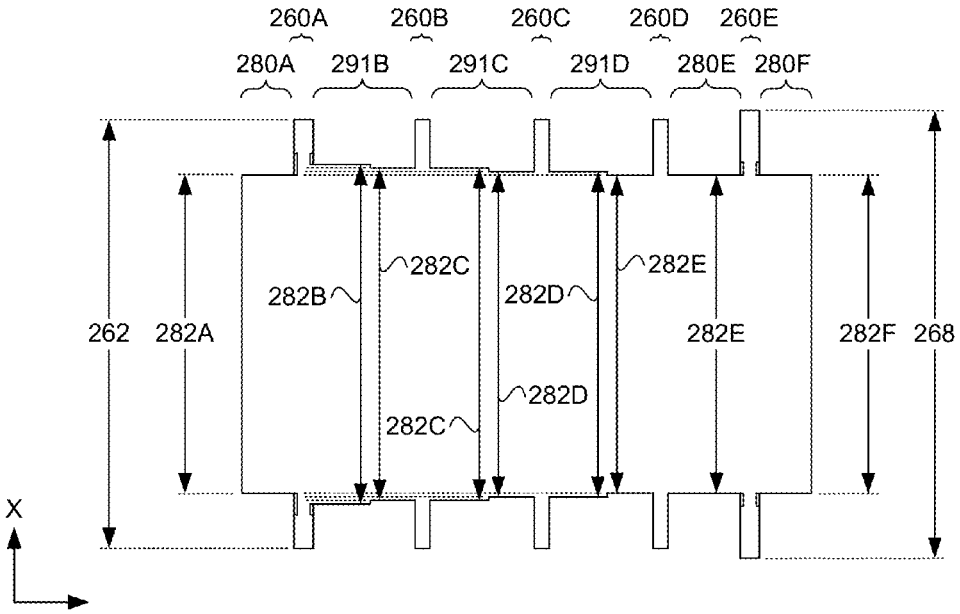
Figure 6A:
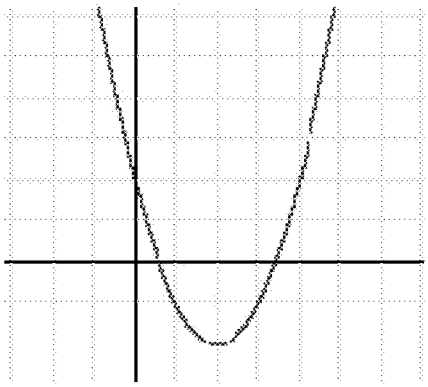
FIGS. 6A-6D illustrate example polynomial functions that can be used for drift tube section walls.
Figure 6B:
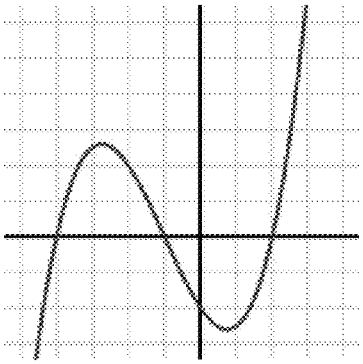
Figure 6C:
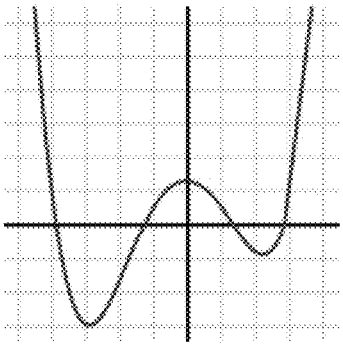
Figure 6D:
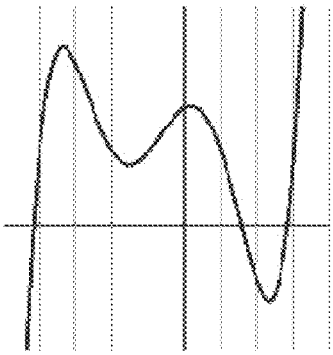
Figure 6E:
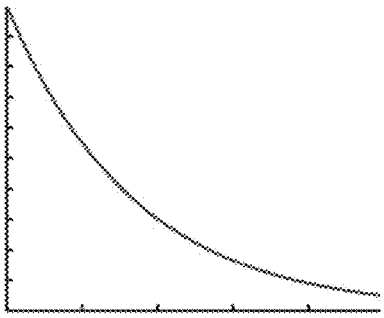
FIG. 6E illustrates an example exponential function that can be used for drift tube section walls.
Figure 6F:
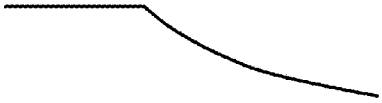
FIG. 6F illustrates an example piece wise combination of a linear function with an exponential function that can be used for drift tube section walls.

FIGS. 5A-5H shows drift tube sections 280A-F as having a cuboid shape with uniform widths along the drift tube sections where drift tube sections 280A, 280E, and 280F have similar widths (e.g., minimum drift tube width 272) and drift tube sections 280B-D have incrementally larger width in a decreasing step pattern from drift tube section 280B to 280E. In other examples, the drift tube sections can have different shapes (i.e., non-uniform) and width configurations in both the y-direction and z-directions. FIGS. 5I-5J illustrate changes along the z-axis. FIG. 5I illustrates a taper of the drift tube section widths 282A-F in the drift sections 290A-F forming a substantially trapezoid shape or linear shape, as seen from a top cross-sectional view. FIG. 5J illustrates a step function of the drift tube section width 282A-F in the drift sections 291A-F forming a double staircase shape, as seen from a top cross-sectional view. Other functions and shapes, such as an exponential shape, a polynomial shape, or a piece wise combination of different shapes, along the width of the drift tube section may also be used. FIGS. 6A-6D illustrate examples of second degree, a third degree, a fourth degree, and fifth degree polynomials, respectively. Other order polynomials may also be used. FIG. 6E illustrates an example exponential function. Other continuous functions may also be used. FIG. 6F illustrates an example of a piece wise combination of a linear function with an exponential function. Other piece wise combinations may also be used.

In a configuration, at least one drift tube section (e.g., 290B-D or 291B-D) has at least two drift tube section widths (e.g., 282B-E) that are substantially different from each other. In one example, each drift tube section width (e.g., 282A-F) is as at least twice the drift tube section height (e.g., 274). In another example, at least one drift tube section width (e.g., 282B-E) is at least 0.3% different from (e.g., greater than) the other drift tube section width (e.g., 282B-E) within a drift tube section.

Figure 7:
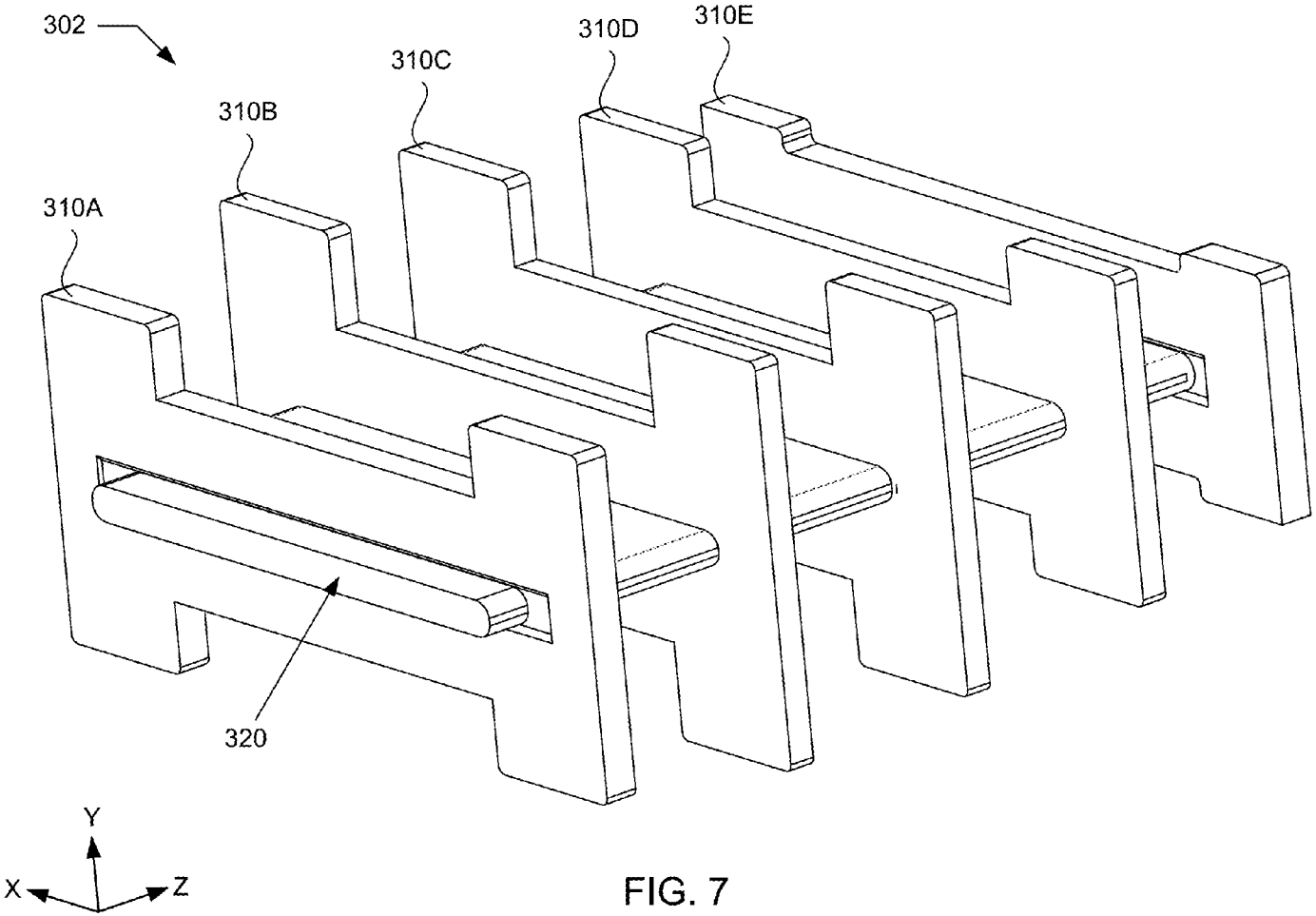
FIG. 7 illustrates resonant cavities and drift tube voids of a SBK.
Figure 8A:
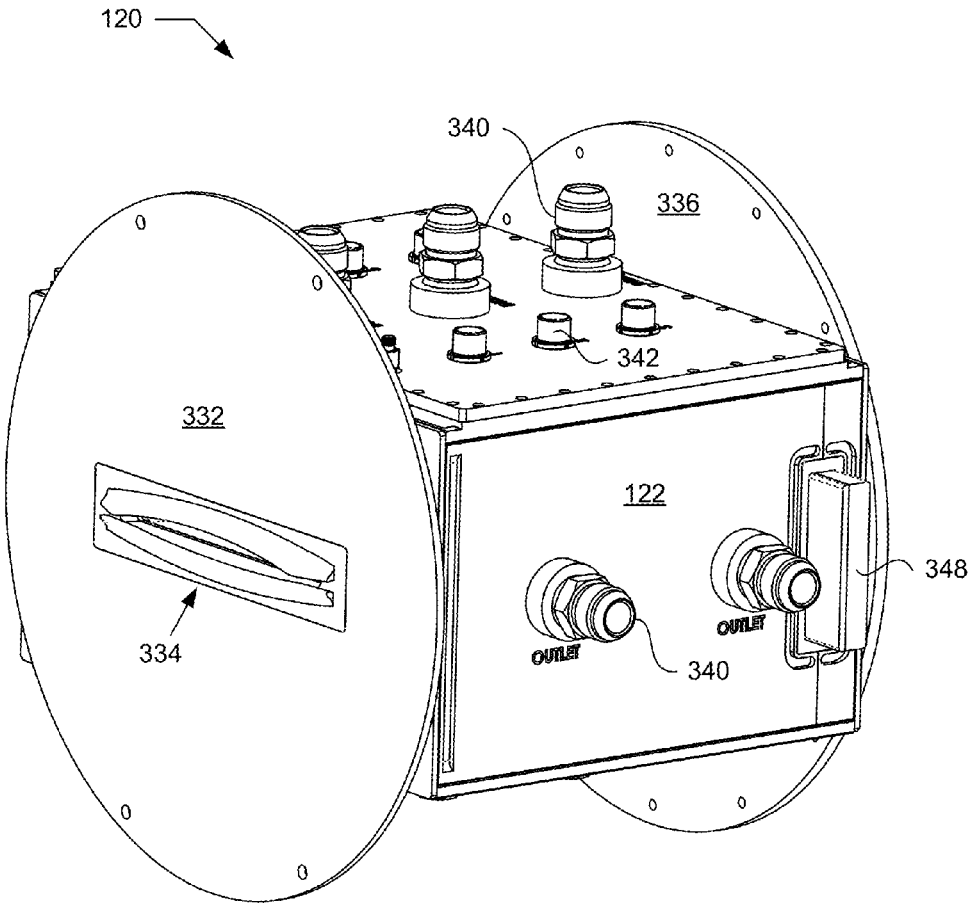
FIGS. 8A-8B illustrate views of a microwave cavity assembly and magnetic circuit of a SBK.
Figure 8B:
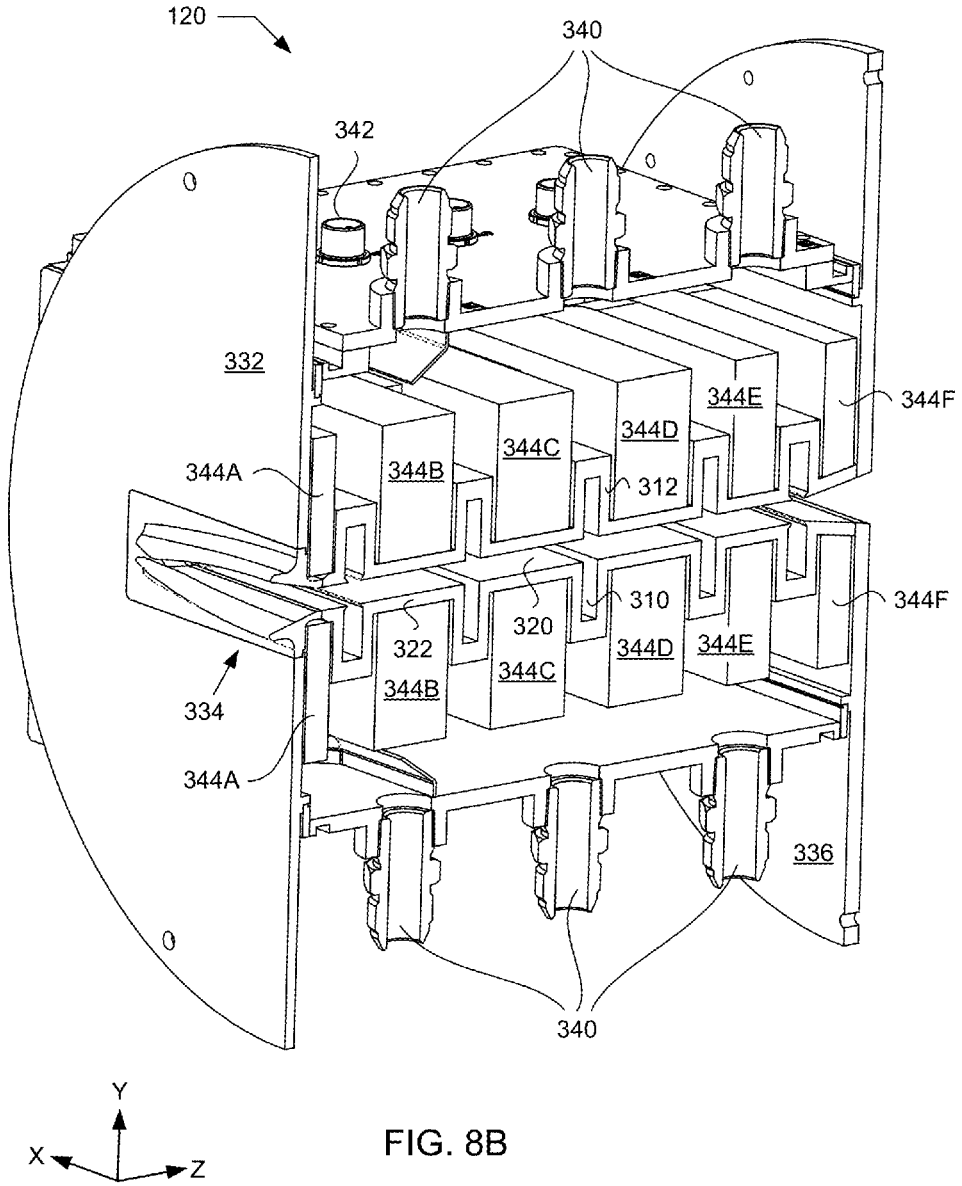
Figure 9:
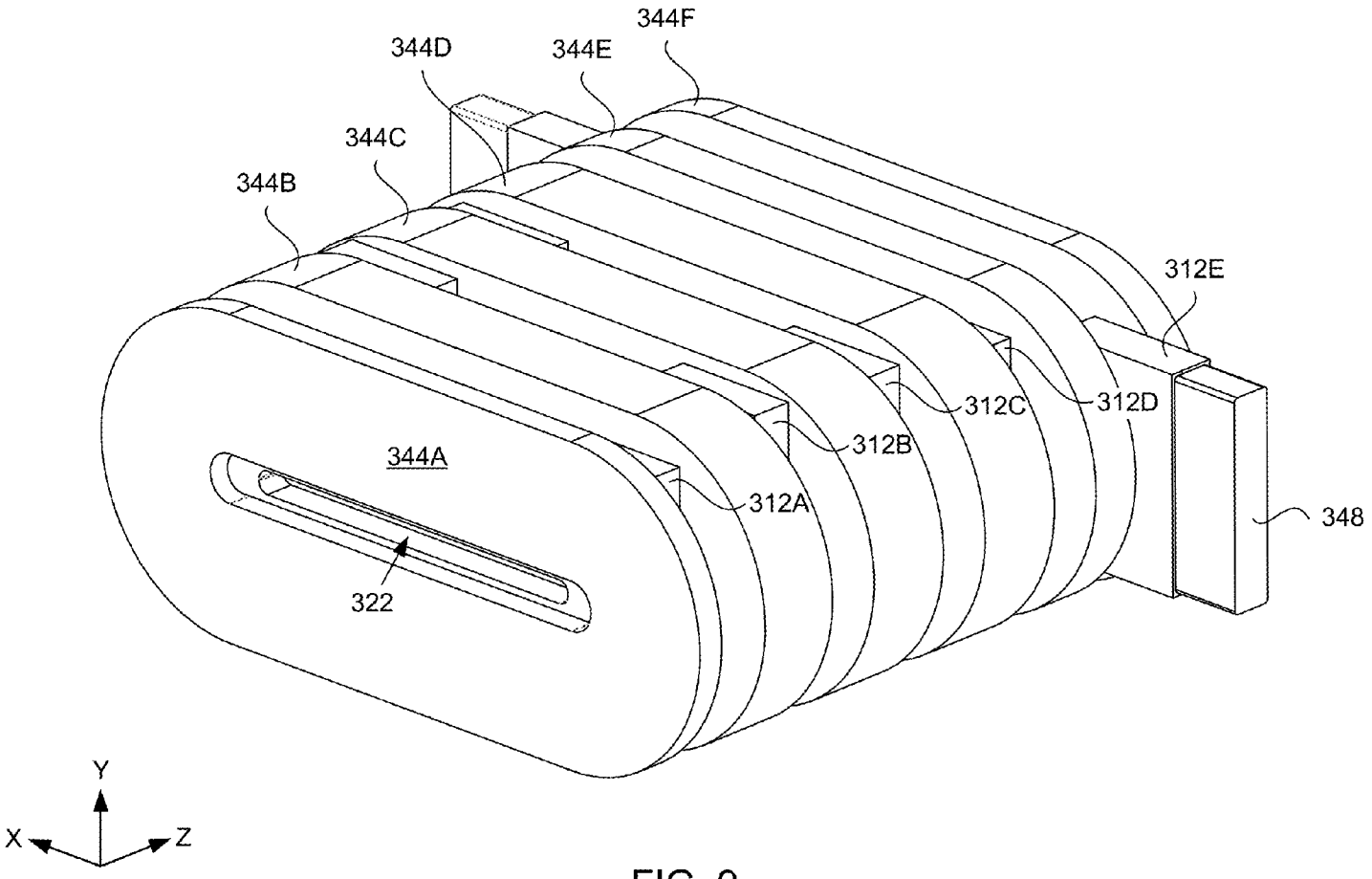
FIG. 9 illustrates a resonant cavity structures and solenoid coils wound around a drift tube of a SBK.

FIG. 7 illustrates microwave cavities 302 including the resonant cavities (or resonator cavities or resonator voids) 310A-E and drift tube voids 320 or 320A-F a five cavity SBK. FIG. 8A illustrates a perspective view of a microwave cavity assembly and magnetic circuit of a SBK, and FIG. 8B shows a perspective cross-sectional view of the resonant cavities 310 and the drift tube voids 320 in the microwave cavity assembly 120 and magnetic circuit with a cross-section taken along a center section of the microwave cavity assembly in a y-z plane. FIG. 9 illustrates a resonant cavity structures 312A-E and solenoid coils 344A-F wound around a drift tube of the microwave cavity assembly. As previously discussed, the microwave cavity assembly 120 includes the magnetic return circuit or box 122 with an anode end pole piece (plate) 332 (also referred to as an input box pole piece or electron gun side pole piece), a collector end pole piece (plate) 336 (also referred to as an output box pole piece or collector side pole piece), cooling interfaces or cooling adapters 340 to circulate coolant between the microwave cavity assembly and a heat exchanger, and solenoid coil connectors 342. The magnetic return box 122 can also provide an opening for the output waveguide 348. The anode end pole piece 332 can include the anode 334. The electron gun can be electrically coupled to the microwave cavity assembly (i.e., hollow tube structure including the drift tube sections and resonant cavities) via the anode 334. The pole pieces 332 and 336 can support the microwave cavity assembly (300 in FIGS. 10A-10J) with the resonant cavities 310 defined by a resonant cavity structure 312 or 312A-E and drift tube cavities 320 or 320A-F defined by a drift tube 322. A magnet or a portion of a magnetic focusing assembly (e.g., solenoid coil 344A-F [electromagnet], permanent magnet, or electromagnet and permanent magnet combination) used to assist with focusing the electron beam in the microwave cavity assembly can at least partially surround the drift tube sections in the x-y plane.

Figure 10A:
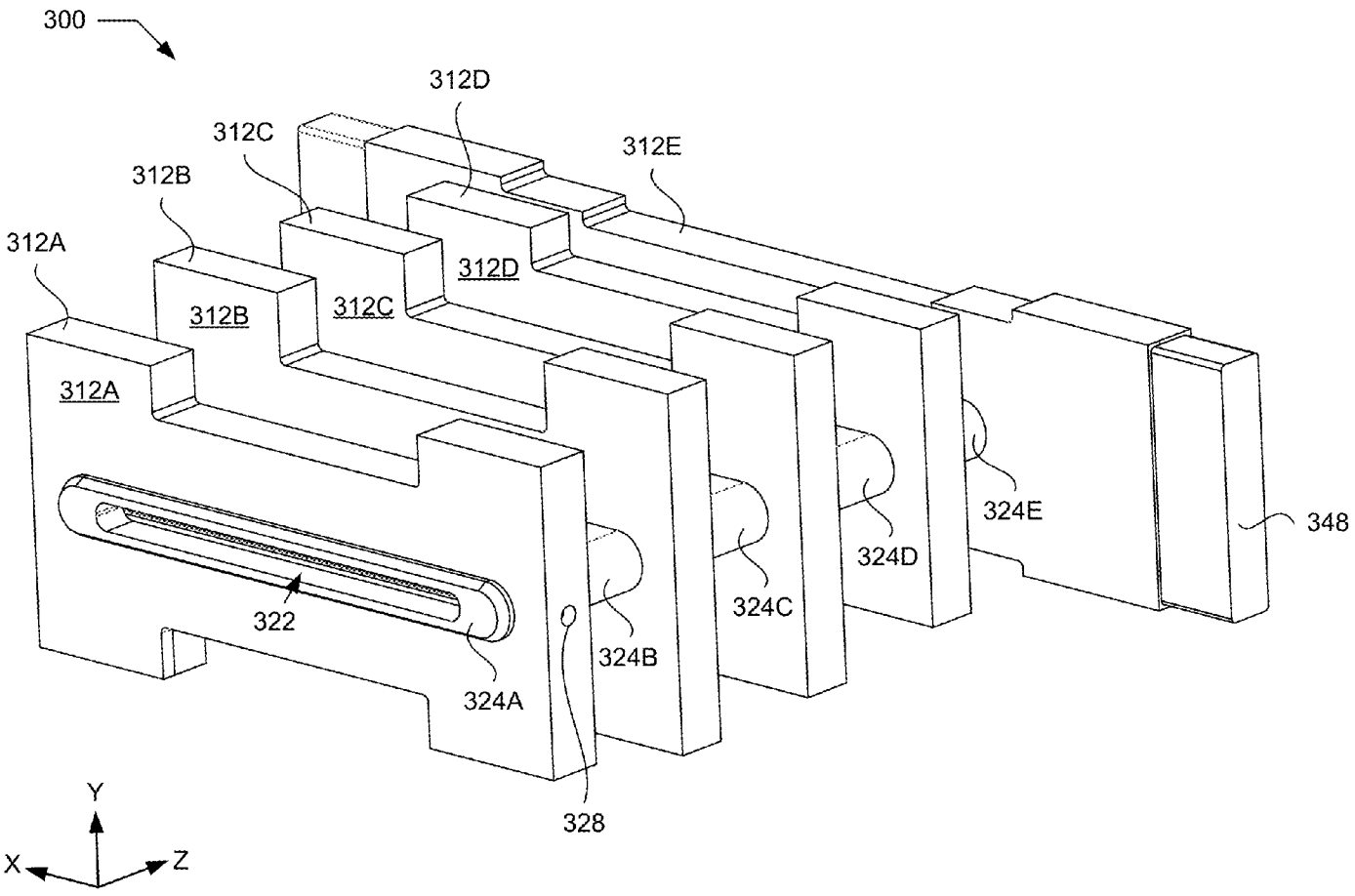
FIGS. 10A-10J illustrate a resonant cavity structures and drift tube of a SBK.
Figure 10B:
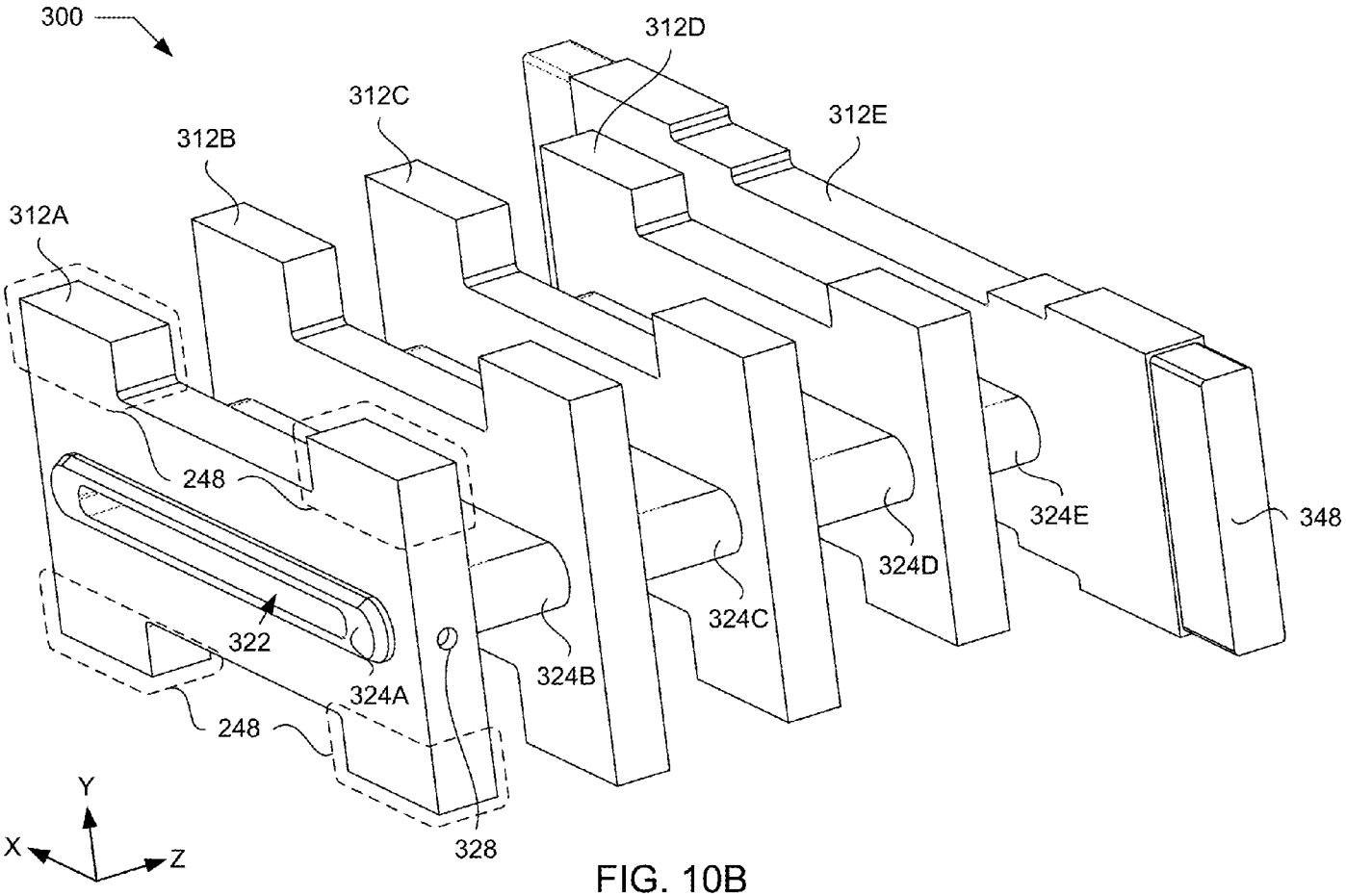
Figure 10C:
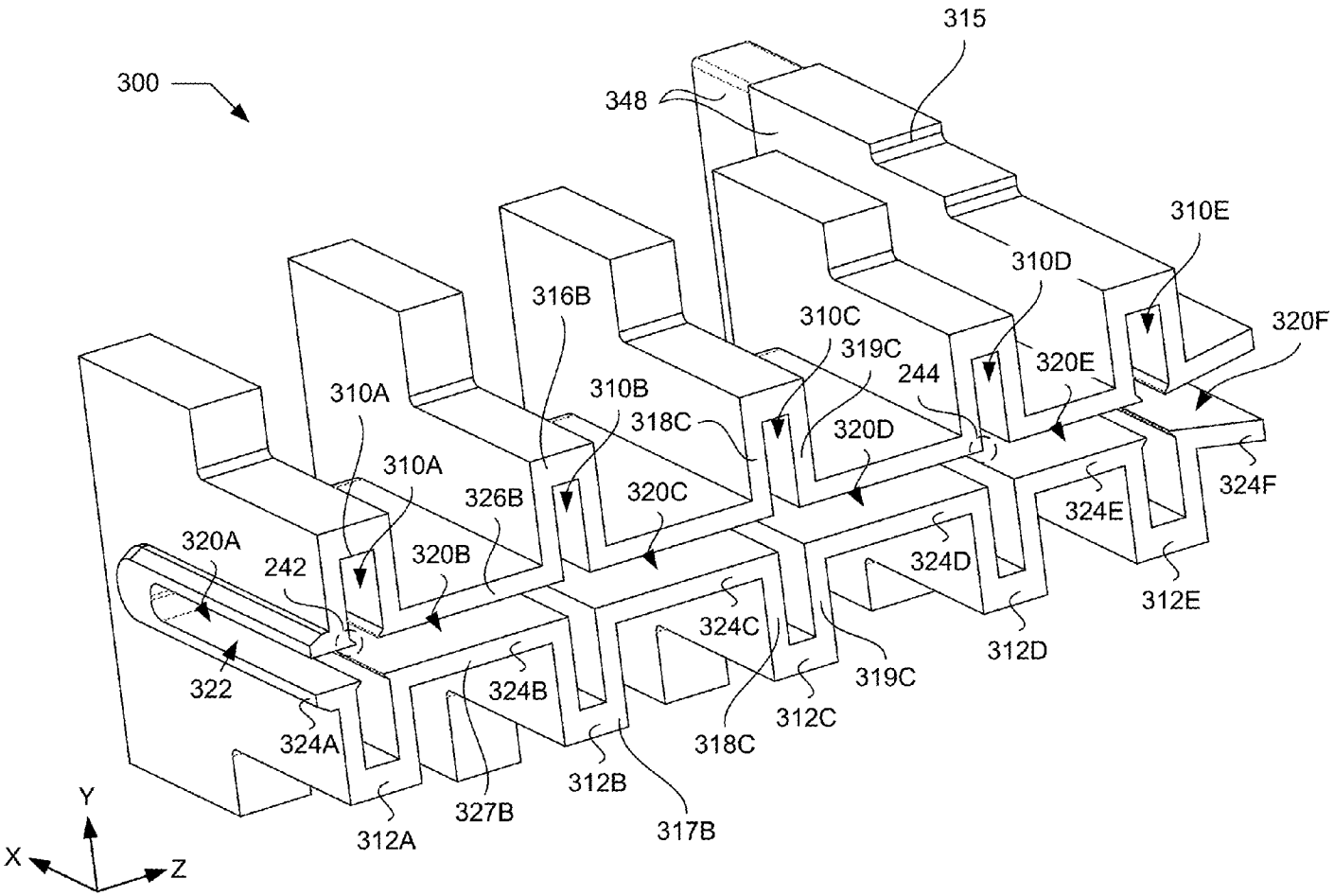
Figure 10D:
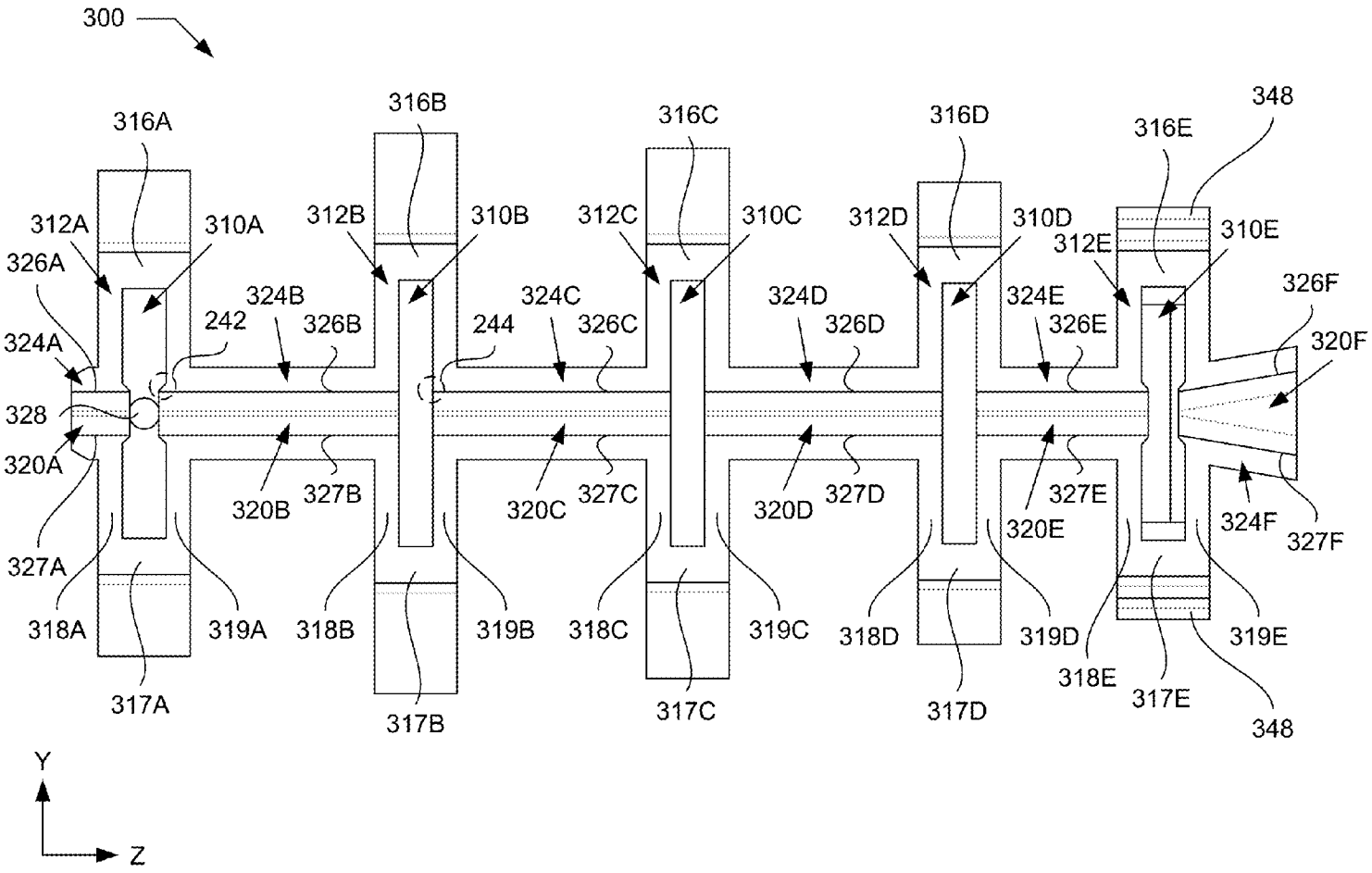
Figure 10E:
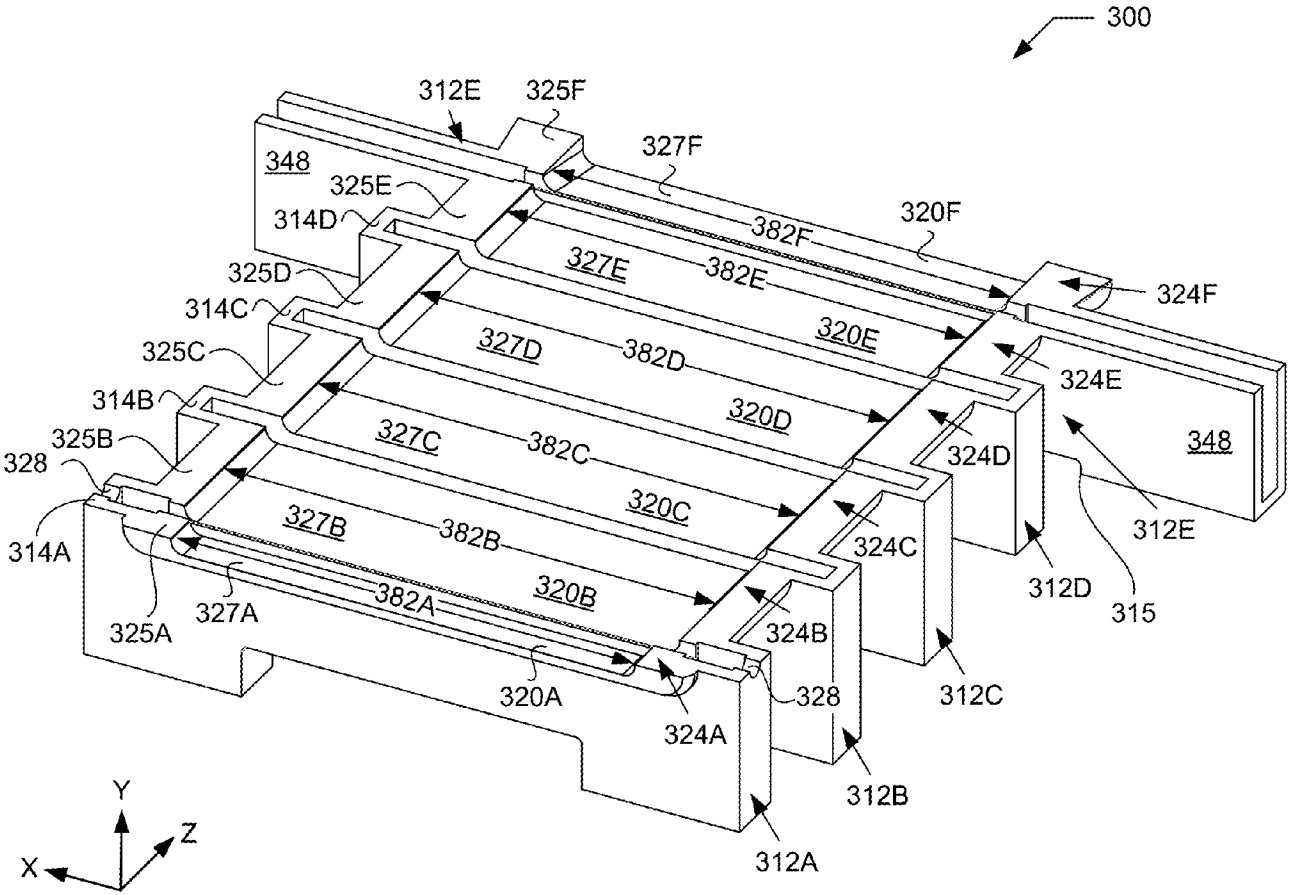
Figure 10F:
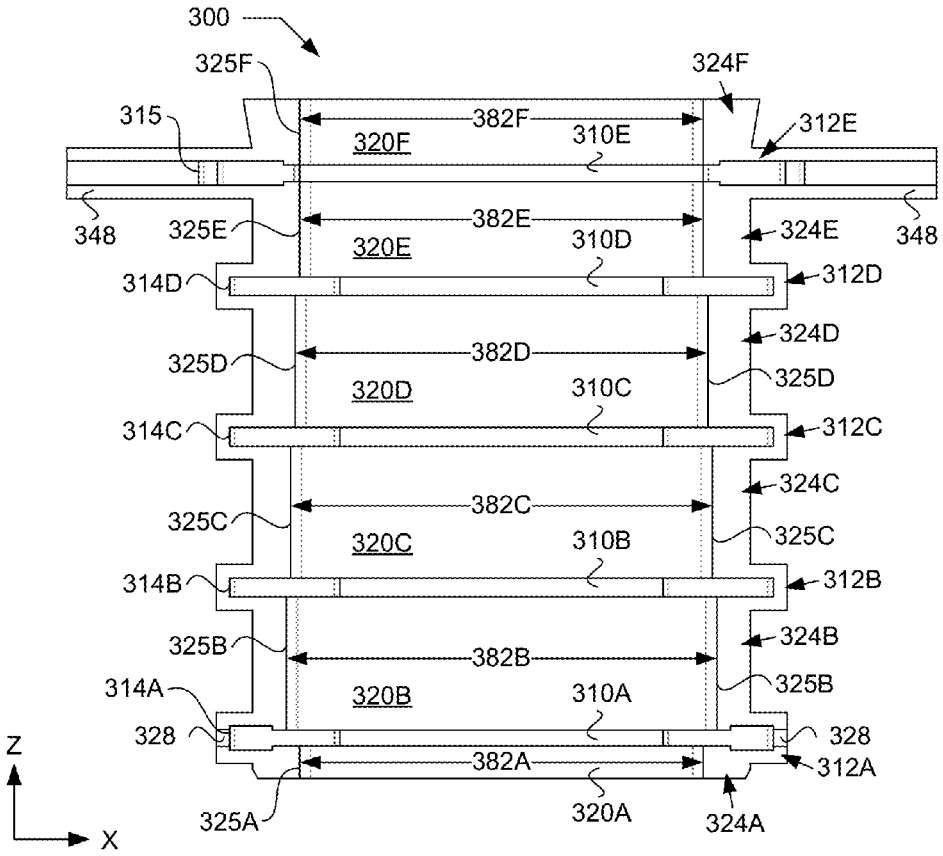
Figure 10G:
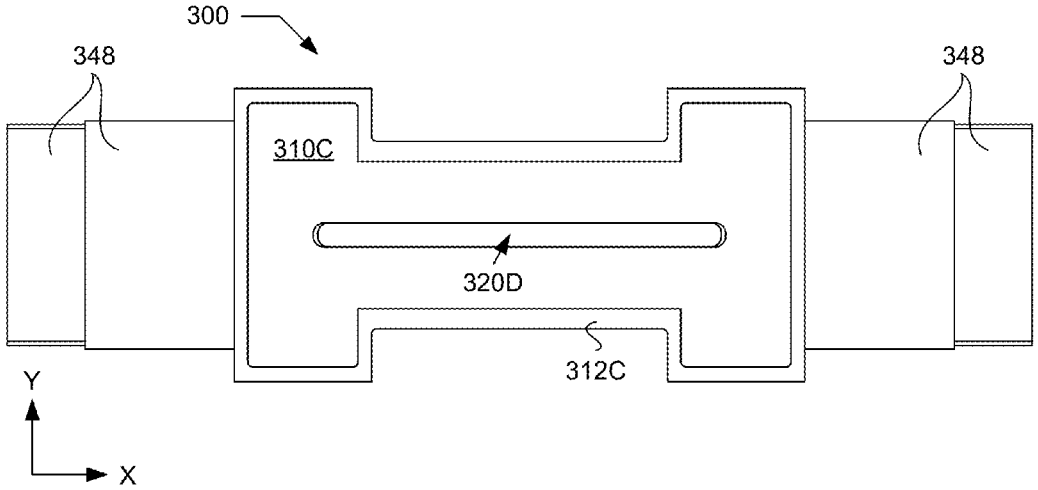
Figure 10H:
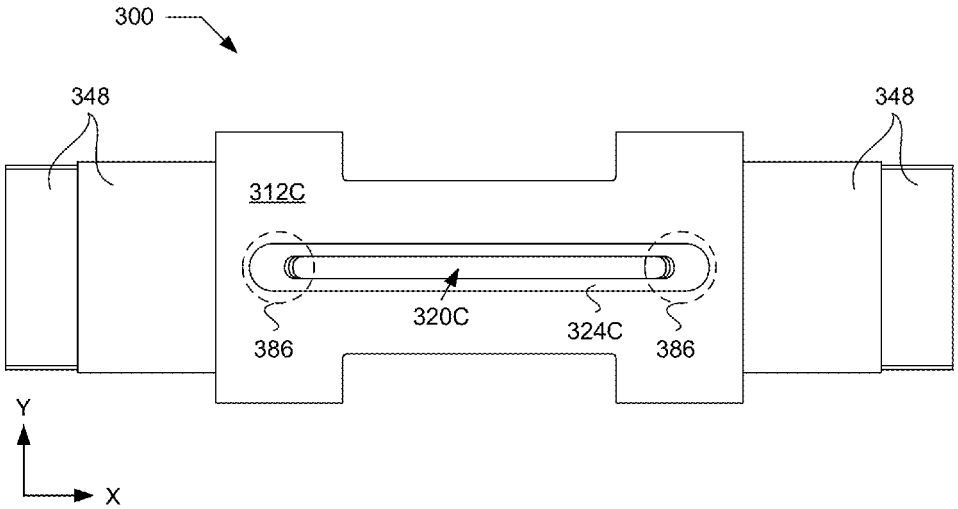
Figure 10I:
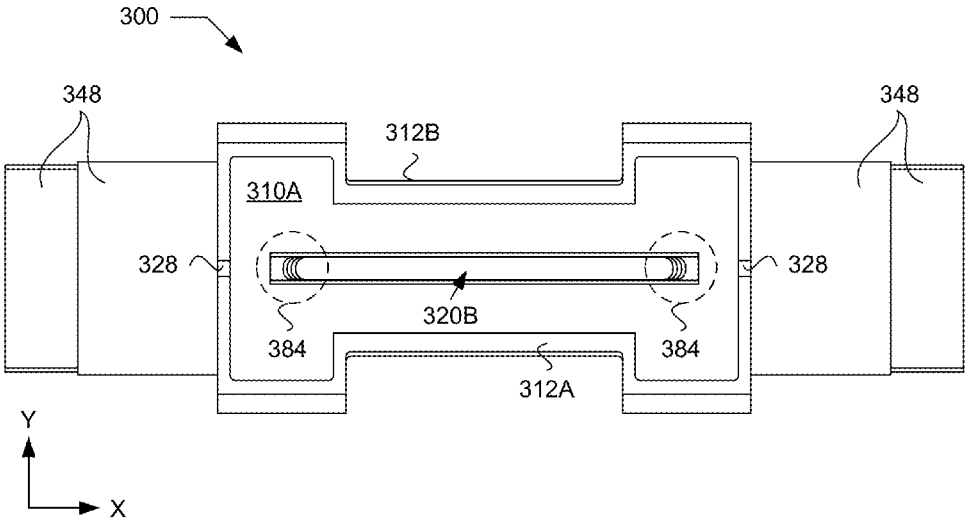
Figure 10J:
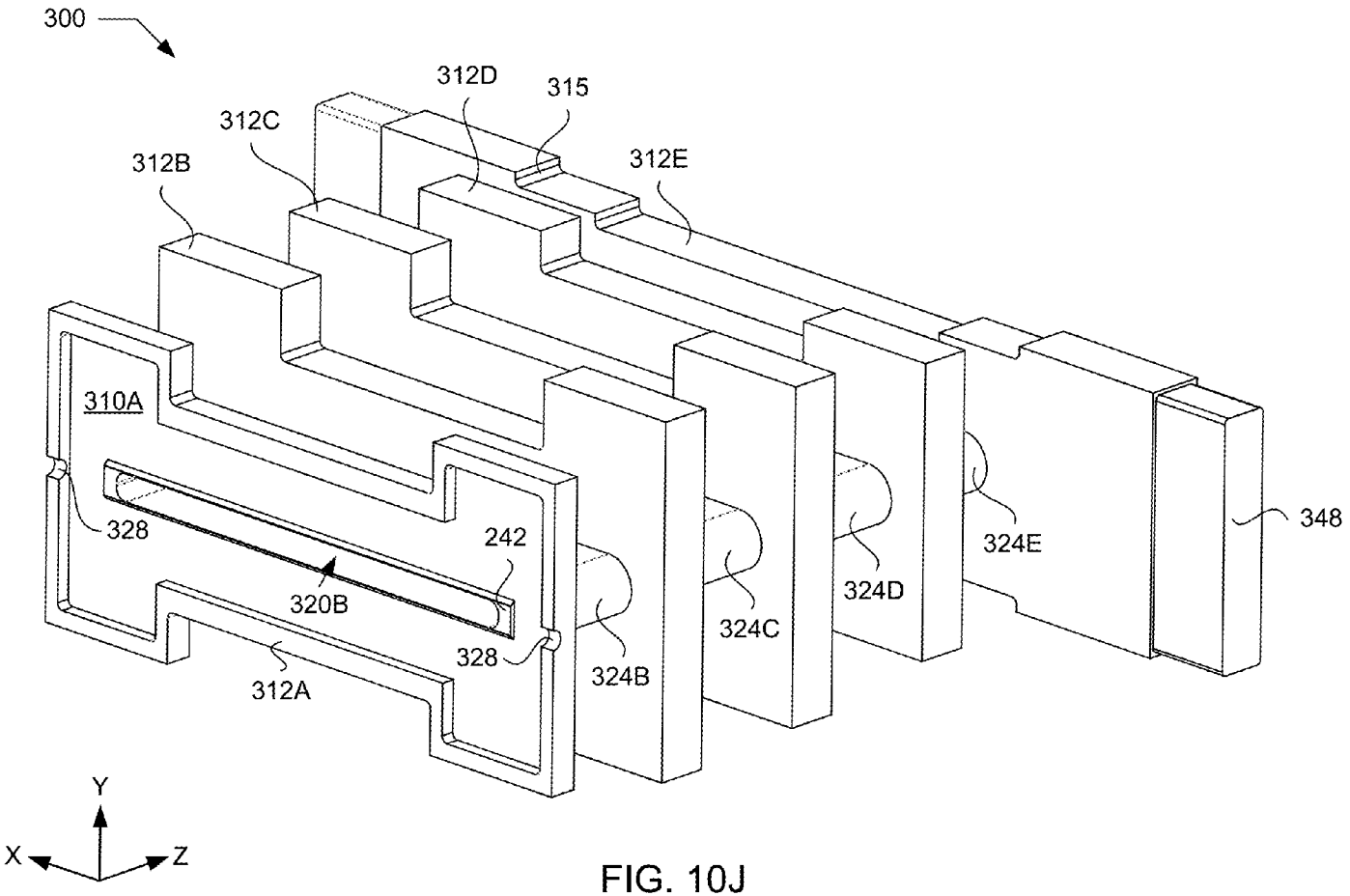

FIGS. 10A-10J illustrate a resonant cavity structures 312A-E and drift tube sections 324A-F of the five cavity SBK shown in FIGS. 3 and 7-9. FIG. 10A shows a front perspective view, FIG. 10B shows a side perspective view, FIG. 10I shows a front cross-sectional view and FIG. 10J shows a front perspective cross-sectional view of the microwave cavity assembly 300 with a cross-section taken along a center section of the input resonant cavity 310A in a x-y plane. FIG. 10C shows a perspective cross-sectional view and FIG. 10D shows a side cross-sectional view of the resonant cavities and the drift tube voids in the microwave cavity assembly 300 with a cross-section taken along a center section of the microwave cavity assembly in a y-z plane. FIG. 10E shows a perspective cross-sectional view and FIG. 10F shows a top cross-sectional view of the resonant cavities and the drift tube voids in the microwave cavity assembly 300 with a cross-section taken along a center section of the microwave cavity assembly in an x-z plane. FIG. 10G shows a front cross-sectional view of the resonant cavities and the drift tube voids in the microwave cavity assembly 300 with a cross-section taken along a center section of the third resonant cavity 310C in an x-y plane. FIG. 10H shows a front cross-sectional view of the resonant cavities and the drift tube voids in the microwave cavity assembly 300 with a cross-section taken along a center section of the drift tube section 324C between the second resonant cavity 310B and third resonant cavity 310C in an x-y plane.

The RF input signal can be injected into the first resonant cavity 312A (or input resonant cavity or input cavity) via input signal opening 328 and the amplified RF output signal can be channeled out from the last resonant cavity 312E (or output resonant cavity or output resonant cavity) through output waveguides 348. Using mechanisms known in the art, each resonant cavity can be tuned to a precise frequency. The resonant cavities 312A-E includes barbell features 248. In other examples (not shown), the resonant cavities can have other sheet beam type cavity configurations. The input cavity 312A and output cavity 312E have a re-entrant feature 242 and the middle resonant cavities 312B-D have a non-re-entrant feature 244 (i.e., cavity without a re-entrant feature or non-re-entrant resonant cavity).

The resonant cavity structure 312 or 312A-E include resonant cavity wide upper wall 316A-E and resonant cavity wide lower wall 317A-E along the length and width of the resonant cavity in the x-z plane, resonant cavity front end wall 318A-E and resonant cavity rear end wall 319A-E along the width and height of the resonant cavity in the x-y plane, and resonant cavity side walls or resonant cavity narrow walls 314A-D along length and height of the resonant cavity in the y-z plane. The resonant cavity wide wall 316A-E or 317A-E is defined by the cavity width (plus the thickness of the wall on each end) and the cavity length (plus the thickness of the wall on each end) and defines the cavity height. The resonant cavity end wall 318A-E or 319A-E is defined by the cavity barbell height (or cavity height without a barbell type feature) (plus the thickness of the wall on each end) and the cavity width (plus the thickness of the wall on each end), defines the cavity length, and includes an opening for the drift tube cavity 320A-F and couples to the drift tube section 324A-F. The resonant cavity narrow wall 314A-D is defined by the cavity barbell height (or cavity height without a barbell type feature) (plus the thickness of the wall on each end) and the cavity length (plus the thickness of the wall on each end) and defines the cavity width. The output resonant cavity structure 312E can have an iris or aperture 315, such as a discontinuity in the resonant cavity wide wall 316E or 317E, that separates the output resonant cavity structure 312E from the output waveguide 348. In other examples (not shown), the discontinuity may occur in the out resonant cavity end wall 318E or 319E.

The drift tube sections 324A-F include drift tube wide upper wall 326A-F and drift tube wide lower wall 327A-F along length and width of the drift tube in the x-z plane, and drift tube side walls or drift tube narrow walls 325A-F along length and height of the drift tube in the y-z plane. The drift tube wide wall 326A-F or 327A-F is defined by the drift tube section width 382 A-F (plus the thickness of the wall on each end) and the drift tube section void length (or less) and defines the drift tube section height. The drift tube wide wall 326A-F or 327A-F may also be referred to as the major wall along the major axis. Due to the relatively wide drift tube section width 382A-F of the drift tube wide wall 326A-F or 327A-F and high vacuum generated on the drift tube sections (and device and also the cavity structures), the drift tube wide wall may be reinforced or have a thicker wall. In some examples, a stiffener material (i.e., second material) may be layered on the drift tube wide wall. The drift tube narrow wall 325A-F is defined by the drift tube section height (plus the thickness of the wall on each end) and the drift tube section void length (or less) and defines drift tube section width 382 A-F. The drift tube narrow wall 325A-F may also be referred to as the minor wall along the major axis.

FIG. 10H shows a change 386 in drift tube width between sections between the drift tube narrow or side walls 325C-F, and FIG. 10I shows a change 384 in drift tube width between sections between the drift tube narrow or side walls 325B-F. In other examples (not shown), the various drift tube narrow or side walls 325A-F may have different forms, surfaces, or textures, such as those shown in FIGS. 5I-5J and 6A-6F.

Conventionally, drift tube section lengths between the input resonant cavity and intermediate resonant cavities are similar. As previously discussed, the drift tube section length between the output resonant cavity and the preceding resonant cavity (i.e., the penultimate cavity) can be shortened as a quarter wavelength function of the working frequency of the vacuum electron device to generate the output signal.

In an example, a hollow tube structure of a vacuum electron device (e.g., SBK) includes at least three resonant cavities (e.g., an input resonant cavity or intermediate resonant cavities, but not an output resonant cavity) and at least two drift tube sections. A first drift tube section of the at least two drift tube sections is disposed between a first resonant cavity and a second resonant cavity of the at least three resonant cavities, and a second drift tube section of the at least two drift tube sections is disposed between the second resonant cavity and a third resonant cavity of the at least three resonant cavities. Referring to FIG. 5E, a drift tube section length (e.g., 286C) of the first drift tube section (e.g., 280C) is substantially different from a drift tube section length (e.g., 286D) of the second drift tube section (e.g., 280D). In a configuration, the drift tube section length of the first drift tube section is 0.7% to 15% different (e.g., greater) than the drift tube section length of the second drift tube section while still being than less than one tenth (1/10) wavelength of the working frequency. For example, if the first drift tube section length 286D is 55 mm, then the second drift tube section length 286C is greater than 55.4 mm (i.e., 390 μm or 0.7% greater than the first drift tube section length) and less than 63.3 mm (i.e., 8.25 mm or 15% greater than the first drift tube section length). In another example, a difference between the drift tube section length of the first drift tube section and the second drift tube section is greater by a specified factor (e.g., five times) of a manufacturing tolerance (e.g., a tolerance of 76.2 μm for a 2.856 GHz device; or at least 0.381 mm for a specified factor of 5 times the manufacturing tolerance) and less than one tenth (1/10) wavelength of the working frequency (e.g., approximately 1.05 cm).

In another configuration, a first drift resonant frequency for a transverse mode of the first drift tube section is approximated by Expression 18, and a second drift resonant frequency for a transverse mode of the second drift tube section is represented by Expression 19, and a delta drift resonant frequency is represented by Expression 20, where the delta drift resonant frequency is at least 0.6% for each transverse mode whose resonant frequency is less than two times the operating frequency and less than two times the cutoff frequency. For example, using the example of an S-band SBK designed to operate at around 2.856 GHz, the drift tube section 280D with the drift tube section length 286D of 55 mm is configured to generate a 4.035 GHz peak drift resonant RF field for a $TE_{302}$ mode, and drift tube section 280C with the drift tube section length 286C of 56 mm is configured to generate a 4.072 GHz peak drift resonant RF field for the $TE_{302}$ mode (with other dimensions, parameters, and features being similar between the resonant cavities and drift tube sections). The difference between the peak drift resonant RF fields between drift tube section 280D and drift tube section 280C is 37 MHz, which is 0.9% of 4.035 GHz peak drift resonant RF field, which is at least 0.6% (i.e., 24.4 MHz) of the peak of the first drift resonant RF field. In another example, the delta drift resonant frequency is at least 0.8% for each transverse mode.

A change in the drift tube section length can change the working frequency of the adjacent resonant cavities. Other dimensions and parameters may vary or change, such as the cavity height of the adjacent resonant cavities to maintain a similar working frequency for the adjacent resonant cavities.

In another example, a hollow tube structure of a vacuum electron device (e.g., SBK) includes at least three resonant cavities and at least two drift tube sections with a first drift tube section disposed between a first resonant cavity and a second resonant cavity and a second drift tube section disposed between the second resonant cavity and a third resonant cavity. The at least two drift tube sections can include a drift tube material. The drift tube material can be similar to the wall material of a remainder of the hollow tube structure. The second drift tube section can include a material (e.g., wall material) along at least one interior wall (e.g., a minor interior wall of the drift tube narrow wall 325A-F or a major interior wall of the drift tube wide wall 326A-F or 327A-F) of the second drift tube section. In some examples, the material along the at least one interior wall may be a material that differs from the material of the rest of the wall or the remainder of the hollow tube structure (e.g., other drift tube sections and the resonant cavities). An electromagnetic property of the material is substantially different from a permeability and permittivity of vacuum. The electromagnetic property includes magnetic permeability or permittivity. The permeability of a vacuum or vacuum permeability is represented as $\mu_0=4\pi\times10^{-7}$ newton per amperes squared $(N/A^2)\approx1.2566370614\times10^{-6}$ $N/A^2$. A relative permeability, $\mu_r$, is a ratio of the permeability of a specific medium, $\mu$, to the vacuum permeability, $\mu_0$, represented as $$\mu_r = \frac{\mu}{\mu_0}.$$

A material that has different permeability from vacuum permeability has a relative permeability greater than 20 at room temperature (e.g., 25° C.) and input frequency. The permittivity of a vacuum or vacuum permittivity is represented as $\epsilon_0$=8.8541878176×10-12 farads per meter (F/m). A relative permittivity, $\epsilon_r$, is a ratio of the permittivity of a specific medium, $\epsilon$, to the vacuum permittivity, $\epsilon_0$, represented as $$\varepsilon_r = \frac{\varepsilon}{\varepsilon_0}.$$

A material that has substantially different permittivity from vacuum permittivity has a relative permittivity greater than 2 at room temperature (e.g., 25° C.) and the input frequency.

In another configuration, a first drift resonant frequency for a transverse mode of the first drift tube section is approximated by Expression 18, and a second drift resonant frequency for a transverse mode of the second drift tube section is represented by Expression 19, and a delta drift resonant frequency is represented by Expression 20, where the delta drift resonant frequency is at least 0.6% for each transverse mode. In another example, the delta drift resonant frequency is at least 0.8% for each transverse mode whose resonant frequency is less than twice the operating frequency less than two times the cutoff frequency.

Reducing Parasitic Cavity Quality Factor by Modifying Reflection Coefficient

In the second method or approach, more RF power in the trapped or parasitic mode is allowed to radiate out of the drift tube section (e.g., the unintended cavity). The external quality factor, $Q_e$, is lowered and the inverse of the total quality factor, $1/Q_T$, is increased for the drift tube section, which increases the threshold for oscillation and decreases growth rates for the trapped or parasitic modes.

From transmission line theory, a change in the impedance along a line results in a reflection of some of the fields propagating on the line. The reflection coefficient (e.g., voltage reflection coefficient), $\Gamma$, can be represented by Expression 23.

$$\Gamma = \frac{Z - Z_o}{Z + Z_o} \quad \text{[Expression 23]}$$

where $Z_o$ is the transmission line impedance and Z represents the impedance of the disturbance on the line. For a rectangular or cuboid waveguide (e.g., SBK drift tube section or resonant cavity), the wave impedance, $Z_{w,mn}$, for the $TE_{mn}$ mode is given by Expression 24.

$$Z_{w,mn} = \frac{\sqrt{\mu/\varepsilon}}{\sqrt{1-\left(\frac{f_{c,mn}}{f}\right)^2}} \quad \text{[Expression 24]}$$

where $\mu$ represents a permeability of a medium or material (e.g., transmission medium), c represents a permittivity of the medium or material, $f_{c,mn}$ is the cutoff frequency of the $TE_{mn}$ mode interacting with the cavity, and f is the input or operating frequency of the device. If the transmission line is terminated in a short (Z=0) or open (Z=infinite), the entire field is reflected back and the magnitude of the reflection coefficient, $\Gamma$, is one (1). Referring to Expression 6, the cavity impedance has a peak at resonance. At resonance, the cavity impedance, $Z_n(\omega)$, is purely real (i.e., no imagery component) and equal to $Q_T$*(R/Q). Thus, when a propagating TE mode in the drift tube is incident on the cavity (e.g., drift tube section), a large reflection coefficient can occur near resonance for the TE mode. To modify the response to the propagating TE mode, various parameters can be changed, such as the transmission line impedance, $Z_{w,mn}$, the resonant frequency for the mode interacting with the cavity, the unloaded quality factor, $Q_o$, the external quality factor, $Q_e$, or the R/Q for the TE mode interacting with the cavity.

The drift tube cavity may be modeled in similar fashion to an open resonator. The reflections from two resonant cavities form the resonator. To achieve the relationship for resonance, the relationship on phase given by Expression 25 should be approximately satisfied. The resulting external quality factor is given by Expression 26 and is approximately equivalent to that shown in Expression 27 when Expression 25 is approximately satisfied.

$$2\beta_g L + \text{phase}(\Gamma_1) + \text{phase}(\Gamma_2) \approx 2q\pi, \text{ where } \beta_g = \omega\sqrt{\mu\epsilon}\sqrt{1-(f/f_c)^2} \quad \text{[Expression 25]}$$

$$Q_e \approx \frac{\beta_g L}{2\propto L - \ln|\Gamma_1| - \ln|\Gamma_2|}\left(1-\left(\frac{f_c}{f}\right)^2\right)^{-1} \quad \text{[Expression 26]}$$

$$Q_e \approx \left(\frac{\omega}{c}\right)^2\left(\frac{L}{\beta_g}\right)\frac{1+|\Gamma_1|^2|\Gamma_2|^2}{1-|\Gamma_1|^2|\Gamma_2|^2} \quad \text{[Expression 27]}$$

where $\beta_g$ is the guide wavenumber, $\Gamma_1$ is the reflection coefficient at a first resonant cavity, $\Gamma_2$ is the reflection coefficient at a second resonant cavity, L is the length between the resonators (e.g., midpoint to midpoint), q is an integer, $\omega$ is the input or operating angular frequency of the resonator, $\mu$, represents a permeability of a medium or material, $\epsilon$ represents a permittivity of the medium or material, f is the input or operating frequency, $f_c$ is the cutoff frequency, $\alpha$ is a constant to represent the loss of the medium (or 0 for a vacuum), and c is the speed of light in vacuum. Note that for reflection coefficient near one that $\ln|\Gamma_1|\approx1-|\Gamma_1|$ or $\ln|\Gamma_2|\approx1-|\Gamma_2|$. Expressions 25-27 are approximations due to end-effects and fringe fields at the end of the waveguide, thus correction factors are used to take into account the end-effects and fringe fields. The difference due to change in quality factor is given by Expression 28.

$$\left|\frac{Q-Q'}{Q}\right| = \left|\frac{\ln(\Gamma_1'\Gamma_2') - \ln(\Gamma_1\Gamma_2)}{\ln(\Gamma_1'\Gamma_2')}\right| \approx \left|\frac{(\Gamma_1\Gamma_2) - (\Gamma_1'\Gamma_2')}{1-(\Gamma_1'\Gamma_2')}\right| \quad \text{[Expression 28]}$$

where Q is the quality factor (i.e., first quality factor), Q' is another quality factor (i.e., second quality factor), $\Gamma_1$ is the reflection coefficient at a first resonant cavity (i.e., first reflection coefficient at a first resonant cavity), $\Gamma_2$ is the reflection coefficient at a second resonant cavity (i.e., first reflection coefficient at a second resonant cavity), $\Gamma_1'$ is another reflection coefficient at the first resonant cavity (i.e., first reflection coefficient at a first resonant cavity), $\Gamma_2'$ is another reflection coefficient at the second resonant cavity (i.e., second reflection coefficient at a second resonant cavity).

Simulation Data

Changes in the drift tube sections (and resonant cavities), such as the drift tube section width, can not only vary the resonant frequency for the trapped modes, these changes can also vary the reflection coefficient. Simulation data is provided to demonstrate the effects (e.g., resonant frequencies and reflection coefficients) due to changes in the drift tube sections and resonant cavities. The computer simulations (including Ansoft High Frequency Structure Simulator [HFSS] eigensolver results for the working mode of the cavities, the $TM_{110}$ mode) are based on a five cavity sheet beam klystron design using oxygen-free copper (OFC) used for structures and no other lossy materials intended to operate at 2.856 GHz. The dimensions of the third resonant cavity 210C were adjusted to generate a resonant frequency of 2.793 GHz and the dimensions of the fourth resonant cavity 210D were adjusted to generate a resonant frequency of 2.895 GHz (i.e., resonant cavities vary as approximately 40 to 45 MHz per mm change in the cavity height 214A or 214E for the $TM_{110}$ mode). The cavity height 214A was changed so that the frequency did not change significantly for the different configurations used in the simulations. The dimensions for the base drift tube section 230A-230F used in the simulations for comparison has a drift tube width 222 of 150 mm and a drift tube height 224 of 9 mm with measurements taken on the third resonant cavity 210C and the fourth resonant cavity 210D. The drift tube section void length 236B-D (defined by the midpoints of the resonant cavities 210A-D) is 56 mm, except the drift tube section void length 236E (defined by the midpoint between the penultimate cavity 210D to final cavity 210E spacing) is shorter. In a simulation A and configuration A, the third resonant cavity 210C (third cavity or cavity 3) has a cavity height 214A of 52.157 mm and a barbell height 215 of 82.089 mm, the fourth resonant cavity 210D (fourth cavity or cavity 4) has a cavity height 214A of 50.205 mm and a barbell height 215D of 74.359 mm, and the third and fourth cavities 210C-D have re-entrant type structure with a cavity length 216 of 9 mm and a re-entrant gap length 217 of 6 mm. The unloaded quality factor, $Q_o$, for the third and fourth cavities were 5270 and 5310, respectively, and the R/Q was approximately 11.5 (Ω). For simulation B and configuration B, the fourth cavity is similar to simulation A and cavity three was re-designed without a re-entrant structure and cavity length 216 of 7 mm, a cavity height 214A of 56.549 mm, and a barbell height 215 of 99.0 mm. The unloaded quality factor, $Q_o$, for the third cavity was 4880 and the R/Q was approximately 9.5Ω (without the re-entrant structure). For simulation C and configuration C, the third cavity 210C has a cavity height 214A of 52.231 mm and a barbell height 215 of 82.089 mm (similar to simulation A), the fourth resonant cavity 210D has a cavity height 214A of 50.220 mm and a barbell height 215D of 74.359 mm (similar to simulation A), and the third and fourth cavities 210C-D have re-entrant type structure with a cavity length 216 of 9 mm and a re-entrant gap length 217 of 6 mm. The drift tube section width 222 of drift tube section 230D between the third and fourth cavities 210C-D was changed to 153.3 mm. The unloaded quality factor, Q°, for the third and fourth cavities were 5250 and 5310, respectively, (similar to simulation A) and the R/Q was approximately 11.5Ω (similar to simulation A). The gap coupling coefficient, M, was approximately 0.8 for simulations A-C. The largest change in the unloaded quality factor, $Q_o$, and R/Q resulted from changing the third cavity 210C from re-entrant cavity to non-re-entrant cavity, and changing the drift tube section width had a negligible effect on the unloaded quality factor, $Q_o$, and R/Q for the resonant cavities.

Figure 11A:
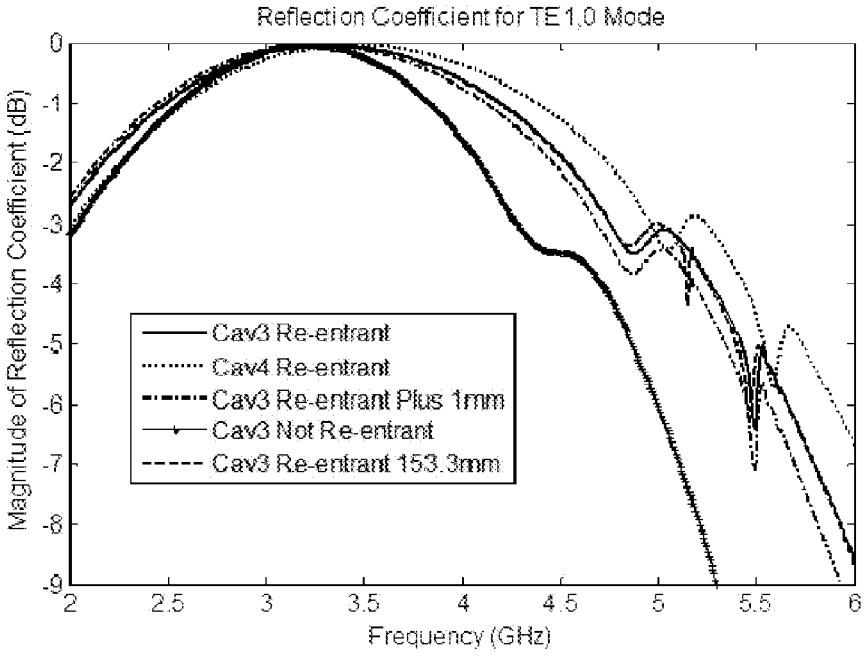
FIGS. 11A-11E illustrate graphs of magnitudes of reflection coefficient versus frequency for various injected modes with different resonant cavity and drift tube section configurations.
Figure 11B:
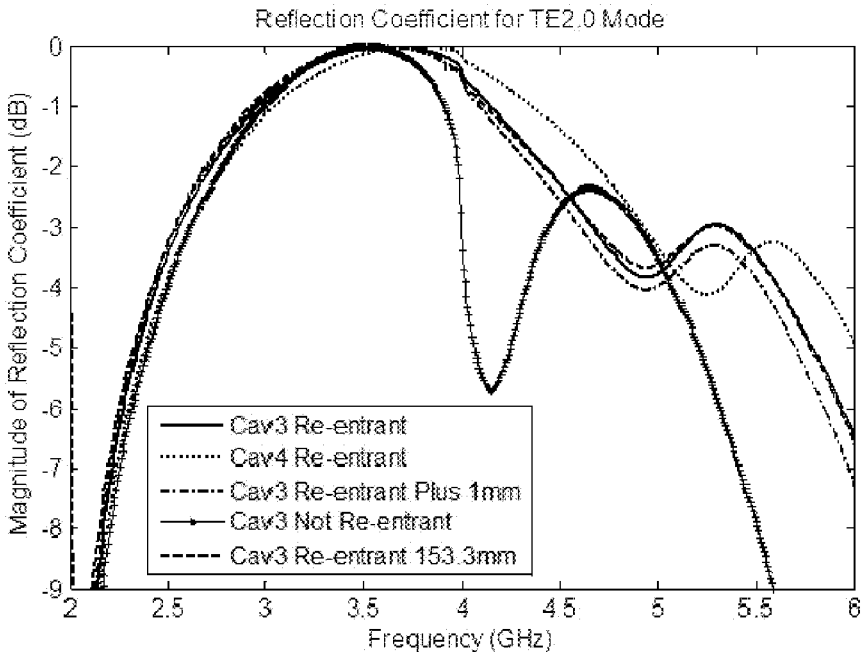
Figure 11C:
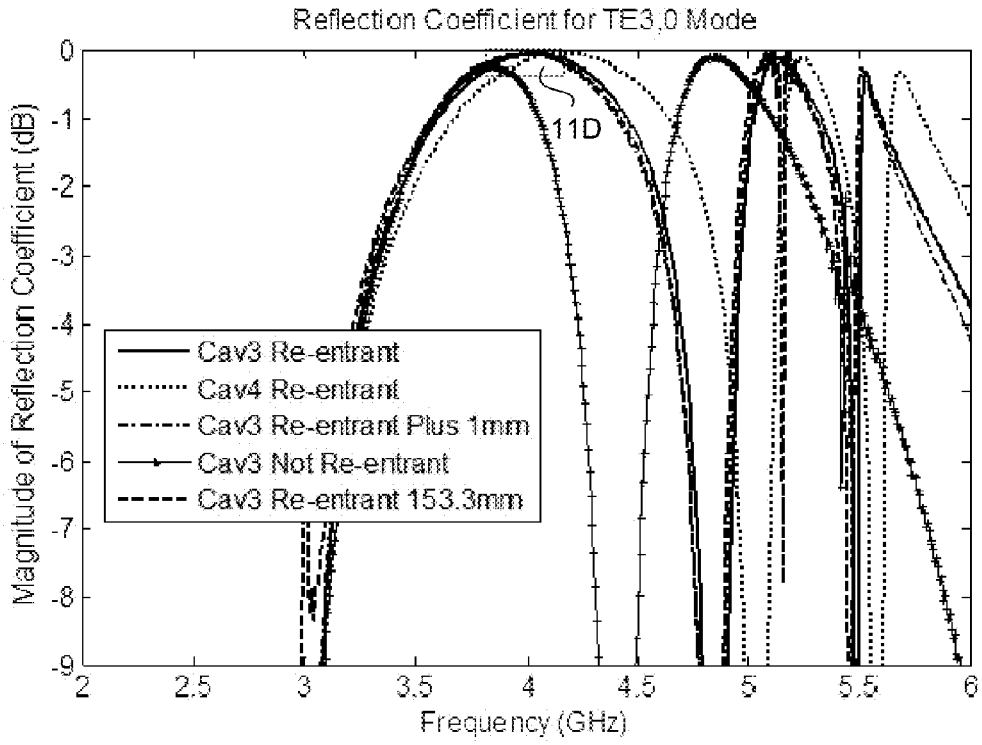
Figure 11D:
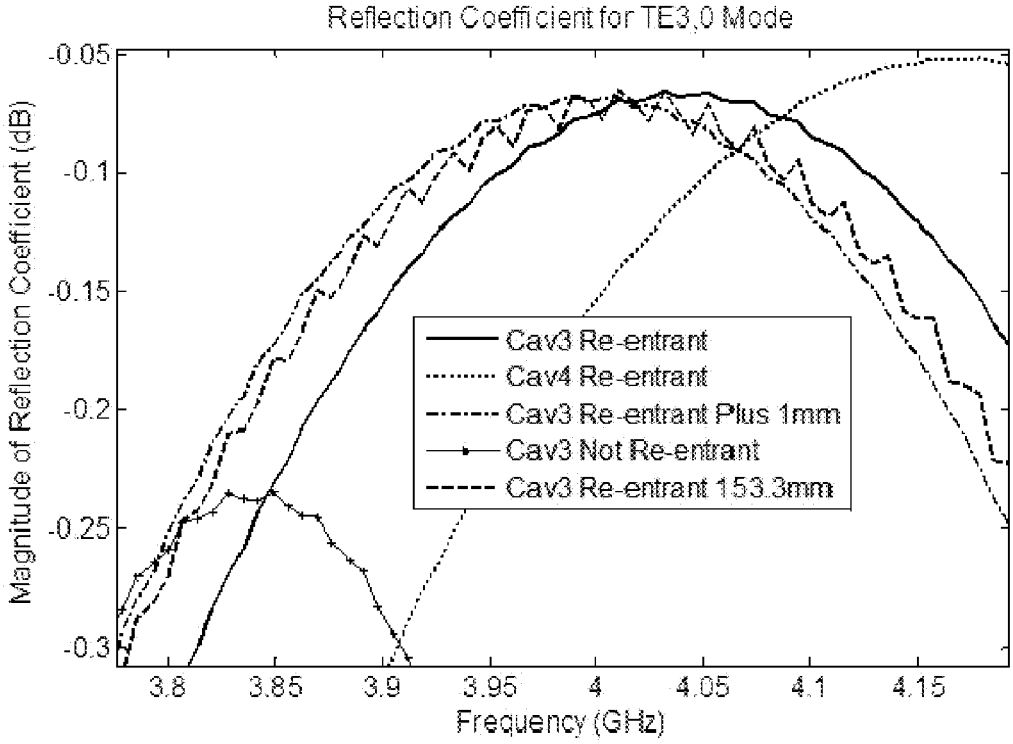
Figure 11E:
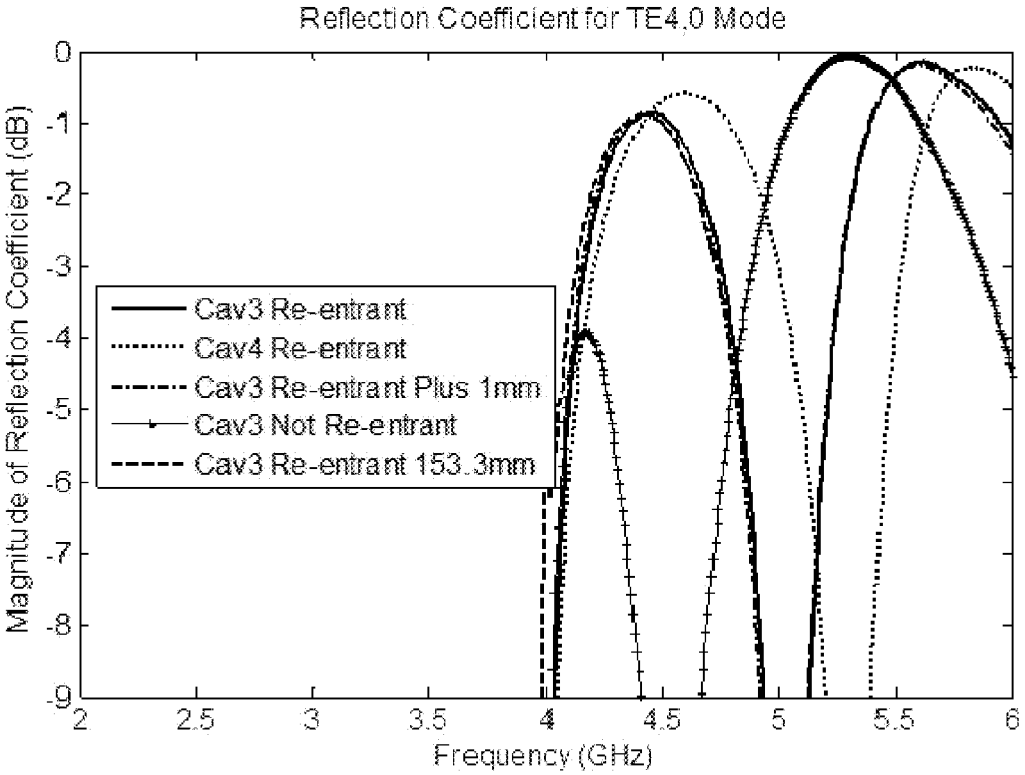

The reflection coefficient was calculated by using the Computer Simulation Technology (CST) time domain solver and injecting a signal at one end of the drift tube section 230D, which propagated toward a resonant cavity 210D. Four different modes, $TE_{10}$, $TE_{20}$, $TE_{30}$, and $TE_{40}$, were injected into the waveguide, representing the drift tube section 230D. FIGS. 11A-11E illustrate graphs of magnitudes of reflection coefficient versus frequency for various injected modes reflected from different resonant cavity and drift tube configurations. FIG. 11A shows the reflection coefficient magnitude for $TE_{10}$. FIG. 11B shows the reflection coefficient magnitude for $TE_{20}$. FIG. 11C shows the reflection coefficient magnitude for $TE_{30}$ and FIG. 11D shows an expanded plot view of FIG. 11C. FIG. 11E shows the reflection coefficient magnitude for $TE_{40}$. Cav3 Re-entrant represents the third cavity from configuration A, Cav4 Re-entrant represents the fourth cavity from configuration A, Cav3 Not Re-entrant represents the third cavity from configuration B, and Cav3 Re-entrant 153.3 mm represents the third cavity from configuration C. Cav3 Re-entrant Plus 1 mm represents the third cavity 210C having a cavity height 214A that is increased by 1 mm (e.g., from 52.157 mm to 53.157 mm in a configuration D) but otherwise similar to configuration A. As shown in the different result, the reflection coefficient has a strong dependence on frequency. In general, resonant cavities with the re-entrant feature have a higher R/Q and unloaded quality factor, $Q_o$, (compared to resonant cavities without the re-entrant feature) as well as a broader peak, which mean re-entrant cavities reflect over a larger frequency band. In configuration D, where the cavity height of the third cavity was increased by 1 mm shifted where the peak in the reflection coefficient occurs, but the change in the cavity height also changes the resonant frequency of the working mode from 2.793 GHz to 2.752 GHz (change of 41 MHz and had small effect on other parameters). In configuration C, changing the drift tube section width 222 also resulted in a slight shift (i.e., decrease) in where the peak in the reflection coefficient occurs, as shown in FIG. 4D. The largest effect was for the third cavity without the re-entrant structure, where R/Q and $Q_o$ were modified along with a slight change (i.e., decrease) in the magnitude of the reflection coefficient, as in configuration B.

From results shown in FIGS. 11A-11E and discussed above, the resonant cavities reflect most of the incident field from the TE mode injected into the waveguide over certain frequency bands. The reflection at these frequencies is similar to placing an open or short at the end of the waveguide except the magnitude of the reflection coefficient is one, independent of frequency (assuming negligible ohmic losses and a waveguide above cutoff). As discussed in relation to Expression 1, a rectangular cavity is formed by placing a conductor at the ends of the waveguide. However, due to the impedance change, a reflection can be generated from the cavity. If cavities are located at the end of a rectangular waveguide, another cavity is formed (i.e., the drift tube section). The unintended cavity for the structure is formed by the drift tube section between the intended cavities or resonant cavities.

FIG. 12 or Table 1 illustrates results of different configurations of the resonant cavities and drift tube sections that include the resonant frequencies (in GHz), the loaded quality factor, $Q_l$ (for Cu), a calculated resonant frequencies of the drift tube sections using middle sections (defined by the drift tube section void length 236D and cavity height 214A) in the resonant cavities, and a calculated resonant frequencies of the drift tube sections using middle sections and end section (defined by the barbell feature and barbell height 215 and 215D) in the resonant cavities, as explained in greater detail below. In Table 1, Samples or Cases 1-6 summarize the various results for the $TM_{110}$ modes operating in the intended cavities or resonant cavities. Samples or Cases 7-15 provide the results for the $TE_{302}$ mode that operates in the unintended cavity formed by the drift tube sections and different permutations of the resonant cavities. To compute the loaded quality factor, $Q_l$, for the resonant cavity, the simulations assumed copper and that RF power not contained in the drift tube sections was absorbed in the background simulation domain (using perfect matched layer [PML] boundary at ends of drift tubes open to simulation boundary).

As shown from FIGS. 11A-11E, modes with high reflection coefficients near resonance with the cavities for the particular mode may cause the drift tube cavity to have a high quality factor (Q). The largest value of the magnitude of the reflection coefficient is the peak magnitude. As shown in Table 1 (FIG. 12), Q's on the order of 1200 and above can be considered nominal (for $TE_{302}$ mode). Lowering the reflection coefficient of a mode decreases the quality factor. To have at least a 33% difference of the quality factor, the Q's need to be lower than 800 at drift tube resonance, which is preferred in an example giving a percent difference of 33% of the quality factor. Using Expression 26 or 27 with an empirical constant ($\alpha$) of 3.5, the reflection coefficient can be changed until the quality factor is approximately 800 (Q~800) or lower from 1200. If the product of the two reflection coefficients (i.e., $\Gamma_1*\Gamma_2$) is approximately 0.97 (0.985*0.985=0.97), then the quality factor is approximately 800. The reflection coefficients product or 0.97 represents a 20% change in Q from 1000 and 33.3% change from 1200. The 0.985 reflection coefficient can also be represented as a reflection coefficient of −0.13 dB. Note that 0.98*0.98 (−0.176 dB) reflection coefficients product reduces Q to −600, 0.975*0.975 (−0.22 dB) reflection coefficients product reduces Q to ~500, and 0.97*0.97 (−0.265 dB) reflection coefficients product reduces Q to ~400. If the reflection coefficient is kept relatively fixed, the quality factor is very insensitive to changes in frequency or drift tube section length (i.e., sensitivity is mainly from the $1/(1-\Gamma_1\Gamma_2)$ factor represented in Expression 28).

In an example with a hollow tube structure of a vacuum electron device that includes at least three resonant cavities and at least two drift tube sections, a peak magnitude of a reflection coefficient from the at least two drift tube sections for each transverse mode is less than 0.13 dB at the drift resonant frequency for the transverse mode for at least one drift tube section for transverse modes whose resonant frequency is less than two times an operating frequency and whose resonant frequency is less than two times a cutoff frequency.

In an example with a hollow tube structure of a vacuum electron device that includes at least three resonant cavities and at least two drift tube sections, a peak product of a magnitude of reflection coefficients (or reflection coefficients product) from the two resonant cavities on each end of the drift tube section is less than 0.97 for a transverse mode for at least one drift tube section for transverse modes whose resonant frequency is less than two times an operating frequency and whose resonant frequency is less than two times a cutoff frequency.

Case 10 provides the results of an HFSS eigensolver simulation of the $TE_{302}$ mode (i.e., parasitic mode) for the unintentional cavity 230D using configuration A. In simulation, the y-component (i.e., along the y-axis) of the electric field (E-field) acts to kick electrons that are present toward the drift tube walls. In Case 10, the simulation give a resonant frequency of 4.072 GHz and a loaded quality factor $(1/Q_o+1/Q_e)^{-1}$ of 1000 when copper is used for the structure. The large quality factor (i.e., 1000) indicates that the unintentional cavity formed by drift tube section is quite strong and has potential to grow for power coupled into the mode (via the electron beam). The Case 10 loaded quality factor (i.e., approximately 1000) is on the same order as the quality factors (i.e., approximately 5000) for the resonant cavities in their working mode (i.e., $TM_{110}$ mode). A rough prediction of the resonant frequency for the drift tube section in configuration A can be approximated or estimated using Expression 1. The drift tube section width 222 provides dimension for 'a' and drift tube section height 224 provides dimension for 'd'. For 'd', the drift tube section void length 236A-F can be used as well as half the cavity height 214A for each resonant cavity. For Case 10, the calculated resonant frequency of the drift tube section 230D using the middle sections (i.e., half the cavity height) is 4.100 GHz. Some of the RF field also goes into a side part or region (i.e., barbell area) of the resonant cavity. A slightly more accurate prediction for the resonant frequency can be calculated by repeating the calculation above but including 93% of the cavity height calculation and 7% due to the side regions (formula found empirically), giving a resonant frequency 4.067 GHz. The calculated resonant frequency of the drift tube section using the middle sections (Calc. Res. Freq. Using Mid. Sects.) and calculated resonant frequency of the drift tube section using the middle and end sections (Calc. Res. Freq. Using Mid. and End Sects.) can also be generated for cases 7-9 and 11-15.

Case 1 provides results for the third resonant cavity in configuration A, and Case 2 provides results for the fourth resonant cavity in configuration A. Case 3 provides results for the third resonant cavity in configuration B. Case 4 provides results for the third resonant cavity in configuration C, and Case 5 provides results for the fourth resonant cavity in configuration C. Case 6 provides results for the third resonant cavity in configuration D.

Case 7 (i.e., configuration E) provides results for the drift tube section between the third and fourth resonant cavities, where both the third and fourth resonant cavities have similar dimensions to the third resonant cavity in configuration A. Of the $TE_{302}$ mode cases (i.e., Cases 7-15), Case 7 had the highest loaded quality factor, $Q_l$ (i.e., 1550). As illustrated by FIG. 11D, the resonant frequency for the $TE_{302}$ mode occurs where the reflection coefficient at the resonant cavities forming the ends of the unintentional cavity are the greatest. Case 8 (i.e., configuration F) provides results for the drift tube section between the third and fourth resonant cavities, where both the third and fourth resonant cavities have similar dimensions to the third resonant cavity in configuration D.

Case 8 only changes the resonant frequency for the parasitic mode (i.e., $TE_{302}$ mode) by 15 MHz (i.e., 4.047-4.032 GHz from Cases 7 and 8), but changes the working mode (i.e., $TM_{110}$ modes) resonant frequency by 41 MHz (i.e., 2.793-2.752 GHz from Cases 1 and 6). As shown by Case 8, a small move in the resonant frequency slightly shifted the loaded quality factor, $Q_l$ (i.e., from 1550 to 1300).

Case 9 (i.e., configuration G) provides results for the drift tube section between the third and fourth resonant cavities, where both the third and fourth resonant cavities have similar dimensions to the third resonant cavity in configuration B without a re-entrant structure. In Case 9, the resonant frequency changed by 82 MHz (i.e., 4.047-3.965 GHz) due to the larger cavity height (i.e., 56.549 mm instead of approximately 52.157 mm). From FIG. 11D, the peak in the reflection coefficient peak for the drift tube section was lowered (by at least 0.15 dB), leading to a significantly lower loaded quality factor of 270.

As previously discussed, Case 10 provides results for the drift tube section between the third and fourth resonant cavities using configuration A.

Case 11 provides results for the drift tube section between the third and fourth resonant cavities using configuration D, which is similar to Case 10 with 1 mm added to the cavity height to the third cavity. Only a small change in resonant frequency (i.e., 8 MHz=4.067-4.059 GHz) of the drift tube section occurs, especially when compared to the change in resonant frequency (i.e., 41 MHz=2.793-2.752 GHz between Cases 1 and 6) of the intended cavity or resonant cavity. Case 11 has a lower loaded quality factor (i.e., 800) compared to the loaded quality factor (i.e., 1000) Case 10 due to the change in reflection coefficients.

Case 12 (i.e., configuration H) is similar to Case 11 but with third cavity without a re-entrant structure resulting in a resonant frequency of 4.023 GHz and a loaded quality factor of 170. With offsetting reflection coefficients (i.e., little overlapping in reflection coefficients) the loaded quality factor is lowered.

For Case 13 (i.e., configuration I), configuration H was used but with the drift tube section void length (i.e., distance between resonant cavities) reduced by 1 mm to 55 mm. The change in drift tube section void length resulted in an increase of resonant frequency of 17 MHz (4.040-4.023 GHz between Cases 12 and 13), which further lowered the loaded quality factor to 150. The lower loaded quality factor was at partially because more RF field or energy was lost out of the third cavity than was gained from increased reflection coefficient in the fourth cavity.

Case 14 provides results for the drift tube section between the third and fourth resonant cavities using configuration C. In Case 14, configuration C is similar to configuration A but the drift tube section width between the two resonant cavities is increased by 3.3 mm. The small change in the drift tube section width resulted in a 47 MHz resonant frequency change (i.e., 4.067-4.020 GHz between Cases 10 and 14). As discussed previously, for a fixed electron beam changing the drift tube section width has a negligible (i.e., very small) effect on other parameters of the vacuum electron device (e.g., klystron), making a change in the drift tube section width a very efficient way to change the frequency of the unintended cavity formed by the drift tube section. For Case 14, the 47 MHz change in resonant frequency resulted in a slight decrease in quality factor going from 1000 to 900.

For Case 15 (i.e., configuration J), configuration H was used but the drift tube section 230C on the input side of third cavity 201C (not part of unintended cavity formed by drift tube section 230D) was changed to 153.3 mm (i.e., increased by 3.3 mm). The resonant frequency of the drift tube section was almost unchanged (at 4.067 GHz) but changed the quality factor from 1000 to 840. The magnitudes of the E-fields for lower loaded quality factor cases (e.g., Cases 9, 12, and 13) the RF fields radiate away from the unintentional cavities formed by the drift tube sections. Changing the reflection coefficient between drift tube sections at the ends of the unintentional cavity (i.e., drift tube section) also allows RF fields to radiate out of the drift tube sections and can be useful to lower the total quality factor. As shown, a variety of structural changes can be made to change the resonant frequency of the drift tube section.

Also shown from Table 1 (e.g., Case 13), a change in the drift tube section void length between the cavities also effects the resonant frequency. However, a change in the drift tube section void length can also alter the operation of the intended klystron (e.g., resonant cavities). Modifying the cavity design, such as going from a re-entrant structure to having no re-entrant structure, also altered the resonant frequency. The effect of the non-re-entrant structure was due to the different cavity height (to generate the similar resonant frequency). However, a non-re-entrant cavity also decreased R/Q and unloaded quality factor, $Q_o$. Adding material, having relative permittivity or permeability greater than one can also change or effect the resonant frequencies. However, using different materials in the vacuum electron device can be more difficult to fabricate, especially at higher frequencies where the dimensions are smaller.

The structures and design parameters described can change the resonant frequency of the unintended cavities formed by the drift tube sections to decrease the frequency overlap the drift tube sections have with each other to decrease gain in the trapped modes, which can be beneficial in the design of sheet beam klystrons with multiple cavities where the drift tube is not cutoff. As described, many mechanisms and structures can change the resonant frequency of the drift tube sections. For example, in the SBK, one of the changes that has the least effect on the intended klystron operation (e.g., resonant frequency of the resonant cavities) is varying the drift tube section width. In addition or alternatively, changing the shape of the resonant cavity, such as changing the cavity width or switching between re-entrant or non-re-entrant features, or changing the drift tube section void length can also change the resonant frequency of the drift tube sections (but changes to other parameters may be more significant than changing the drift tube section width). These other changes can affect the performance of the intended klystron, but may be an acceptable tradeoff based on the klystron design.

The technology (e.g., concepts, principles, mechanisms, structures, features, parameters, methods, systems, and devices) described can reduce, minimize, lessen, or in some cases even eliminate the effects of TE mode instability, which has impaired the usefulness of sheet beam klystrons. The attractiveness of an SBK for use as RF sources derives from: the reduced energy and thermal densities due to increased surface areas; the reduced current densities possible as the beam becomes wider; the reduced magnetic field, cathode loading and reduction of some instabilities resulting from the reduced current density; and the potential for lower device cost. Using the technology described helps to realize these benefits.

Although the structures, features, and parameters discussed were illustrated with sheet beam klystrons, analogous techniques, structures, features, and parameters may also be used to help suppress the parasitic modes of other vacuum electron devices, such as the extended interaction klystrons (EIKs) and relativistic klystron amplifiers (RKAs).

Although the concepts were applied to specific examples (e.g., at specific frequencies), the technology is more general and do not depend on many of the parameters discussed in the specific examples. The technology does not depend on the frequency of the device and can be implemented over any frequency band, especially in the microwave bands. The technology is independent of the type of focusing magnetic field being used and can be used for both electromagnet (e.g., solenoid), permanent magnet, and periodic magnet type focusing. As shown for a sheet beam device, the drift tube section width can be changed with a small or negligible effect on other parameters. The examples that illustrate the geometry are not necessarily optimum, but are used for illustration. Similarly, a change in resonant frequency of the unintended cavity can also be obtained by placing a material having a permeability or permittivity greater than one (1) in the drift tube sections to change the resonant frequency rather than modifying the cavity walls, however added additional materials can make manufacturing more difficult and expensive. The change in resonant frequency due to materials in the drift tube sections can be seen by looking at the dependence of permeability and permittivity in Expression 1. Instead of changing the width a, or length d, one would change the material to effect $\mu$ and/or $\epsilon$. The technology described can be used for multiple and extended interaction type cavities that can also use sheet beams.

During vacuum electron device design, such as SBK design, the drift tube section width or drift tube section length can be varied in accordance with the description above.

All references recited herein are incorporated herein by specific reference in their entirety.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

Furthermore, the described features, structures, or characteristics may be combined in a suitable manner in one or more embodiments. In the previous description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

While the forgoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited. Various features and advantages of the invention are set forth in the following claims.

What is claimed is:

1. A vacuum electron device, comprising:

a hollow tube structure comprising:

at least three resonant cavities, each resonant cavity includes a cavity width along a major axis, a cavity height along a minor axis, and a cavity length along a propagation axis, and the major axis is substantially orthogonal to the minor axis;

at least two drift tube sections, each drift tube section includes a drift tube section width along the major axis, a drift tube section height along the minor axis, and a drift tube section length along the propagation axis, and the cavity height is greater than the drift tube section height;

a first drift tube section of the at least two drift tube sections is disposed between a first resonant cavity and a second resonant cavity of the at least three resonant cavities;

a second drift tube section of the at least two drift tube sections is disposed between the second resonant cavity and a third resonant cavity of the at least three resonant cavities; and a drift tube section width of the first drift tube section is substantially different from a drift tube section width of the second drift tube section.

2. The vacuum electron device of claim 1, wherein for each drift tube section, the drift tube section width is at least twice the drift tube section height.

3. The vacuum electron device of claim 1, wherein the drift tube section width of the first drift tube section is at least 0.3% greater than the drift tube section width of the second drift tube section.

4. The vacuum electron device of claim 1, wherein the first drift tube section is configured to generate a first drift resonant radio frequency (RF) field and the second drift tube section is configured to generate a second drift resonant RF field, and a peak of the first drift resonant RF field varies from a peak of the second drift resonant RF field by at least 0.6% of the peak of the first drift resonant RF field for transverse modes whose resonant frequency is less than two times an operating frequency and whose resonant frequency is less than two times a cutoff frequency, wherein the first drift tube section and the second drift tube section are not a drift tube section between a penultimate resonant cavity and a final resonant cavity.

5. The vacuum electron device of claim 1, wherein the first drift tube section is configured to generate a first drift resonant radio frequency (RF) field with a first drift bandwidth and the second drift tube section is configured to generate a second drift resonant RF field with a second drift bandwidth, and a peak of the first drift resonant RF field varies from a peak of the second drift resonant RF field by at least 1.5 times a sum of the first drift bandwidth and the second drift bandwidth for transverse modes whose resonant frequency is less than two times an operating frequency and whose resonant frequency is less than two times a cutoff frequency wherein the first drift tube section and the second drift tube section are not a drift tube section between a penultimate resonant cavity and a final resonant cavity.

6. The vacuum electron device of claim 5, wherein the first drift bandwidth is given by $(f_{o,mnp}/Q_{L_1,mnp})$ and the second drift bandwidth is given by $(f_{o_2,mnp}/Q_{L_2,mnp})$, where $f_{o_1,mnp}$ is a resonant frequency of the first drift tube section for a transverse mode, $f_{o_2,mnp}$ is a resonant frequency of the second drift tube section for the transverse mode, $Q_{L_1,mnp}$ is a loaded quality factor of the first drift tube section, and $Q_{L_2,mnp}$ is a loaded quality factor of the second drift tube section.

7. The vacuum electron device of claim 1, wherein a first drift resonant frequency for a transverse mode of the first drift tube section is approximated by $$f_{do_1,mnp} = \frac{1}{2\pi\sqrt{\mu_1\varepsilon_1}}\sqrt{\left(\frac{m\pi}{w_1}\right)^2 + \left(\frac{n\pi}{h_1}\right)^2 + \left(\frac{p\pi}{l_1}\right)^2},$$

where $\mu_1$ is a composite magnetic permeability and $\epsilon_1$ is a composite magnetic permittivity of a volume of a material in the first drift tube section; $w_1$ is the drift tube section width; $h_1$ is the drift tube section height; and $l_1$ is an approximation of the drift tube section length of the first drift tube section, a half of the cavity height of the first resonant cavity, a half of the cavity height of the second resonant cavity, and a correction factor for features of the first resonant cavity, the first drift tube section, and the second resonant cavity; and m, n, and p are non-negative integers representing the transverse mode and m and n are not both zero; and a second drift resonant frequency for a transverse mode of the second drift tube section is represented by $$f_{do_2,mnp} = \frac{1}{2\pi\sqrt{\mu_2\varepsilon_2}}\sqrt{\left(\frac{m\pi}{w_2}\right)^2 + \left(\frac{n\pi}{h_2}\right)^2 + \left(\frac{p\pi}{l_2}\right)^2},$$

where $\mu_2$ is a composite magnetic permeability and $\epsilon_2$ is a composite magnetic permittivity of a volume of a material in the second drift tube section; $w_2$ is the drift tube section width; $h_2$ is the drift tube section height; and $l_2$ is an approximation of the drift tube section length of the second drift tube section, a half of the cavity height of the second resonant cavity, a half of the cavity height of the third resonant cavity, and a correction factor for features of the second resonant cavity, the second drift tube section, and the third resonant cavity; and a delta drift resonant frequency $$\Delta f_{do,mnp} = \left|\frac{f_{do_1,mnp} - f_{do_2,mnp}}{f_{do_1,mnp}}\right|$$

is at least 0.6% for each transverse modes whose resonant frequency is less than two times an operating frequency and whose resonant frequency is less than two times a cutoff frequency, wherein the first drift tube section and the second drift tube section are not a drift tube section between a penultimate resonant cavity and a final resonant cavity.

8. The vacuum electron device of claim 1, wherein a first drift resonant frequency for a transverse mode of the first drift tube section is approximated by $$f_{do_1,mnp} = \frac{1}{2\pi\sqrt{\mu\varepsilon}}\sqrt{\left(\frac{m\pi}{w_1}\right)^2 + \left(\frac{n\pi}{h}\right)^2 + \left(\frac{p\pi}{l}\right)^2},$$

where $\mu$ is a composite magnetic permeability and $\epsilon$ is a composite permittivity of a volume of a material in a drift tube section, $w_1$ is the drift tube section width of the first drift tube section, h is the drift tube section height, and l is an approximation of the drift tube section length of the drift tube section, a half of the cavity height of resonant cavities on each end of the drift tube section, and a correction factor for features of the drift tube section and the resonant cavities on each end of the drift tube section; and m, n, and p are non-negative integers representing the transverse mode and m and n are not both zero, and a second drift resonant frequency for a transverse mode of the second drift tube section is represented by $$f_{do_2,mnp} = \frac{1}{2\pi\sqrt{\mu\varepsilon}}\sqrt{\left(\frac{m\pi}{w_2}\right)^2 + \left(\frac{n\pi}{h}\right)^2 + \left(\frac{p\pi}{l}\right)^2},$$

where $w_2$ is the drift tube section width of the second drift tube section, and a delta drift resonant frequency $$\Delta f_{do,mnp} = \left|\frac{f_{do_1,mnp} - f_{do_2,mnp}}{f_{do_1,mnp}}\right|$$

is at least 0.6% for each transverse modes whose resonant frequency is less than two times an operating frequency and whose resonant frequency is less than two times a cutoff frequency, wherein the first drift tube section and the second drift tube section are not a drift tube section between a penultimate resonant cavity and a final resonant cavity.

9. The vacuum electron device of claim 1, wherein a peak magnitude of a reflection coefficient from the at least two drift tube sections for each transverse mode is less than 0.13 decibels (dB) at a drift resonant frequency for the transverse mode for at least one drift tube section for transverse modes whose resonant frequency is less than two times an operating frequency and whose resonant frequency is less than two times a cutoff frequency.

10. The vacuum electron device of claim 1, wherein a peak product of a magnitude of reflection coefficients from two resonant cavities on each end of the drift tube section is less than 0.97 for a transverse mode for at least one drift tube section for transverse modes whose resonant frequency is less than two times an operating frequency and whose resonant frequency is less than two times a cutoff frequency.

11. The vacuum electron device of claim 1, wherein the at least two drift tube sections have a substantially cuboid shape or a substantially elliptic cylindrical shape.

12. The vacuum electron device of claim 1, wherein the vacuum electron device includes a sheet beam klystron.

13. The vacuum electron device of claim 1, further comprising:

an electron gun assembly coupled to a first end of the hollow tube structure along the propagation axis; and a collector assembly coupled to a second end of the hollow tube structure along the propagation axis.

14. The vacuum electron device of claim 13, further comprising:

a magnetic focusing assembly surrounding at least a portion of the hollow tube structure configured to focus an electron beam.

15. The vacuum electron device of claim 14, wherein the magnetic focusing assembly includes a permanent magnet, a periodic permanent magnet, or an electromagnet.

16. The vacuum electron device of claim 1, wherein the hollow tube structure further comprises:

a third drift tube section of the at least two drift tube sections is disposed between the third resonant cavity and a fourth resonant cavity of the at least three resonant cavities along the propagation axis; and a drift tube section width of the third drift tube section is substantially different from the drift tube section width of the first drift tube section and the drift tube section width of the second drift tube section.

17. The vacuum electron device of claim 16, wherein the drift tube section width of the third drift tube section is at least 0.3% different from the drift tube section width of the first drift tube section or at least 0.3% different from than the drift tube section width of the second drift tube section.

18. The vacuum electron device of claim 16, wherein the third drift tube section is configured to generate a third drift resonant frequency for a transverse mode of the third drift tube section, and the third drift resonant frequency varies from a first drift resonant frequency by at least 0.7% of the third drift resonant frequency and varies from a second drift resonant frequency by at least 0.6% of the third drift resonant frequency.

19. The vacuum electron device of claim 1, wherein at least one of the at least three resonant cavities include a re-entrant feature.

20. The vacuum electron device of claim 1, wherein the at least one of the at least three resonant cavities include a re-entrant feature and the at least one of the at least three resonant cavities includes a non-re-entrant feature.

21. The vacuum electron device of claim 1, wherein at least one of the at least three resonant cavities includes a non-re-entrant feature, and each resonant cavity without a re-entrant feature is referred to as a non-re-entrant resonant cavity.

22. The vacuum electron device of claim 21, wherein a loaded quality factor of at least one drift tube section formed with a resonant cavity with a non-re-entrant feature is at least 20% less than a loaded quality factor of a similar drift tube section formed by resonant cavities with a re-entrant feature.

23. The vacuum electron device of claim 1, wherein at least one of the at least three resonant cavities include a sheet beam type cavity selected from the group consisting of a barbell cavity, a dumbbell cavity, an H-block cavity, a regular cuboid cavity, a slotted ridged waveguide, and a cross-aperture cavity.

24. The vacuum electron device of claim 1, wherein the cavity width is greater than the drift tube section width.

25. The vacuum electron device of claim 1, wherein the cavity width is at least twice the cavity height.

26. A vacuum electron device, comprising:

a hollow tube structure comprising:

at least two resonant cavities, each resonant cavity includes a cavity width along a major axis, a cavity height along a minor axis, and a cavity length along a propagation axis, and the major axis is substantially orthogonal to the minor axis;

at least one drift tube section in a drift tube that includes at least two drift tube section widths along the major axis, a drift tube section height along the minor axis, and a drift tube section length along the propagation axis, the cavity height is greater than the drift tube section height;

a first drift tube section of the at least one drift tube sections is disposed between a first resonant cavity and a second resonant cavity of the at least two resonant cavities; and a first drift tube section width of the at least one drift tube section is substantially different from a second drift tube section width of the at least one drift tube section.

27. The vacuum electron device of claim 26, wherein the first drift tube section width and the second drift tube section width are each at least twice the drift tube section height.

28. The vacuum electron device of claim 26, wherein the at least one drift tube section has a substantially trapezoid shape, a double staircase shape, an exponential shape, a polynomial shape, a linear shape, or a piece wise combination along a plane formed by the major axis and the propagation axis.

29. The vacuum electron device of claim 26, wherein the first drift tube section width is at least 0.3% greater than the second drift tube section width.

30. A vacuum electron device, comprising:

a hollow tube structure comprising:

at least three resonant cavities, each resonant cavity includes a cavity width along a major axis, a cavity height along a minor axis, and a cavity length along a propagation axis, and the major axis is substantially orthogonal to the minor axis;

at least two drift tube sections, each drift tube section includes a drift tube section width along the major axis, a drift tube section height along the minor axis, and a drift tube section length along the propagation axis, and the cavity height is greater than the drift tube section height;

a first drift tube section of the at least two drift tube sections is disposed between a first resonant cavity and a second resonant cavity of the at least three resonant cavities;

a second drift tube section of the at least two drift tube sections is disposed between the second resonant cavity and a third resonant cavity of the at least three resonant cavities; and a drift tube section length of the first drift tube section is substantially different from a drift tube section length of the second drift tube section, wherein the first drift tube section and the second drift tube section are not a drift tube between a penultimate resonant cavity and a last resonant cavity.

31. The vacuum electron device of claim 30, wherein for each drift tube section, the drift tube section width is at least twice the drift tube section height.

32. The vacuum electron device of claim 30, wherein the drift tube section length of the first drift tube section is 0.7% to 15% greater than the drift tube section width of the second drift tube section.

33. The vacuum electron device of claim 30, wherein the first resonant cavity, the second resonant cavity, and the third resonant cavity are not an output resonant cavity.

34. The vacuum electron device of claim 30, wherein the first drift tube section is configured to generate a first drift resonant radio frequency (RF) field and the second drift tube section is configured to generate a second drift resonant RF field, and a peak of the first drift resonant RF field varies from a peak of the second drift resonant RF field by at least 0.6% of the peak of the first drift resonant RF field for transverse modes whose resonant frequency is less than two times an operating frequency and whose resonant frequency is less than two times a cutoff frequency.

35. The vacuum electron device of claim 30, wherein a first drift resonant frequency for a transverse mode of the first drift tube section is approximated by $$f_{do_1,mnp} = \frac{1}{2\pi\sqrt{\mu_1\varepsilon_1}}\sqrt{\left(\frac{m\pi}{w_1}\right)^2 + \left(\frac{n\pi}{h_1}\right)^2 + \left(\frac{p\pi}{l_1}\right)^2},$$

where $\mu_1$ is a composite magnetic permeability and $\epsilon_1$ is a composite magnetic permittivity of a volume of a material in the first drift tube section; $w_1$ is the drift tube section width; $h_1$ is the drift tube section height; and $l_1$ is an approximation of the drift tube section length of the first drift tube section, a half of the cavity height of the first resonant cavity, a half of the cavity height of the second resonant cavity, and a correction factor for features of the first resonant cavity, the first drift tube section, and the second resonant cavity; and m, n, and p are non-negative integers representing the transverse mode and m and n are not both zero; and a second drift resonant frequency for a transverse mode of the second drift tube section is represented by $$f_{do_2,mnp} = \frac{1}{2\pi\sqrt{\mu_2\varepsilon_2}}\sqrt{\left(\frac{m\pi}{w_2}\right)^2 + \left(\frac{n\pi}{h_2}\right)^2 + \left(\frac{p\pi}{l_2}\right)^2},$$

where $\mu_2$ is a composite magnetic permeability and $\epsilon_2$ is a composite magnetic permittivity of a volume of a material in the second drift tube section; $w_2$ is the drift tube section width; $h_2$ is the drift tube section height; and $l_2$ is an approximation of the drift tube section length of the second drift tube section, a half of the cavity height of the second resonant cavity, a half of the cavity height of the third resonant cavity, and a correction factor for features of the second resonant cavity, the second drift tube section, and the third resonant cavity; and a delta drift resonant frequency $$\Delta f_{do,mnp} = \left|\frac{f_{do_1,mnp} - f_{do_2,mnp}}{f_{do_1,mnp}}\right|$$

is at least 0.6% for transverse modes whose resonant frequency is less than two times an operating frequency and whose resonant frequency is less than two times a cutoff frequency.

36. The vacuum electron device of claim 30, wherein the first drift tube section is configured to generate a first drift resonant radio frequency (RF) field with a first drift bandwidth given by ($f_{o_1,mnp}/Q_{L_1,mnp}$) and the second drift tube section is configured to generate a second drift resonant RF field with a second drift bandwidth ($f_{o_2,mnp}/Q_{L_2,mnp}$), where $f_{o_1,mnp}$ is a resonant frequency of the first drift tube section for a transverse mode, $f_{o_2,mnp}$ is a resonant frequency of the second drift tube section for the transverse mode, $Q_{L_1,mnp}$ is a loaded quality factor of the first drift tube section, and $Q_{L_2,mnp}$ is a loaded quality factor of the second drift tube section, and a peak of the first drift resonant RF field varies from a peak of the second drift resonant RF field by at least by at least 1.5 times a sum of the first drift bandwidth and the second drift bandwidth for transverse modes whose resonant frequency is less than two times an operating frequency and whose resonant frequency is less than two times a cutoff frequency, wherein the first drift tube section and the second drift tube section are not a drift tube section between a penultimate resonant cavity and a final resonant cavity.

37. A vacuum electron device, comprising:

a hollow tube structure comprising:

at least three resonant cavities, each resonant cavity includes a cavity width along a major axis, a cavity height along a minor axis, and a cavity length along a propagation axis, and the major axis is substantially orthogonal to the minor axis;

at least two drift tube sections in a drift tube that include a drift tube material, each drift tube section includes a drift tube section width along the major axis, a drift tube section height along the minor axis, and a drift tube section length along the propagation axis, and the cavity height is greater than the drift tube section height;

a first drift tube section of the at least two drift tube sections is disposed between a first resonant cavity and a second resonant cavity of the at least three resonant cavities along the propagation axis;

a second drift tube section of the at least two drift tube sections is disposed between the second resonant cavity and a third resonant cavity of the at least three resonant cavities along the propagation axis, and the second drift tube section includes a wall material along at least one interior wall of the second drift tube section;

wherein an electromagnetic property of the wall material is substantially different from the a permeability and a permittivity of vacuum and a wall material of a remainder of the hollow tube structure.

38. The vacuum electron device of claim 37, wherein at least one interior wall includes a minor interior wall along the minor axis or a major interior wall along the major axis.

39. The vacuum electron device of claim 37, wherein a first drift resonant frequency for a transverse mode of the first drift tube section is approximated by $$f_{do_1,mnp} = \frac{1}{2\pi\sqrt{\mu_1\varepsilon_1}}\sqrt{\left(\frac{m\pi}{w_1}\right)^2 + \left(\frac{n\pi}{h_1}\right)^2 + \left(\frac{p\pi}{l_1}\right)^2},$$

where $\mu_1$ is a composite magnetic permeability and $\epsilon_1$ is a composite magnetic permittivity of a volume of a material in the first drift tube section; $w_1$ is the drift tube section width; $h_1$ is the drift tube section height; and $l_1$ is an approximation of the drift tube section length of the first drift tube section, a half of the cavity height of the first resonant cavity, a half of the cavity height of the second resonant cavity, and a correction factor for features of the first resonant cavity, the first drift tube section, and the second resonant cavity; and m, n, and p are non-negative integers representing the transverse mode and m and n are not both zero; and a second drift resonant frequency for a transverse mode of the second drift tube section is represented by $$f_{do_2,mnp} = \frac{1}{2\pi\sqrt{\mu_2\varepsilon_2}}\sqrt{\left(\frac{m\pi}{w_2}\right)^2 + \left(\frac{n\pi}{h_2}\right)^2 + \left(\frac{p\pi}{l_2}\right)^2},$$

where $\mu_2$ is magnetic permeability and $\epsilon_2$ is a volume of a material in the second drift tube section; $w_2$ is the drift tube section width; $h_2$ is the drift tube section height; and $l_2$ is an approximation of the drift tube section length of the second drift tube section, a half of the cavity height of the second resonant cavity, a half of the cavity height of the third resonant cavity, and a correction factor for features of the second resonant cavity, the second drift tube section, and the third resonant cavity; and a delta drift resonant frequency $$\Delta f_{do,mnp} = \left| \frac{f_{do_1,mnp} - f_{do_2,mnp}}{f_{do_1,mnp}} \right|$$

is at least 0.6% for transverse modes whose resonant frequency is less than two times an operating frequency and whose resonant frequency is less than two times a cutoff frequency, wherein the first drift tube section and the second drift tube section are not a tube section between a penultimate resonant cavity and a final resonant cavity.

40. The vacuum electron device of claim 37, wherein the first drift tube section is configured to generate a first drift resonant radio frequency (RF) field with a first drift bandwidth given by ($f_{o_1,mnp}/Q_{L_1,mnp}$) and the second drift tube section is configured to generate a second drift resonant RF field with a second drift bandwidth ($f_{o_2,mnp}/Q_{L_2,mnp}$), where $f_{o_1,mnp}$ is a resonant frequency of the first drift tube section for a transverse mode, $f_{o_2,mnp}$ is a resonant frequency of the second drift tube section for the transverse mode, $Q_{L_1,mnp}$ is a loaded quality factor of the first drift tube section, and $Q_{L_2,mnp}$ is a loaded quality factor of the second drift tube section, and a peak of the first drift resonant RF field varies from a peak of the second drift resonant RF field by at least by at least 1.5 times a sum of the first drift bandwidth and the second drift bandwidth for transverse modes whose resonant frequency is less than two times an operating frequency and whose resonant frequency is less than two times a cutoff frequency, wherein the first drift tube section and the second drift tube section are not a drift tube section between a penultimate resonant cavity and a final resonant cavity.

* * * * *